US007879519B2

(12) United States Patent
Toda et al.

(10) Patent No.: US 7,879,519 B2
(45) Date of Patent: Feb. 1, 2011

(54) IMAGE BEARING MEMBER AND IMAGE FORMING APPARATUS USING THE SAME

(75) Inventors: Naohiro Toda, Yokohama (JP); Yoshiki Yanagawa, Numazu (JP); Takaaki Ikegami, Susono (JP); Makoto Yasuda, Hiratsuka (JP); Takeshi Orito, Yokohama (JP)

(73) Assignee: Ricoh Company Limited, Tokyo (JP)

( * ) Notice: Subject to any disclaimer, the term of this patent is extended or adjusted under 35 U.S.C. 154(b) by 421 days.

(21) Appl. No.: 12/030,886

(22) Filed: Feb. 14, 2008

(65) Prior Publication Data

US 2008/0292981 A1 Nov. 27, 2008

(30) Foreign Application Priority Data

Feb. 15, 2007 (JP) ..... 2007-035170
Feb. 27, 2007 (JP) ..... 2007-047065
Nov. 22, 2007 (JP) ..... 2007-303020

(51) Int. Cl.
*G03G 15/00* (2006.01)

(52) U.S. Cl. ..... 430/66; 430/58.65; 399/159

(58) Field of Classification Search ..... 430/58.65, 430/66; 399/159
See application file for complete search history.

(56) References Cited

U.S. PATENT DOCUMENTS 6,824,939 B2 11/2004 Kurimoto et al.
6,861,188 B2 3/2005 Ikegami et al.
7,018,755 B2 3/2006 Ikegami et al.
7,220,522 B2 5/2007 Ikegami et al.
7,267,916 B2 9/2007 Sugino et al.
7,314,693 B2 1/2008 Ikegami et al.
7,390,600 B2 * 6/2008 Toda et al. ..... 430/58.7
7,416,823 B2 * 8/2008 Yanagawa et al. ..... 430/58.7
7,473,504 B2 * 1/2009 Yanagawa et al. ..... 430/58.7
2005/0008957 A1 1/2005 Ikegami et al.
2005/0158641 A1 7/2005 Yanagawa et al.
2005/0221210 A1 10/2005 Suzuki et al.
2005/0266325 A1 12/2005 Yanagawa et al.
2005/0282075 A1 12/2005 Ikuno et al.
2005/0287452 A1 12/2005 Tamura et al.
2006/0134540 A1 6/2006 Kondo et al.
2006/0141378 A1 6/2006 Takada et al.
2006/0199092 A1 9/2006 Sugino et al.
2006/0240346 A1 10/2006 Toda et al.

(Continued)

FOREIGN PATENT DOCUMENTS

JP 56-048637 5/1981

(Continued)

*Primary Examiner*—John L Goodrow
(74) *Attorney, Agent, or Firm*—Oblon, Spivak, McClelland, Maier & Neustadt, L.L.P.

(57) ABSTRACT

This invention relates to image bearing member and an image forming apparatus that employs the image bearing member. The image bearing member contains an electroconductive substrate; a charge generation layer; a charge transport layer; a cross-linking surface protective layer, and a monomer having one radical polymerizable functional group with a charge transport structure. The cross-linking surface protective layer is formed by curing a monomer having at least three radical polymerizable functional groups without a charge transport structure. For the image bearing member, the ratio of the layer thickness of the cross linking surface protective layer to the layer thickness of the charge transport layer is from 0.7 to 1.3.

20 Claims, 2 Drawing Sheets

U.S. PATENT DOCUMENTS

| | | | |
|---|---|---|---|
| 2007/0009818 | A1 | 1/2007 | Yanagawa et al. |
| 2007/0015074 | A1 | 1/2007 | Sugino et al. |
| 2007/0042281 | A1 | 2/2007 | Orito et al. |
| 2007/0059617 | A1 | 3/2007 | Toda et al. |
| 2007/0117033 | A1 | 5/2007 | Sugino et al. |
| 2007/0212627 | A1 | 9/2007 | Yanagawa et al. |
| 2007/0231733 | A1 | 10/2007 | Takada et al. |
| 2007/0287083 | A1 | 12/2007 | Gondoh et al. |
| 2007/0297836 | A1 | 12/2007 | Kawasaki et al. |

FOREIGN PATENT DOCUMENTS

| | | |
|---|---|---|
| JP | 64-001728 | 1/1989 |
| JP | 04-281461 | 10/1992 |
| JP | 05-216249 | 8/1993 |
| JP | 08-262779 | 10/1996 |
| JP | 2000-066425 | 3/2000 |
| JP | 2004-302451 | 10/2004 |
| JP | 2006-227496 | 8/2006 |

* cited by examiner

IMAGE BEARING MEMBER AND IMAGE FORMING APPARATUS USING THE SAME

BACKGROUND OF THE INVENTION

1. Field of the Invention

The present invention relates to an image bearing member and an image forming apparatus using the image bearing member.

2. Discussion of the Background

In recent years, an organic photoconductor (OPC) has superseded an inorganic photoconductor in a photocopier, a facsimile machine, a laser printer and their multi-functional device as an image bearing member in light of performance and advantages. For examples, such an organic photoconductor has the following advantages over an inorganic photoconductor: (1) a wide light absorption wavelength range and a large light absorption amount with regard to optical characteristics; (2) high sensitivity and stable chargeability with regard to electric characteristics; (3) wide selection range of material; (4) easiness of manufacturing; (5) low cost; and (6) non-toxic.

On the other hand, along with the advance of size reduction of an image forming apparatus, the image bearing member therein has been also reduced in size. Furthermore, due to movement toward high speed performance and maintenance-free, an image bearing member having a high durability has been strongly demanded. In light of this, an organic photoconductor is generally soft considering that the main components of the surface layer thereof are a low molecular weight charge transport material and an inactive polymer. Therefore, when such an organic photoconductor is repetitively used in the electrophotographic process, the organic photoconductor has a disadvantage of being easily abraded under the mechanical stress caused by a development system or a cleaning system. In addition, to meet the demand of producing quality images, the size of toner particles decreases, which requires improvement of cleaning property. Thus, the hardness of rubber of a cleaning blade and the contact pressure thereof to an image bearing member increases. This results in another factor of accelerating the abrasion of the surface of an image bearing member. Such abrasion of an image bearing member invites deterioration of electric characteristics such as sensitivity and chargeability and causes reduction of image density, background fouling, etc., which leads to production of abnormal images. When such abrasion occurs locally and damages the surface of an image bearing member, obtained images have streak fouling. In the current situation, the life of an image bearing member is limited by this abrasion or scar, meaning that replacement is necessary.

With regard to improvement on the durability of an organic photoconductor (image bearing member), reducing the amount of the abrasion described above is inevitable and an imminent problem to be solved in this field.

There are following technologies for improving the anti-abrasion property of a photosensitive layer: (1) using a surface layer containing a curing binder resin {refer to unexamined published Japanese patent application No. (hereinafter referred to as JOP) S56-48637}; (2) using a charge transfer polymer (refer to JOP S64-1728); and (3) using a surface layer in which an inorganic filler is dispersed (refer to JOP H04-281461). Among these technologies, the technology of (1) tends to result in image density reduction since the curing binder resin is poorly compatible with a charge transport material or the residual voltage increases due to impurities such as a polymerization initiator or non-reacted residual groups. With regard to the technologies of (2) and (3), it is possible to improve anti-abrasion property in some degree but not satisfactorily. Furthermore, in the technology of (3), the residual voltage rises due to trap existing on the surface of the inorganic filler so that the image density tends to decrease. In conclusion, the technologies of (1), (2) and (3) have not sufficiently satisfied the total durability including electric durability and mechanical durability demanded for an organic photoconductor.

Furthermore, in relation with the technology of (1), an image bearing member is known which contains a curing type acrylate monomer having multiple functional groups to improve anti-abrasion property and anti-damage property {refer to Japanese patent No. (hereinafter referred to as JP) 3262488}. Although there is a description that this curing type acrylate monomer having multiple functional groups can be contained in the protective layer formed on a photosensitive layer with regard to this image bearing member, there is no specific description about the monomer. Furthermore, when a low molecular weight charge transport material is simply contained in the surface (protective) layer, a compatibility problem arises with the curing type material mentioned above. This causes precipitation of the low molecular weight charge transport material, cracking, and deterioration of mechanical strength of the layer. There is also a description about containing a polycarbonate resin to improve the compatibility, but the content of the curing type acryl monomer decreases so that sufficient anti-abrasion property is not obtained. With regard to an image bearing member which does not contain a charge transport material in the surface layer thereof, There is also another description that the surface layer is made to be thin to lower the voltage at irradiated portions. However, when the surface layer is thin, the life of an image bearing member is short and actually it is not possible to maintain an effective value with regard to the voltage at irradiated portions.

There is known a technology improving the anti-abrasion property of a photosensitive layer superseding the technologies mentioned above (refer to JP 3194392). In this technology, a charge transport layer is provided which is formed by a liquid application containing a monomer having a carbon-carbon double bond, a charge transport material having a carbon-carbon double bond and a binder resin. This binder resin is a binder resin having a carbon-carbon double bond and reactivity with the charge transport material mentioned above and a binder resin having no carbon-carbon double bond and no reactivity with the charge transport material mentioned above. This image bearing member is notable in terms of good combination of anti-abrasion property and electric characteristics. When a binder resin having no reactivity with the charge transport material mentioned above is used, the compatibility between the binder resin and the cured material produced from the reaction between the monomer mentioned above and the charge transport material is bad. Therefore, a rough surface is made during cross-linked due to the phase separation, which tends to degrade cleaning performance. In addition that the binder resin interferes curing of the monomer as described above, the monomer specified for use in this image bearing member has two functional groups, which is too small in number to obtain sufficient cross linking density. Thus, the obtained image bearing member has an insufficient anti-abrasion property. When a binder resin having reactivity with the charge transport material mentioned above is used, the number of functional groups contained in the monomer mentioned above and the binder resin is too few to have a good combination of the combined amount of the charge transport material mentioned above and the cross-linking density. Thus, the electric characteristics and the ant-abrasion property are not sufficient.

There is also known a photosensitive layer having a compound formed by curing a positive hole transport material having at least 2 chain reaction polymerizable functional groups in a same molecule (refer to JOP2000-66425). However, since the positive hole transport material is bulky and has at least 2 chain reaction polymerizable functional groups, there is distortion in the cured material, which increases internal stress in the photosensitive layer. This internal stress tends to make the surface layer rough and cause cracking, meaning that the durability is not sufficient.

As a method of solving the problems mentioned above about the anti-abrasion property, electric characteristics, surface property and cracking, JOP 2004-302451 describes an image bearing member having a cross-linking type charge transport layer which is provided on a charge transport layer, has a layer thickness of from 1 to 10 μm and is formed by curing at least a monomer having at least three radical polymerizable functional groups without a charge transport structure and a monomer having one radical polymerizable functional group with a charge transport structure. This image bearing member has a good anti-abrasion property and maintains stable electric characteristics in comparison with the image bearing members because the provided specific cross-linking type charge transport layer significantly improves the durability of the image bearing member. However, as the processing speed of an information processing terminal have increased in recent years, the technologies dealing with a large amount of information in a short time advance day by day. At the same time, an image forming apparatus is demanded to increase the output speed and be durable for an extended period of time, for example, at least 1 million image impressions on sheets. Actually, the image bearing member described in JOP 2004-302451 has a problem that abnormal images are produced due to deterioration of electric characteristics when the image bearing member is used for an extended period of time, for example, 1 million or more image impressions on sheets.

Such abnormal images produced in such a repetitive use over a long period of time are caused by a residual image due to charges having a reverse polarity generated while a toner image is transferred to a transfer member. Especially, this abnormal image is significantly generated in an image forming apparatus taking a direct transfer system. As the method of solving this problem of abnormal images in this direct transfer system, JOP 2006-227496 describes an image bearing member in which a charge blocking layer, a moiré prevention layer, a photosensitive layer and a protective layer are accumulated on an electroconductive substrate and the protective layer is formed by curing at least a monomer having at least three radical polymerizable functional groups without a charge transport structure and a monomer having one radical polymerizable functional group with a charge transport structure as described in JOP 2004-302451.

The image bearing member according to the technology described in JOP 2006-227496 has relatively good durability in comparison with that described in JOP 2004-302451. However, the residual image mentioned above is still observed when the image bearing member is used for an extended period of time, for example, 1 million or more image impressions on sheets. As a result, the image bearing member provided by the technology does not sufficiently have a mechanical durability and stable electric characteristics for forming quality images for an extended period of time.

SUMMARY OF THE INVENTION

Because of these reasons, the present inventors recognize that a need exists for an image bearing member that has a mechanical durability and stable electric characteristics for forming quality images for an extended period of time and an image forming apparatus using the image bearing member.

Accordingly, an object of the present invention is to provide an image bearing member that has a mechanical durability and stable electric characteristics for forming quality images for an extended period of time and an image forming apparatus using the image bearing member.

Briefly this object and other objects of the present invention as hereinafter described will become more readily apparent and can be attained, either individually or in combination thereof, by an image bearing member including an electroconductive substrate; a charge generation layer; a charge transport layer; a cross-linking surface protective layer formed by curing at least a monomer having at least three radical polymerizable functional groups without a charge transport structure and a monomer having one radical polymerizable functional group with a charge transport structure, wherein the ratio (t1/t2) of the layer thickness (t1) of the cross linking surface protective layer to the layer thickness (t2) of the charge transport layer is from 0.7 to 1.3 and wherein the charge transport layer includes a compound represented by chemical formula I:

Chemical formula I

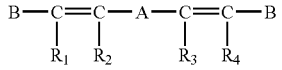

In chemical formula I, $R_1$ to $R_4$ independently represent a hydrogen atom, an alkyl group having 1 to 4 carbon atoms, an alkoxy group having 1 to 4 carbon atoms, or a phenyl group which can be substituted by an alkyl group having 1 to 4 carbon atoms or an alkoxy group having 1 to 4 carbon atoms, A represents a substituted or non-substituted arylene group or a compound represented by chemical formula II Chemical formula II

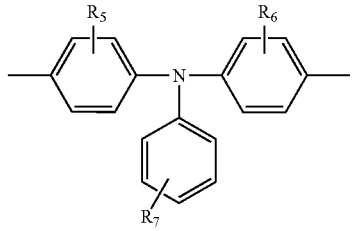

(In Chemical formula II, $R_5$, $R_6$ and $R_7$ independently represent a hydrogen atom, an alkyl group having 1 to 4 carbon atoms, an alkoxy group having 1 to 4 carbon atoms, or a phenyl group which can be substituted by an alkyl group having 1 to 4 carbon atoms or an alkoxy group having 1 to 4 carbon atoms), B represents a substituted or non-substituted aryl group or a compound represented by Chemical formula III:

Chemical formula III

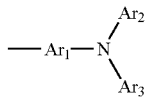

(In Chemical formula III, $Ar_1$ represents an arylene group which can be substituted by an alkyl group or alkoxy group having 1 to 4 carbon atoms, $Ar_2$ and $Ar_3$ independently represent an aryl group which can be substituted by an alkyl group or alkoxy group having 1 to 4 carbon atoms), and C represents a carbon atom.

It is preferred that, in the image bearing member mentioned above, the charge transport layer further includes a distyryl benzene derivative represented by chemical formula IV:

Chemical formula IV

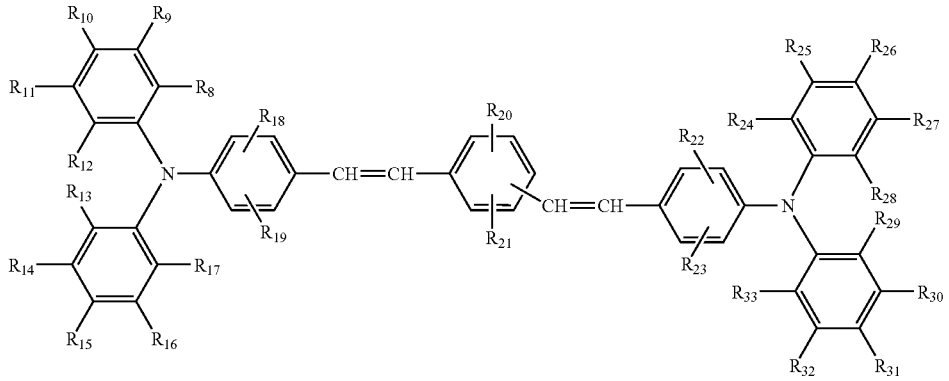

In Chemical formula IV, $R_8$ to $R_{33}$ independently represent a hydrogen atom, an alkyl group having 1 to 4 carbon atoms, an alkoxy group having 1 to 4 carbon atoms, or a substituted or non-substituted phenyl group.

As another aspect of the present invention, an image bearing member is provided in which the image bearing member includes an electroconductive substrate; a charge generation layer; a charge transport layer; a cross-linking surface protective layer formed by curing at least a monomer having at least three radical polymerizable functional groups without a charge transport structure and a monomer having one radical polymerizable functional group with a charge transport structure, wherein the ratio (t1/t2) of the layer thickness (t1) of the cross linking surface protective layer to the layer thickness (t2) of the charge transport layer is from 0.7 to 1.3 and the charge transport layer includes a compound represented by chemical formula V:

Chemical formula V

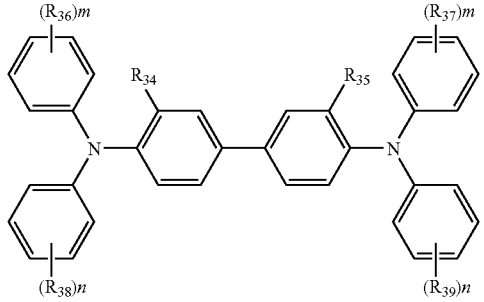

In Chemical formula V, $R_{34}$ and $R_{35}$ independently represent a hydrogen atom, a halogen atom, an alkyl group, or an alkoxy group, $R_{36}$ to $R_{39}$ independently represent a hydrogen atom, a halogen atom, an alkyl group, an alkoxy group or a dialkylamino group and m and n independently represents 1 or 2.

As another aspect of the present invention, an image bearing member is provided in which the image bearing member includes an electroconductive substrate; a charge generation layer; a charge transport layer; a cross-linking surface protective layer formed by curing at least a monomer having at least three radical polymerizable functional groups without a charge transport structure and a monomer having one radical polymerizable functional group with a charge transport structure, wherein the ratio (t1/t2) of the layer thickness (t1) of the cross linking surface protective layer to the layer thickness (t2) of the charge transport layer is from 0.7 to 1.3 and the charge transport layer includes a compound represented by Chemical formula VI:

Chemical formula VI

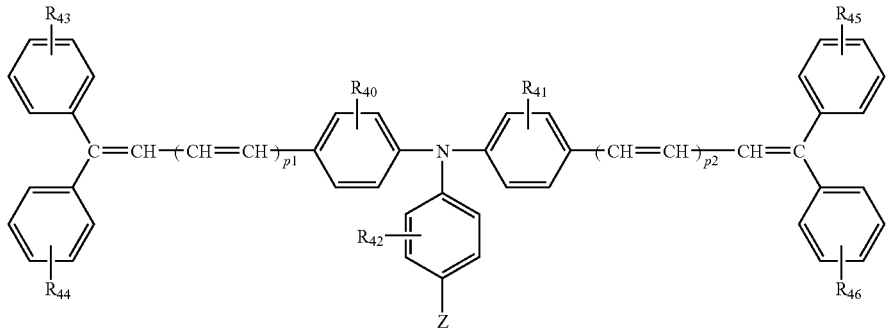

In Chemical formula VI, $R_{40}$ to $R_{46}$ independently represent a hydrogen atom, a lower alkyl group, an alkoxy group, a phenoxy group, a halogen atom or a substituted or non-substituted aryl group, p1 and p2 independently represent 0 or 1, Z represents hydrogen atom, a lower alkyl group, an alkoxy group, a phenoxy group, a halogen atom, a substituted or non-substituted aryl group or a group represented by Chemical formula VII, Chemical formula VIII or Chemical formula IX:

Chemical formula VII

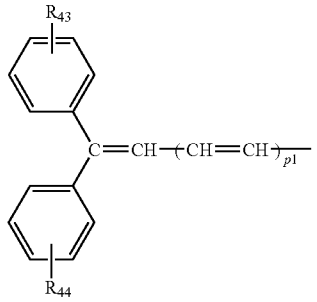

Chemical formula VIII

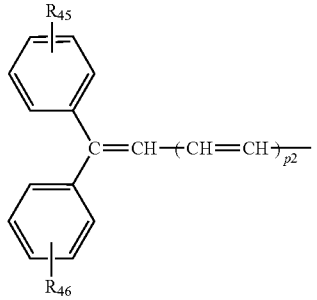

Chemical formula IX

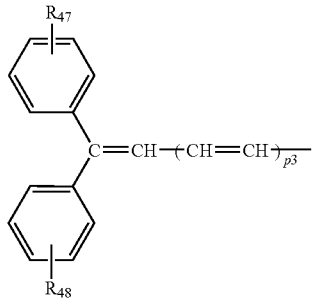

In Chemical formulae VII, VIII and IX, $R_{43}$ to $R_{46}$, P1 and P2 independently represent 0 or 1, $R_{47}$ and $R_{48}$ independently represent a hydrogen atom, a lower alkyl group, an alkoxy group, a phenoxy group, a halogen atom, or a substituted or non-substituted aryl group, and p3 represents 0 or 1.

It is still further preferred that the image bearing member mentioned above has a layer thickness (t2) of the cross linking surface protective layer of from 10 to 20 μm.

It is still further preferred that, in the image bearing member mentioned above, the charge transport layer further includes a compound represented by Chemical formula X:

Chemical formula X

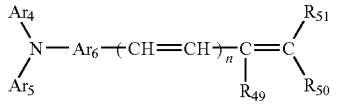

In chemical formula X, wherein $Ar_4$ and $Ar_5$ independently represent a substituted or non-substituted aryl group or a substituted or non-substituted heterocyclic ring, $R_{49}$, $R_{50}$ and $R_{51}$ independently represent a hydrogen atom, a substituted or non-substituted alkyl group, a substituted or non-substituted alkoxy group, a substituted or non-substituted aryl group, or a substituted or non-substituted heterocyclic group, $R_{50}$ and $R_{51}$ optionally share bond connectivity to form a ring, $Ar_6$ represents a substituted or non-substituted arylene group and n represents 0 or 1.

It is still further preferred that, the image bearing member mentioned above, the charge generation layer includes a titanyl phthalocyanine pigment.

It is still further preferred that, the image bearing member mentioned above, the monomer having one radical polymerizable functional group with a charge transport structure includes an acryloyloxy group or a methacryloyloxy group as the functional group.

As another aspect of the present invention, an image forming apparatus is provided which includes the image bearing member mentioned above for bearing a latent electrostatic image; a charge device for charging the image bearing member; an irradiation device for irradiating the surface of the image bearing member to form the latent electrostatic image; a development device for developing the latent electrostatic image with a development agent; and a transfer device for transferring the developed image to a transfer medium, wherein the developed image on the image bearing member rotating at a linear speed of not less than 500 mm/s is directly transferred to the transfer medium and the polarity of the surface of the image bearing member after the developed image is transferred to the transfer medium is opposite to the polarity when the image bearing member is charged.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
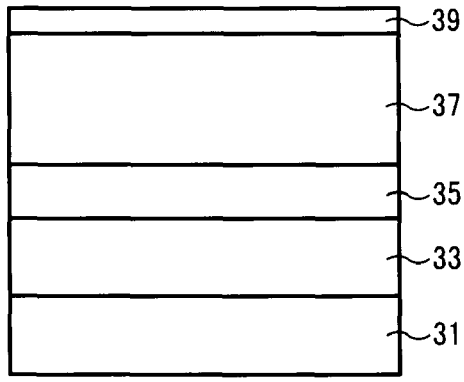
FIG. 1 is a diagram illustrating a cross section of an example of the image bearing member of the present invention.

The present invention will be described below in detail with reference to several embodiments and accompanying drawings.

First, in the case of the image bearing member of the present invention, a charge generation layer and a charge transport layer are provided on an electroconductive substrate and a surface protective layer is provided on the charge transport layer to reduce the affect of the abrasion caused during repetitive use of the image bearing member and improve the electric stability for an extended period of time. The surface protective layer is formed by at least a cross-linking curing resin, which is a product of a radical polymerizable compound having at least three functional groups (i.e., a monomer having at least three radical polymerizable functional groups) without a charge transport structure and a radical polymerizable compound having one functional group (i.e., a monomer having a polymerizable functional group having one functional group) with a charge transport structure. Thus, the protective surface layer has a developed three dimensional structure with good anti-abrasion property and stable electric characteristics. Also, the ratio (t2/t1) of the layer thickness (t2) of the protective surface layer to the layer thickness (t1) of the charge transport layer is adjusted in the range of from 0.7 to 1.3. Thereby, the image bearing member of the present invention can avoid the deterioration of the electric characteristics caused during the repetitive use of the image bearing member for an extended period of time, for example, not less than 1,000,000 impressions on paper. Especially, it is possible not to produce abnormal images having residual images caused by charges having a reverse polarity generated during transfer.

In addition, it is preferred to use a titanyl phthalocyanine pigment or a mixture of a disazao pigment therewith as a charge generation material for use in the charge generation layer especially to avoid production of abnormal images when an image bearing member containing the compound or mixture is repetitively used for an extended period of time.

The present inventors infer that the mechanism of the present invention is: that charges having a reverse polarity generated during transfer hardly remain in a charge transport layer as a trap due to the specific compound contained in the charge transport layer; In addition, by limiting the ratio of the layer thickness of the charge transport layer and the layer thickness of the cross-linking surface protective layer having a charge transport function in a particular range, it is possible to minimize the deterioration of the electric characteristics of each layer; and therefore, production of abnormal images can be avoided. Furthermore, it is also inferred that, when a titanyl phthalocyanine pigment or a mixture of a disazao pigment therewith is used as a charge generation material for the charge generation layer, charges having a reverse polarity generated during transfer hardly remain as a trap when the charges are infused into the charge generation layer.

The protective layer (i.e., surface protective layer or cross-linking surface protective layer) for use in the present invention is described next.

As described above, in the image bearing member (photoconductor or electrophotographic photoconductor) for use in the present invention, a surface protective layer is provided on a photosensitive layer to relieve the influence of abrasion caused by repetitive use of the image bearing member and improve and maintain electric stability for a long period of time. The protective layer is formed by curing at least a monomer having at least three radical polymerizable functional groups without a charge transport structure and a monomer having one radical polymerizable functional group with a charge transport structure.

This protective layer is to improve the anti-abrasion property of an image bearing member, thereby restraining the increase of electric field caused by repetitive use. This is effective to reduce background fouling. In addition, in an image bearing member having this protective layer, the rise in the residual voltage is small and the surface of the image bearing member has good anti-damage property, and filming hardly occurs. Thus, the protective layer is also effective to reduce the occurrence of image deficiency. As a result, providing this protective layer is effective and useful in terms of achieving high durability.

Scars on the surface of an image bearing member or foreign objects such as toner, external additives, carrier and paper dust) that are attached thereto reduce the cleaning property of the image bearing member and significantly degrade the image stability. Therefore, to obtain an image bearing member with a high durability, it is preferred to minimize the adverse impact of such scar or foreign objects on the surface of the image bearing member or filming in addition to improvement on anti-abrasion property. To achieve this, it is preferred to form a smooth surface layer having a high hardness and a high elasticity.

The protective layer for use in the present invention has a cross-linking structure formed by curing a radical polymerizable compound having 3 or more functional groups and develops a three-dimensional network structure. Thus, the cross-linking density of the protective layer is extremely high and resultantly, the obtained protective layer is hard, elastic, uniform and smooth with a high anti-abrasion property and anti-damage property.

Furthermore, the protective layer of the present invention contains a monomer having one radical polymerizable functional group with a charge transport structure in addition to the monomer having at least 3 radical polymerizable functional groups. This monomer having one radical polymerizable functional group with a charge transport structure is taken into the cross linking linkage during curing of the radical polymerizable compound having at least 3 functional groups. To the contrary, when a low molecular weight charge transport material having no functional group is contained in a protective layer, the low molecular weight charge transport material precipitates, the white turbidity phenomenon occurs and the mechanical strength of the protective layer deteriorates. When a charge transport material having two or more functional groups is used instead as a main component, the charge transport material is fixed in the cross-linking structure by multiple linkages so that the cross-linking density increases. However, this charge transport structure is extremely bulky. Therefore, the structure of the cured resin is greatly distorted and the internal stress in the protective layer increases, which causes the occurrence of cracking.

Furthermore, the image bearing member of the present invention has good electric characteristics and is thus stable for repetitive use. Consequently, the image bearing member achieves a high durability and a high stability. This is because a monomer having one radical polymerizable functional group with a charge transport structure is used as a component of the protective layer and fixed in the cross-linking linkage in a pendulant manner. In the case of a charge transport material having no functional group, precipitation and white turbidity phenomenon occur so that the electric characteristics significantly deteriorate during repetitive use, for example, the sensitivity deteriorates and the residual voltage rises. When a charge transport material having two or more functional groups is used as a main component, the charge transport material is trapped in the cross-linking structure by multiple linkages, the intermediate structure (cation radical) is not stable during charge transport and the sensitivity tends to deteriorate and the residual voltages easily rises due to entrapment of charges. Deterioration of these electric characteristics results in reduction in image density, thinned line images, etc.

As described above, since the surface protective layer for use in the present invention has excellent anti-abrasion property and electric stability, it is possible to obtain good characteristics in a wide range of layer thickness. To maintain a good stability over a long period of time, the layer thickness is preferably from 10 to 20 μm in consideration of the balance with the layer thickness of a charge transport layer.

The material composition of the liquid application of the surface protective layer for use in the present invention is described next.

Specific examples of the monomer having at least three radical polymerizable functional groups without a charge transport structure include, but are not limited to, a monomer having at least three radical polymerizable functional groups which does not have a positive hole transport structure, such as the positive hole transport structure of triarylamine, hydrazone, pyrazoline or carbazole, or which does not have an electron transport structure, such as the electron transport structure of an electron-attracting aromatic ring having condensed polycyclic quinone, diphenoquinone, cyano group, or nitro group. Any radical polymerizable functional group having a carbon-carbon double bond and capable of undergoing a radical polymerization reaction can be used. Specific examples of these radical polymerizable functional groups include, but are not limited to, 1-substituted ethylene functional groups, and 1,1-substituted ethylene functional groups as follows:

Specific examples of the 1-substituted ethylene functional group include, but are not limited to, functional groups represented by the following chemical formula 11:

$$CH_2{=}CH{-}X_1{-} \qquad \text{Chemical formula 11,}$$

in the chemical formula II, $X_1$ represents a substituted or non-substituted arylene group, for example, phenylene group, or naphthylene group, a substituted or non-substituted alkenylene group, —CO— group, —COO— group, —CON($R_{10}$) group ($R_{10}$ represents hydrogen atom, an alkyl group, for example, methyl group or ethyl group, or an aralkyl group, for example, benzyl group, naphthylmethyl group or phenethyl group, or an aryl group, for example, phenyl group or naphthyl group), or an —S— group.

Specific examples of these substituent groups include, but are not limited to, vinyl group, styryl group, 2-methyl-1,3-butadienyl group, vinylcarbonyl group, acryloyloxy group, acryloylamide group, and vinylthioether group.

Specific examples of the 1,1-substituted ethylene functional group include, but are not limited to, functional groups represented by the following chemical formula 12:

$$CH_2{=}CH(Y){-}X_2{-} \qquad \text{Chemical formula 12,}$$

in the chemical formula 12, Y represents a substituted or non-substituted alkyl group, a substituted or non-substituted aralkyl group, a substituted or non-substituted aryl group, for example, phenyl group and naphthyl group, a halogen atom, cyano group, nitro group or an alkoxy group, for example, methoxy group or ethoxy group, —$COOR_{11}$ ($R_{11}$ represents hydrogen atom, a substituted or non-substituted alkyl group, for example, methyl group or ethyl group; a substituted or non-substituted aralkyl group, for example, benzyl group or phenethyl group, or a substituted or non-substituted aryl group, for example, phenyl group or naphthyl group), or $CONR_{12}R_{13}$ ($R_{12}$ and $R_{13}$ independently represent a hydrogen atom, a substituted or non-substituted alkyl group, for example, methyl group or ethyl group, a substituted or non-substituted aralkyl group, for example, benzyl group, naphthylmethyl group or phenethyl group, or a substituted or non-substituted aryl group, for example, phenyl group or naphthyl group). $X_2$ represents the same substituent group as $X_1$ described above, a single bond or an alkylene group. At least either of Y and $X_2$ is an oxycarbonyl group, cyano group, an alkenylene group or an aromatic ring.

Specific examples of these substituent groups include, but are not limited to, α-acryloyloxy chloride group, methacryloyloxy group, α-cyanoethylene group, α-cyanoacryloyloxy group, α-cyanophenylene group, and methacryloylamino group.

Specific examples of substituent groups that are furthermore substituted in the substituent group of $X_1$, $X_2$, or Y include, but are not limited to, a halogen atom; nitro group; cyano group; an alkyl group, for example, methyl group or ethyl group; an alkoxy group, for example, methoxy group and ethoxy group; an aryloxy group, for example, phenoxy group; an aryl group, for example, phenyl group and naphthyl group; and an aralkyl group, for example, benzyl group and phenethyl group.

Among these radical polymerizable functional groups, acryloyloxy group, and methacryloyloxy group are particularly effective, and a compound having three or more acryloyloxy groups can be obtained by conducting, for example, an ester reaction or an ester exchange reaction of a compound having 3 or more hydroxyl groups in the molecule with an acrylic acid (salt), an acrylic acid halide, and an acrylic acid ester. A compound having 3 or more methacryloyl groups can also be obtained in the same manner. The radical polymerizable functional groups in a monomer having 3 or more radical polymerizable functional groups may be the same or different from each other.

Specific examples of the monomer having at least three radical polymerizable functional groups without a charge transport structure include, but are not limited to, the following compounds.

Specific examples of the monomer having at least three radical polymerizable functional groups for use in the present invention include, but are not limited to, trimethylolpropane triacrylate (TMPTA), trimethylolpropane trimethacrylate, HPA modified trimethylolpropane triacrylate, trimethylol propane ethylene oxy-modified (EO-modified) triacrylate, trimethylolpropane propyleneoxy-modified (PO-modified) triacrylate, trimethylolpropane caprolactone-modified triacrylate, trimethylolpropane HPA-modified trimethacrylate, pentaerythritol triacrylate, pentaerythritol tetraacrylate (PETTA), glycerol triacrylate, glycerol epichlorohydrine-modified (ECH-modified) triacrylate, glycerol EO-modified triacrylate, glycerol PO-modified triacrylate, tris(acryloxyethyl)isocyanurate, dipentaerythritol hexaacrylate (DPHA), dipentaerythritol caprolactone-modified hexaacrylate, dipentaerythritol hydroxypentaacrylate, alkyl-modified dipentaerythritol pentaacrylate, alkyl-modified dipentaerythritol tetraacrylate, alkyl-modified dipentaerythritol triacrylate, dimethylolpropane tetraacrylate (DTMPTA), pentaerythritol ethoxytetraacrylate, phosphoric acid EO-modified triacrylate, and 2,2,5,5-tetrahydroxymethyl cyclopentanone tetraacrylate. These can be used alone or in combination.

With regard to the monomer having at least three radical polymerizable functional groups without a charge transport structure for use in the present invention, the ratio of molecular weight relative to the number of functional groups (molecular weight/the number of functional group) in the monomer is preferably from 250 or less to form a dense cross-linking bond in the surface protective layer. When the ratio is excessively great, the surface protective layer is soft and thus the abrasion resistance is degraded in some degree. Therefore, it is not suitable to single out a compound having an extremely long modified group for use among the monomers having a modified group, for example, caprolactone-modified, EO-modified and PO-modified group. The content of the monomer having at least three radical polymerizable functional groups without a charge transport structure contained in the surface protective layer in the solid content of the liquid composition is adjusted such that the component ratio thereof is from 20 to 80% by weight, and preferably from 30 to 70% by weight based on the total amount of the surface protective layer. When the content of the monomer component is too small, the three dimensional cross-linked bonding density of the cross-linked surface layer tends to be low. Also the abrasion resistance is not significantly improved in comparison with the case where a typical thermoplastic binder resin is used. When the content of the monomer is too great, the content of the charge transport compound tends to decrease, which causes degradation of electric properties.

The monomer having one radical polymerizable functional group with a charge transport structure for use in the present invention represents a monomer having a radical polymerizable functional group with a charge transport structure which includes a positive hole transport structure, such as triarylamine, hydrazone, pyrazoline, and carbazole, or an electron-transport structure, such as electron-attracting aromatic ring having condensed polycyclic quinone, diphenoquinone, cyano group, and nitro group. Any radical polymerizable functional group having a carbon-carbon double bond and capable of undergoing a radical polymerization reaction can be used. Specific examples of these radical polymerizable functional groups include, but are not limited to, the same 1-ethylene substituted functional groups, and 1,1-substituted ethylene functional groups as described for the monomer having at least three radical polymerizable functional group without a charge transport structure.

As the charge transport structure, triaryl amine structure is effective. Furthermore, when a compound represented by Chemical structure 3 or 4 is used, the electric characteristics, for example, sensitivity and residual voltage, are suitably sustained.

Chemical structure 13

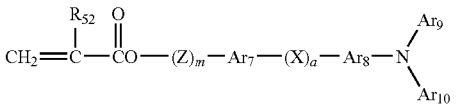

Chemical structure 14

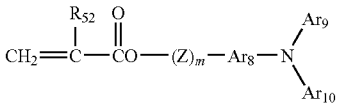

In the chemical structures 13 and 14, $R_{52}$ represents hydrogen atom, a halogen atom, an alkyl group, an aralkyl group, an aryl group, a cyano group, a nitro group, an alkoxy group, —$COOR_{53}$ wherein $R_{53}$ represents hydrogen atom, a substituted or non-substituted alkyl group, a substituted or non-substituted aralkyl group or a substituted or non-substituted aryl group, a halogenated carbonyl group or $CONR_{54}R_{55}$, wherein $R_{54}$ and $R_{55}$ each, independently, represent a hydrogen atom, a halogen atom, a substituted or non-substituted alkyl group, a substituted or non-substituted aralkyl group or a substituted or non-substituted aryl group, $Ar_7$ and $Ar_8$ each, independently represent a substituted or unsubstituted arylene group, $Ar_9$ and $Ar_{10}$ each, independently, represent a substituted or unsubstituted aryl group, X represents a substituted or non-substituted alkylene group, a substituted or non-substituted cycloalkylene group, a substituted or non-substituted alkylene ether group, oxygen atom, sulfur atom or vinylene group, Z represents a substituted or non-substituted alkylene group, a substituted or non-substituted alkylene ether divalent group or an alkyleneoxy carbonyl divalent group, a represents 0 or 1 and m and n, each, independently, represent 0 or an integer of from 1 to 3.

In the chemical structures 13 and 14, in the substituent group of $R_{52}$, specific examples of the alkyl groups include, but are not limited to, methyl group, ethyl group, propyl group, and butyl group; specific examples of the aryl groups include, but are not limited to, phenyl group and naphthyl group; specific examples of the aralkyl groups include, but are not limited to, benzyl group, phenethyl group and naphthylmethyl group; specific examples of the alkoxy group include, but are not limited to, methoxy group, ethoxy group, propoxy group, buthoxy group, heptyloxy group and hexyloxy group. These groups can be substituted by a halogen atom; nitro group; cyano group; an alkyl group, for example, methyl group and ethyl group; an alkoxy group, for example, methoxy group and ethoxy group; an aryloxy group, for example, phenoxy group; an aryl group, for example, phenyl group and naphthyl group; or an aralkyl group, for example, benzyl group and phenethyl group.

Among the substituent groups of $R_1$, hydrogen atom and methyl group are particularly preferred.

$Ar_9$ and $Ar_{10}$ are a substituted or unsubstituted aryl group, and specific examples thereof include, but are not limited to, condensed polycyclic hydrocarbon groups, non-condensed cyclic hydrocarbon groups, and heterocyclic groups.

Preferred specific examples of the condensed polycyclic hydrocarbon group include, but are not limited to, groups in which the number of the carbon atoms forming a ring is 18 or less. Specific examples thereof include, but are not limited to, pentanyl group, indenyl group, naphthyl group, azulenyl group, heptalenyl group, biphenylenyl group, as (asym)-indacenyl group, s(sym)-indacenyl group, fluorenyl group, acenaphthylenyl group, pleiadenyl group, acenaphtenyl group, phenalenyl group, phenanthryl group, anthryl group, fluoranthenyl group, acephenantolylenyl group, aceanthrylenyl group, triphenylel group, pyrenyl group, chrysenyl group and naphthacenyl group.

Specific examples of the uncondensed cyclic hydrocarbon groups include, but are not limited to, monovalent groups derived from benzene, diphenyl ether, polyethylene diphenyl ether, diphenyl thioether, diphenyl sulfone, biphenyl, polyphenyl, diphenyl alkane, diphenyl alkene, diphenyl alkyne, triphenylmethane, distyrylbenzene, 1,1-diphenyl cycloalkane, polyphenyl alkane, and polyphenyl alkene. In addition, monovalent groups derived from polycyclic hydrocarbons such as 9,9-diphenyl fluorene can also be used.

Specific examples of the heterocyclic groups include, but are not limited to, monovalent groups derived from carbazole, dibenzofuran, dibenzothiophene, oxadiazole, thiazole, etc.

The aryl groups represented by $Ar_9$ and $Ar_{10}$ may preferably have the following substituent groups.

(1) A halogen atom, cyano group, nitro group, etc.

(2) A straight-chain or branched-chain alkyl group having 1 to 12 carbon atoms, more preferably 1 to 8 carbon atoms, and much more preferably 1 to 4 carbon atoms, which may substituted with fluorine atom; hydroxyl group; cyano group; an alkoxy group having 1 to 4 carbon atoms; or a phenyl group substituted with a halogen atom, an alkyl group having 1 to 4 carbon atoms, or an alkoxy group having 1 to 4 carbon atoms. Specific examples of the alkyl groups include, but are not limited to, methyl group, ethyl group, n-butyl group, i-propyl group, t-butyl group, s-butyl group, n-propyl group, trifluoromethyl group, 2-hydroxyethyl group, 2-ethoxyethyl group, 2-cyanoethyl group, 2-methoxyethyl group, benzyl group, 4-chlorobenzyl group, 4-methylbenzyl group, and 4-phenylbenzyl group.

(3) An alkoxy group (—$OR_{56}$, wherein $R_{56}$ represents an alkyl group defined in the paragraph (2)). Specific examples of the alkoxy groups include, but are not limited to, methoxy group, ethoxy group, n-propoxy group, i-propoxy group, t-butoxy group, n-butoxy group, s-butoxy group, i-butoxy group, 2-hydroxyethoxy group, benzyloxy group, and trifluoromethoxy group.

(4) An aryloxy group. Specific examples of the aryl groups include, but are not limited to, phenyl group and naphthyl group. The aryloxy group can be substituted with an alkoxy group having 1 to 4 carbon atoms, an alkyl group having 1 to 4 carbon atoms, or a halogen atom. Specific examples of the aryloxy groups include, but are not limited to, phenoxy group, 1-naphthyloxy group, 2-naphthyloxy group, 4-methoxyphenoxy group, and 4-methylphenoxy group.

(5) An alkylmercapto group or an arylmercapto group. Specific examples of these groups include, but are not limited to, methylthio group, ethylthio group, phenylthio group, and p-methylphenylthio group.

(6) A substituent group represented by the following chemical formula 15:

Chemical formula 15

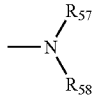

wherein each of $R_{56}$ and $R_{57}$ independently represents hydrogen atom, an alkyl group defined in the paragraph (2), or an aryl group (e.g., phenyl group, biphenyl group, naphthyl group) which can be substituted with an alkoxy group having 1 to 4 carbon atoms, an alkyl group having 1 to 4 carbon atoms, or a halogen atom; and wherein $R_{56}$ and $R_{57}$ optionally share bond connectivity to form a ring. Specific examples of the substituent groups mentioned above include, but are not limited to, amino group, diethylamino group, N-methyl-N-phenylamino group, N,N-diphenylamino group, N,N-di(tolyl)amino group, dibenzylamino group, piperidino group, morpholino group, and pyrrolidino group.

(7) An alkylenedioxy group and an alkylenedithio group such as methylenedioxy group and methylenedithio group.

(8) A substituted or unsubstituted styryl group, a substituted or unsubstituted β-phenyl styryl group, diphenyl aminophenyl group, dinitrile aminophenyl group, etc.

Specific examples of the arylene groups represented by $Ar_7$ and $Ar_8$ include, but are not limited to, divalent groups derived from the aryl groups represented by $Ar_9$ and $Ar_{10}$.

X represents a substituted or unsubstituted alkylene group, a substituted or unsubstituted cycloalkylene group, a substituted or unsubstituted alkylene ether group, an oxygen atom, a sulfur atom, or a vinylene group.

The substituted or unsubstituted alkylene group is a straight-chained or branched-chain alkylene group having 1 to 12 carbon atoms, preferably 1 to 8 carbon atoms, and more preferably 1 to 4 carbon atoms. These alkylene groups may have a fluorine atom, a hydroxyl group, a cyano group, an alkoxy group having 1 to 4 carbon atoms, a phenyl group, or a phenyl group substituted with a halogen atom, an alkyl group having 1 to 4 carbon atoms, or an alkoxy group having 1 to 4 carbon atoms. Specific examples of the substituted or unsubstituted alkylene groups include, but are not limited to, methylene group, ethylene group, n-butylene group, i-propylene group, t-butylene group, s-butylene group, n-propylene group, trifluoromethylene group, 2-hydroxyethylene group, 2-ethoxyethylene group, 2-cyanoethylene group, 2-methoxyethylene group, benzylidene group, phenylethylene group, 4-chlorophenylethylene group, 4-methylphenylethylene group, and 4-biphenylethylene group.

The substituted or non-substituted cycloalkylene group is a cyclic alkylene group having 5 to 7 carbon atoms which may have a fluorine atom, a hydroxyl group, an alkyl group having 1 to 4 carbon atoms, or an alkoxy group having 1 to 4 carbon atoms. Specific examples of the substituted or non-substituted cycloalkylene groups include, but are not limited to, cyclohexylidene group, cyclohexylene group, and 3,3-dimethylcyclohexylidene group.

Specific examples of the substituted or non-substituted alkylene ether groups include, but are not limited to, ethyleneoxy group, propyleneoxy group, ethylene glycol, propylene glycol, diethylene glycol, tetraethylene glycol, and tripropylene glycol. The alkylene group of the alkylene ether group may have a substituent group, for example, a hydroxyl group, a methyl group, and an ethyl group.

Specific examples of the vinylene groups include, but are not limited to, the following substituent groups:

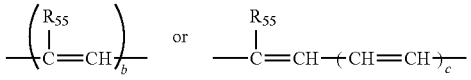

$R_{55}$ represents hydrogen atom, an alkyl group (same as defined in the paragraph (2)), or an aryl group (same aryl groups as represented by $Ar_9$ and $Ar_{10}$); a represents an integer of 1 or 2; and b represents an integer of from 1 to 3.

Z represents a substituted or unsubstituted alkylene group, a substituted or non-substituted alkylene ether group, or an alkyleneoxycarbonyl group.

Examples of the substituted or unsubstituted alkylene group include, but are not limited to, the same alkylene groups as those described in the X.

Examples of the substituted or non-substituted alkylene ether divalent group include, but are not limited to, the same alkylene ether groups as those described in the X.

Specific examples of the alkyleneoxycarbonyl group include, but are not limited to, caprolactone-modified groups.

As the monomers having a radical polymerizable functional group with a charge transport structure for use in the present invention, compounds represented by the following chemical formula 16 are preferably used.

Chemical formula 16

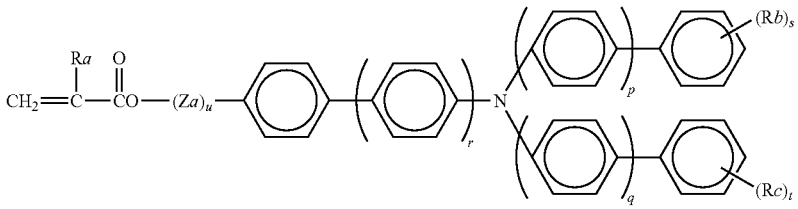

In the chemical structure 16, u, r, p, q each, independently, represent 0 or 1, s and t each, independently, represent 0 or an integer of from 1 to 3, Ra represents hydrogen atom or methyl group, each of Rb and Rc independently represents an alkyl group having 1 to 6 carbon atoms, and Za represents methylene group, ethylene group, —$CH_2CH_2O$—, —$CHCH_3CH_2O$—, or —$C_6H_5CH_2CH_2$—.

Among the compounds represented by Chemical structure 16 illustrated above, the compounds having a methyl group or an ethyl group as each of Rb and Rc are preferred.

The monomer having one radical polymerizable functional group with a charge transport structure for use in the present invention represented by the chemical structures 13, 14 and especially 16 is polymerized in such a manner that the double linkage of C and C is open to both ends. Therefore, the monomer having one radical polymerizable functional group with a charge transport structure is not present at the end but in the chained polymer. In a polymer in which a cross linking chain is formed with a radical polymerizable monomer without a charge transfer structure, the monomer having one radical polymerizable functional group with a charge transport structure is present in the main chains of the polymer and in a cross linking chain. There are two kinds of cross linking chains. One is referred to as inter-molecule cross linking, in which the cross linking chain is formed between a polymer and another polymer. The other is referred to as internal cross linking, in which the cross linking chain is formed between a portion in the main chain present in a polymer formed in a folded state and another portion deriving from the monomer which is polymerized at a position remote from that portion in the main chain. Whether the monomer having at least 3 radical polymerizable functional groups is present in a main chain or in a cross linking chain, the preferred triaryl amine structure suspending from the chain portion has at least three aryl groups disposed in the radial directions from the nitrogen atom therein. Such a triaryl amine structure is bulky and does not directly bind with the chain portion but suspends from the chain portion via a carbonyl group, etc. That is, the triaryl amine structure is stereoscopically fixed in the polymer in a flexible state. Therefore, these triaryl amine structures can be adjacent to each other with a moderate space in a polymer. Therefore, the structural distortion in a molecule is slight. In addition, when the structure is used in the surface layer of an image bearing member, it can be deduced that the internal molecular structure can have a structure in which there are relatively few disconnections in the charge transport route.

Specific examples of the monomers having one radical polymerizable functional group with a charge transport structure include, but are not limited to, the following:

No. 1

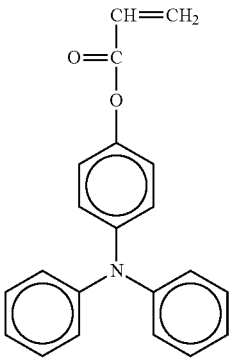

-continued

No. 2

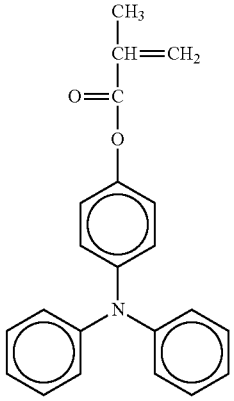

No. 3

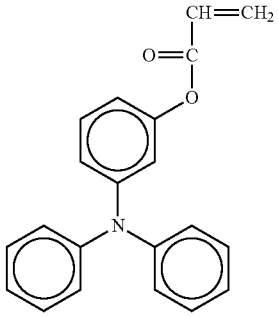

No. 4

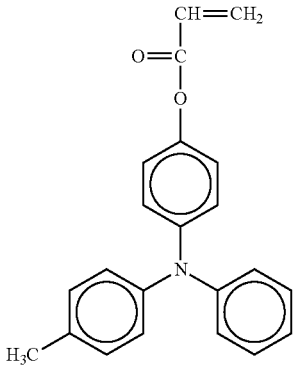

No. 5

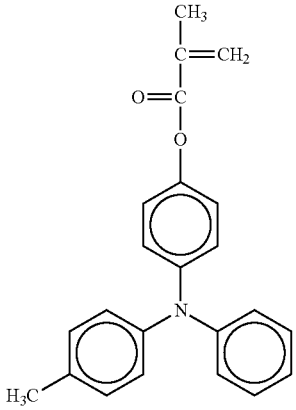

-continued
No. 6
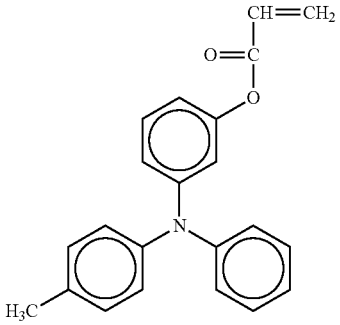
No. 7
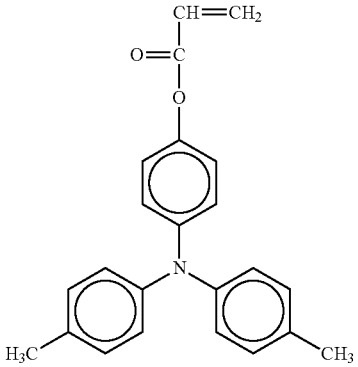
No. 8
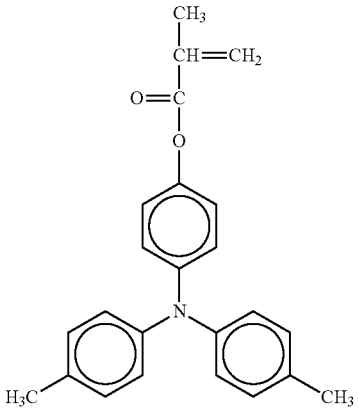
No. 9
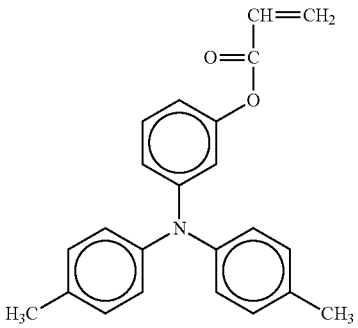
-continued
No. 10
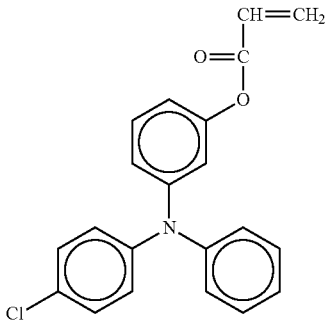
No. 11
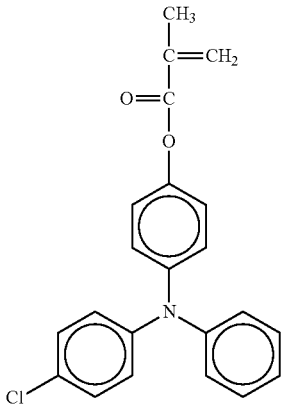
No. 12
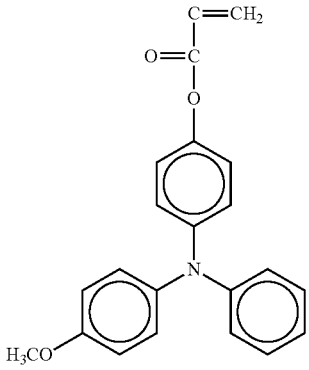
No. 13
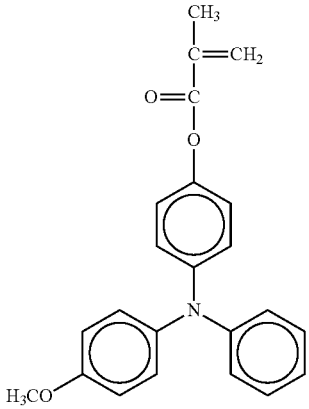

-continued
No. 14
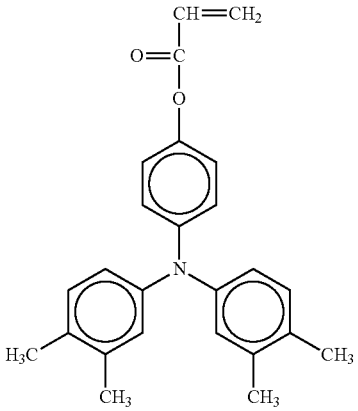
No. 15
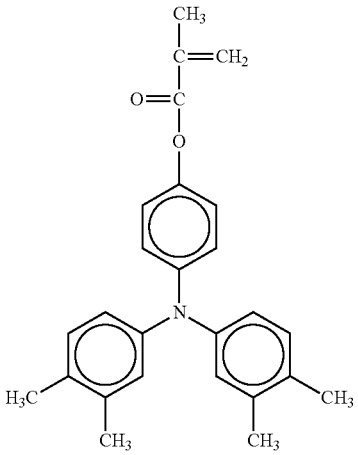
No. 16
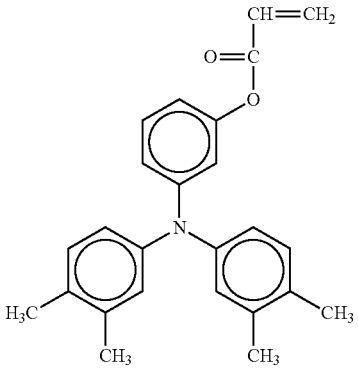
No. 17
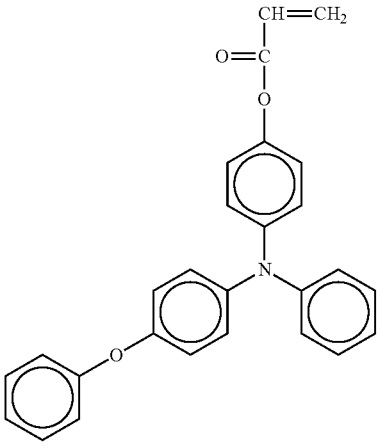
-continued
No. 18
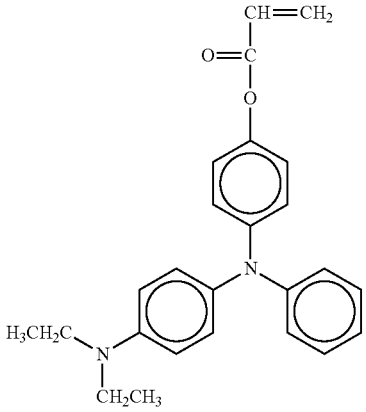
No. 19
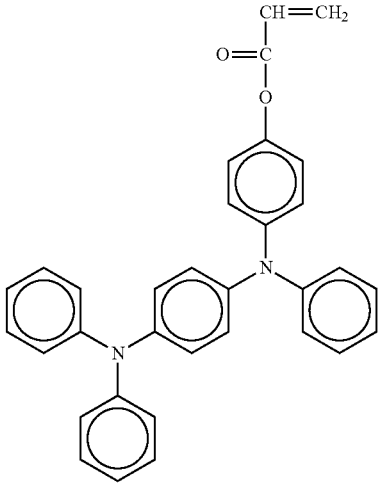
No. 20
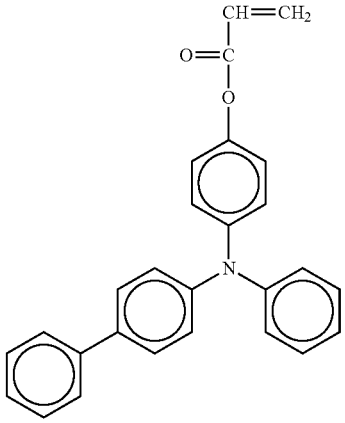

-continued
No. 21
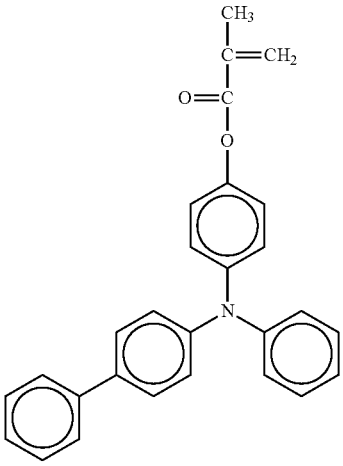
No. 22
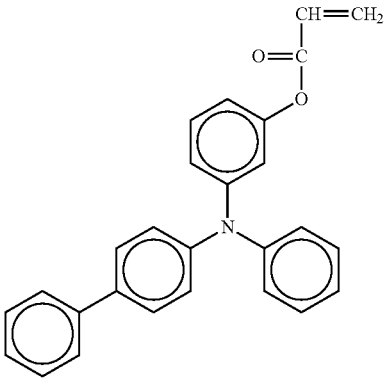
No. 23
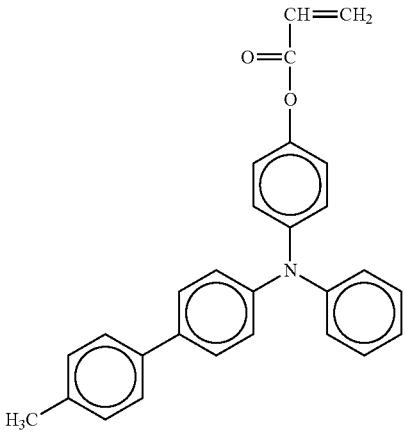
-continued
No. 24
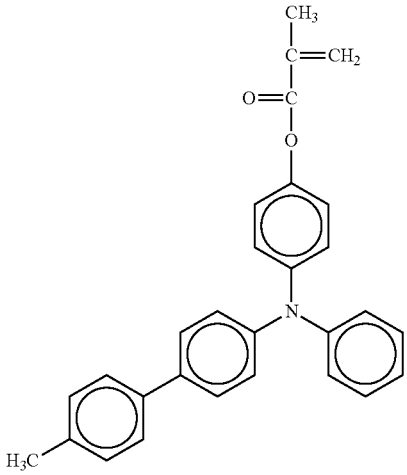
No. 25
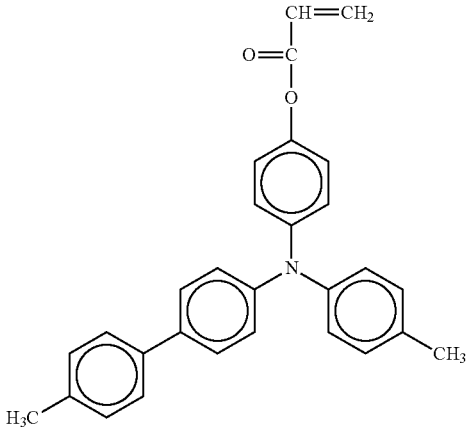
No. 26
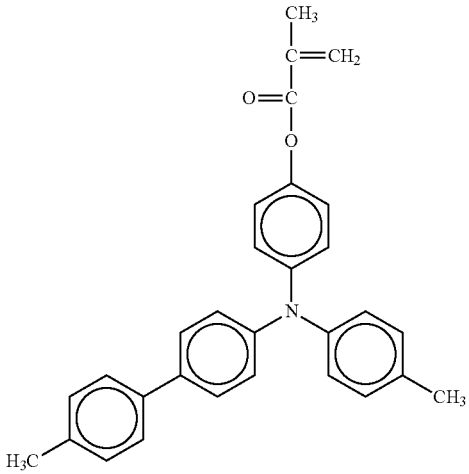

-continued
No. 27
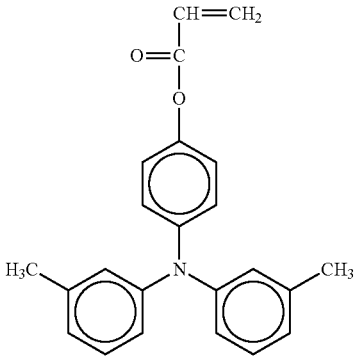
No. 28
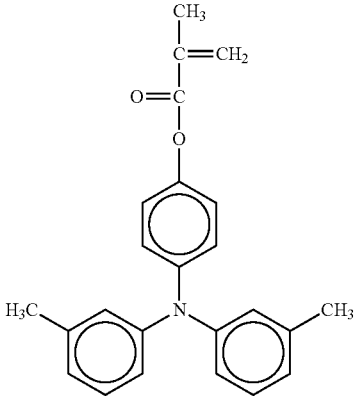
No. 29
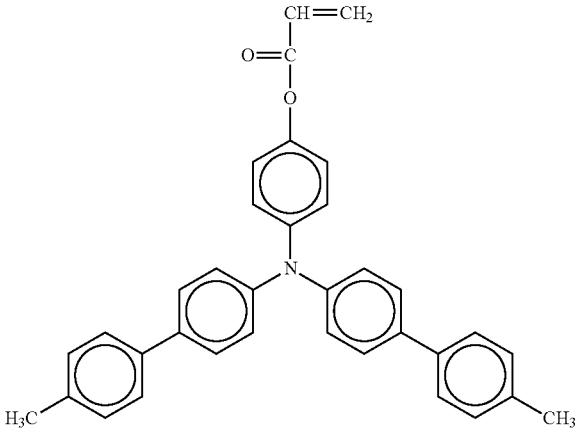
No. 30
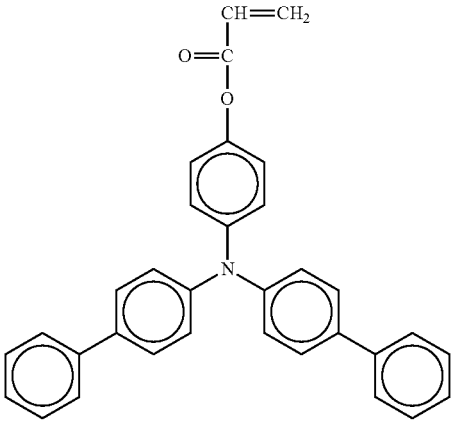
-continued
No. 31
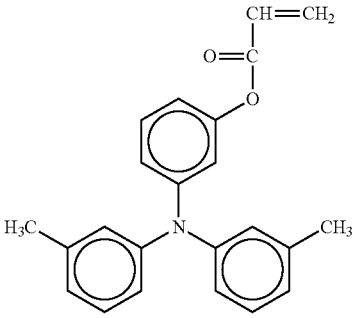
No. 32
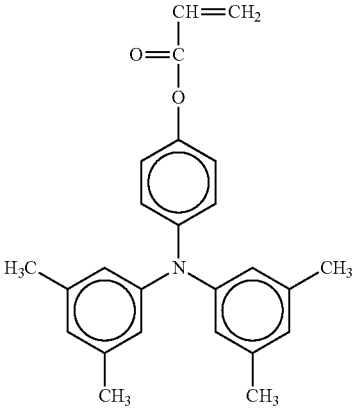
No. 33
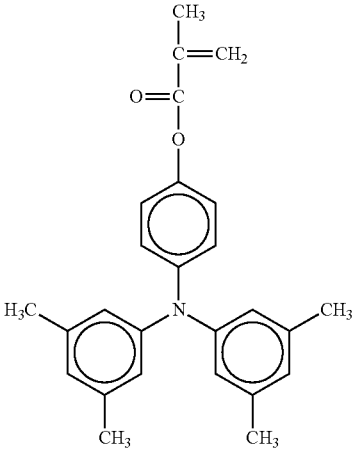
No. 34
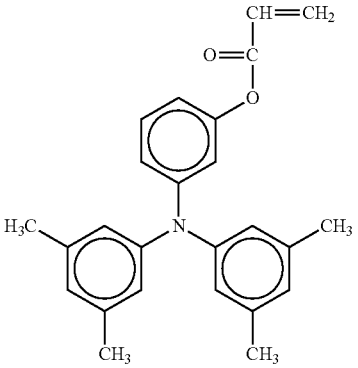

-continued
No. 35
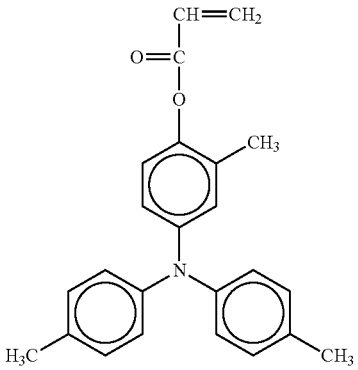
No. 36
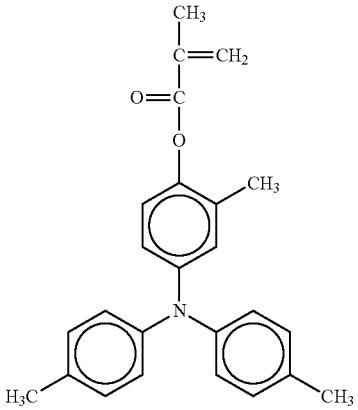
No. 37
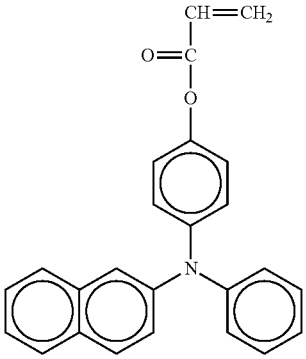
No. 38
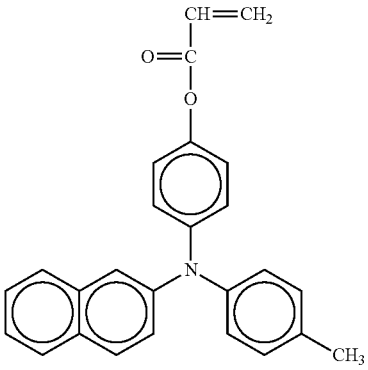
-continued
No. 39
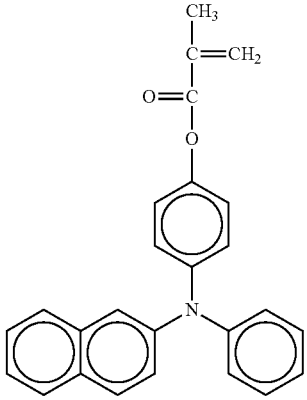
No. 40
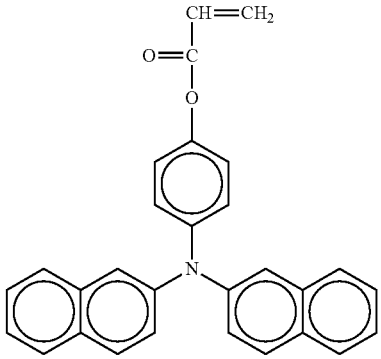
No. 41
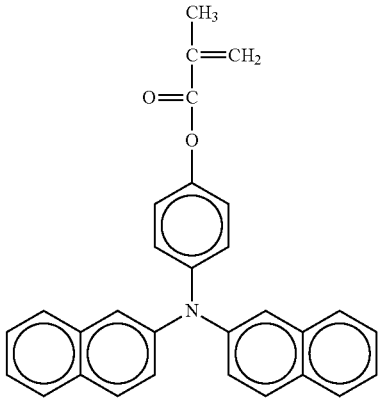

-continued
No. 42
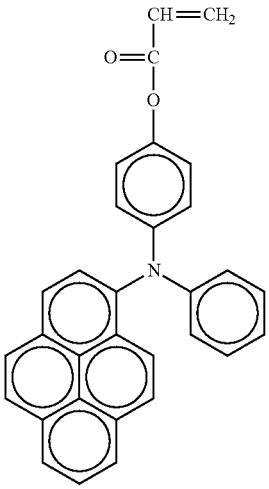
No. 43
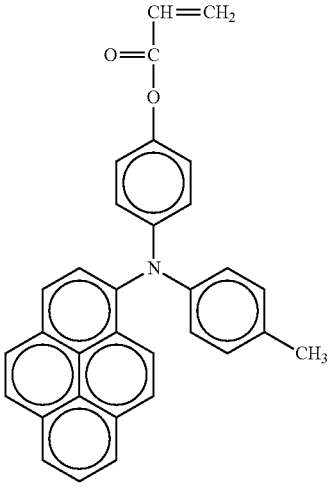
No. 44
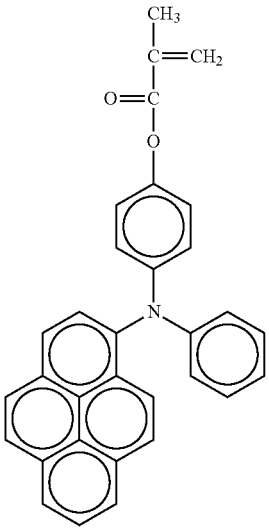
-continued
No. 45
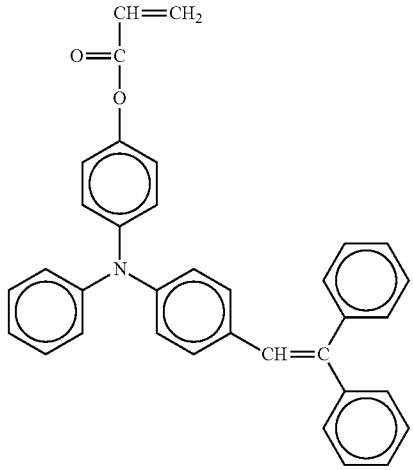
No. 46
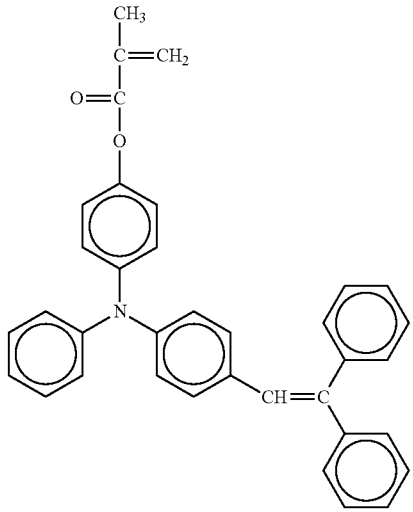
No. 47
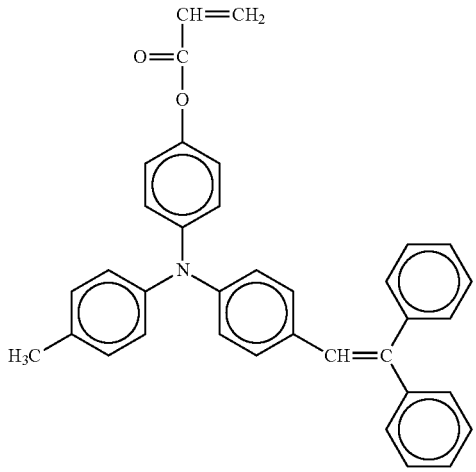

-continued
No. 48
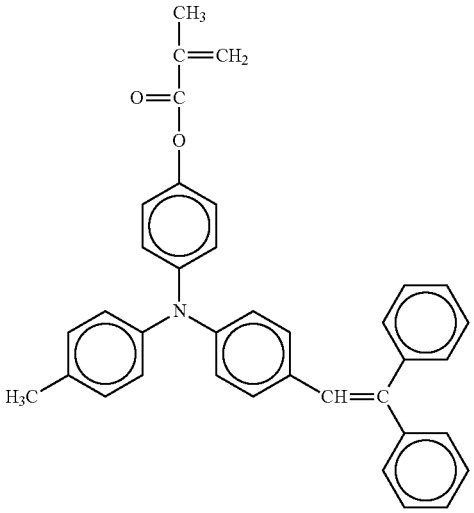
No. 49
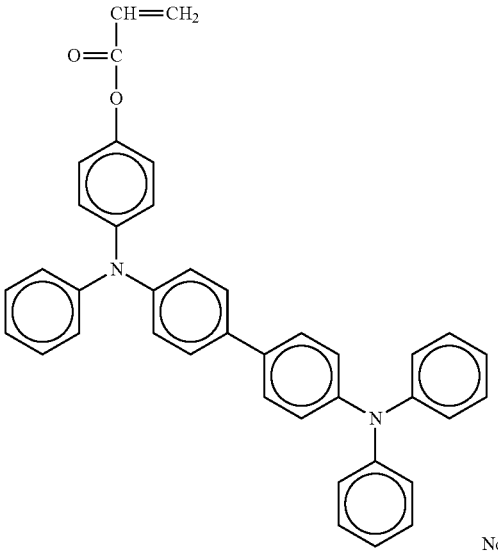
No. 50
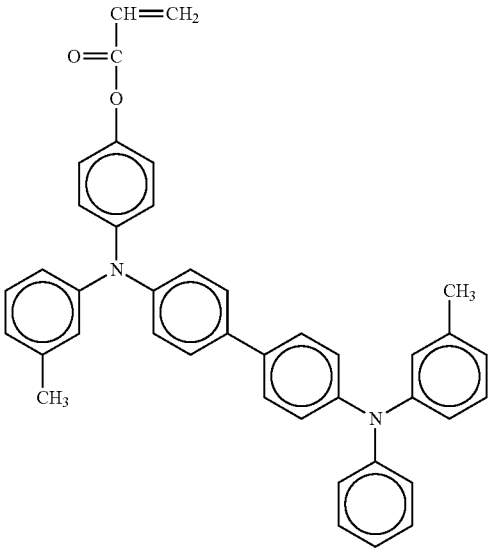
-continued
No. 51
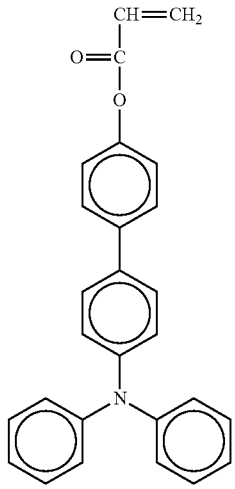
No. 52
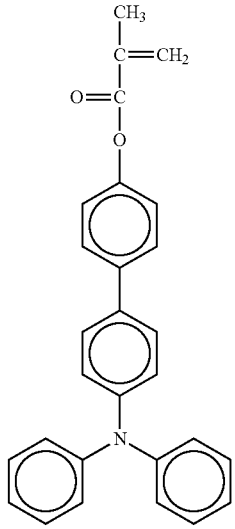
No. 53
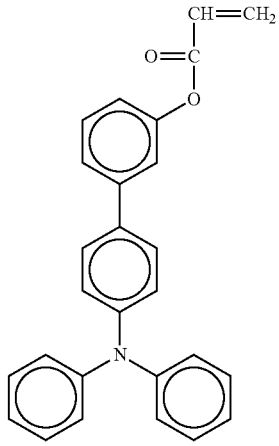

-continued
No. 54
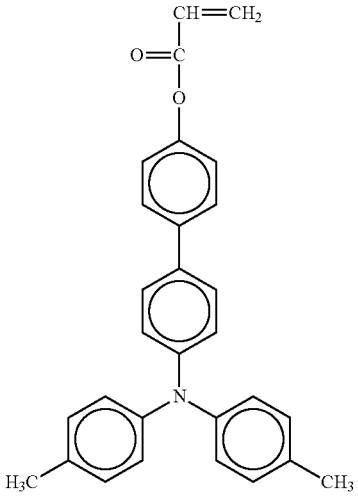
No. 55
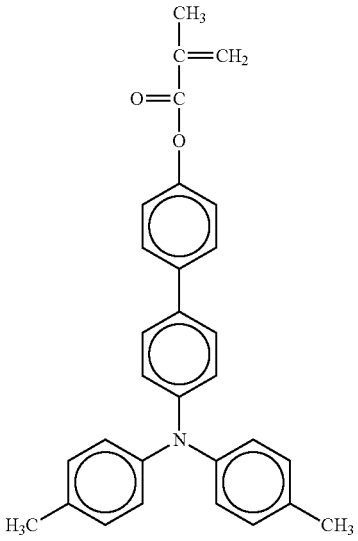
No. 56
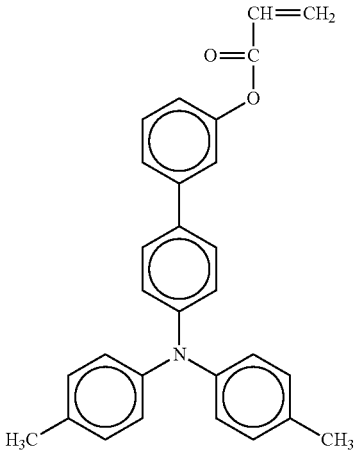
-continued
No. 57
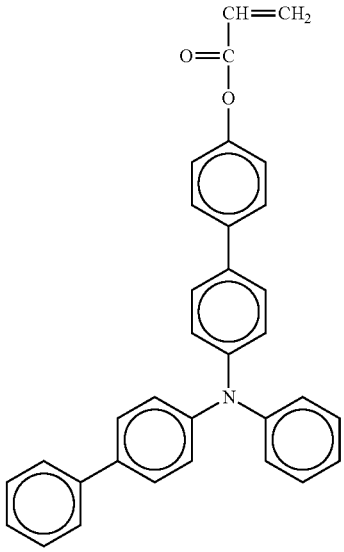
No. 58
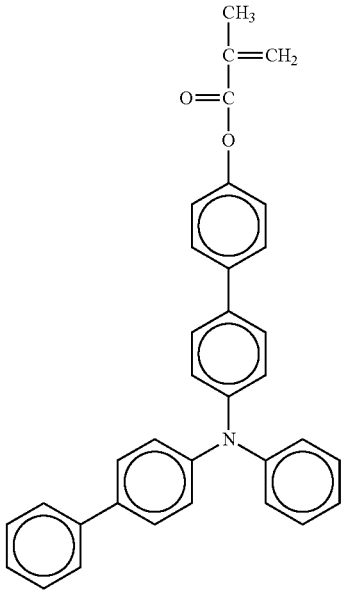

-continued
No. 59
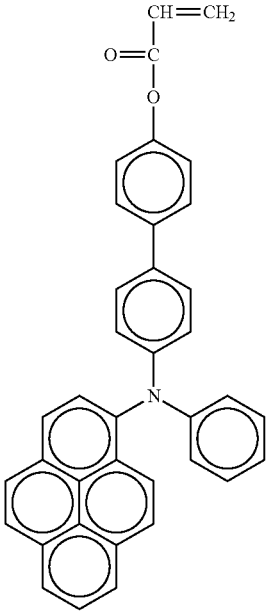
No. 60
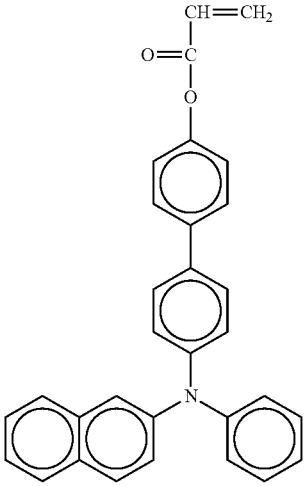
No. 61
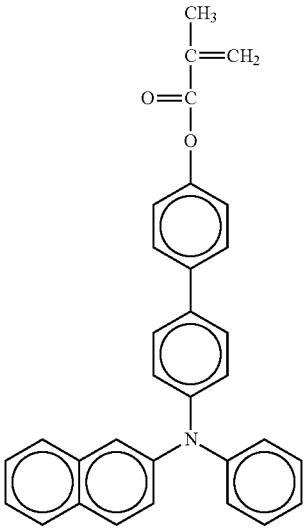
-continued
No. 62
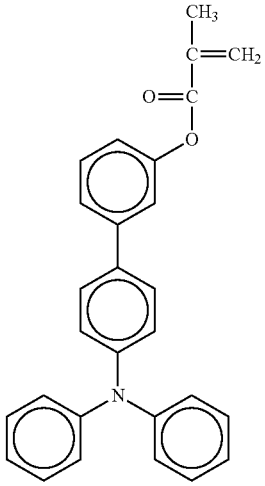
No. 63
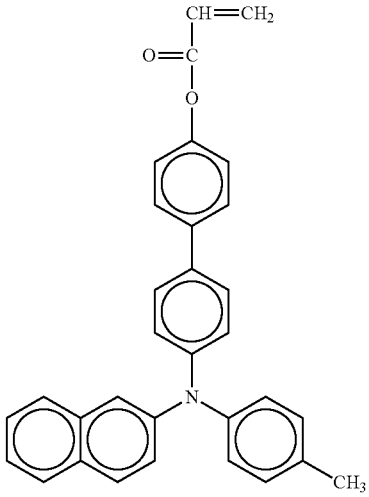
No. 64
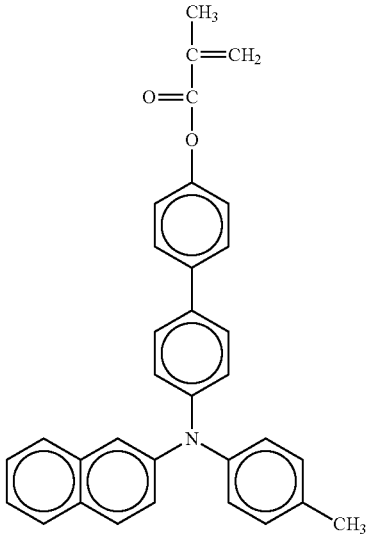

-continued
No. 65
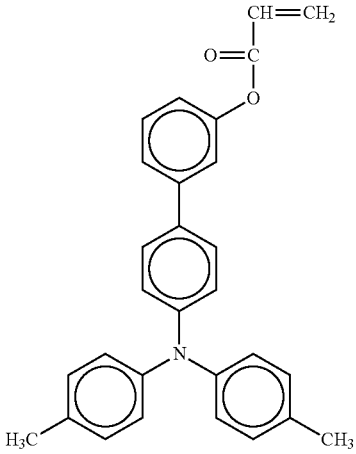
No. 66
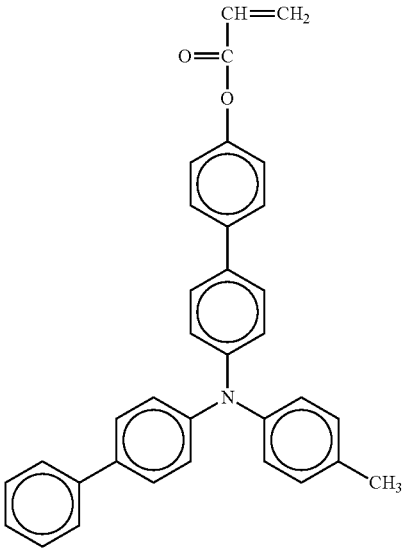
No. 67
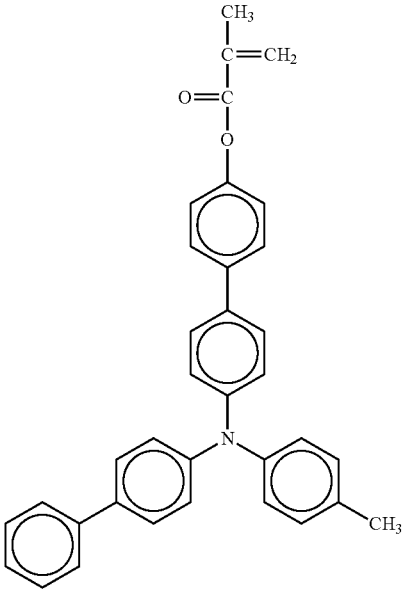
-continued
No. 68
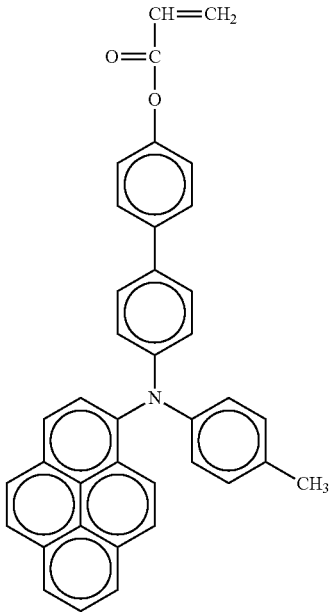
No. 69
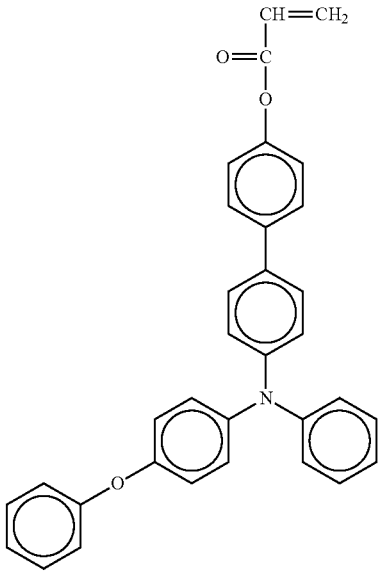

-continued
No. 70
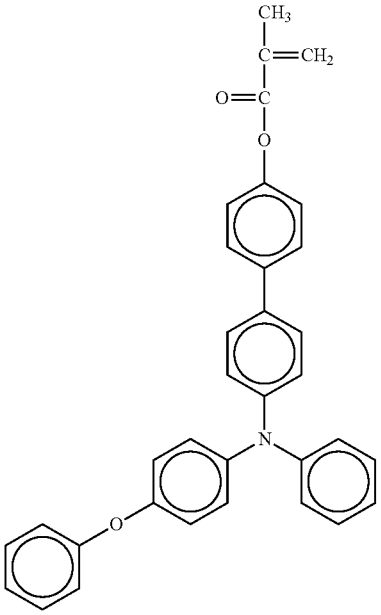
No. 71
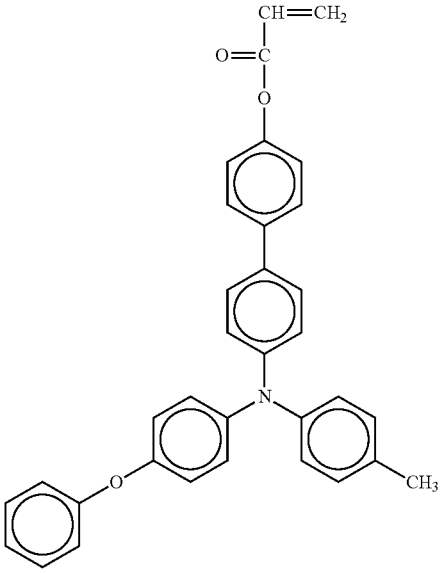
No. 72
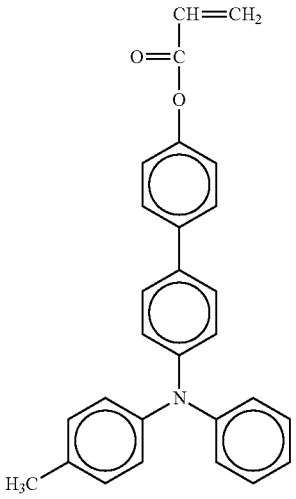
-continued
No. 73
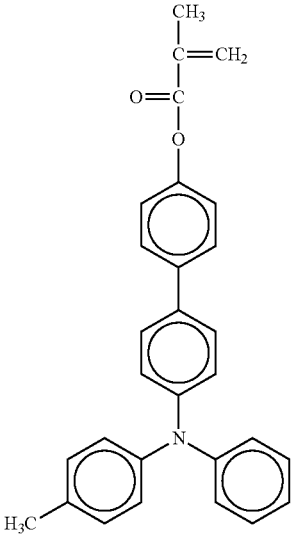
No. 74
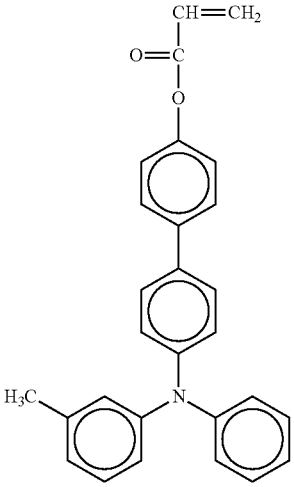
No. 75
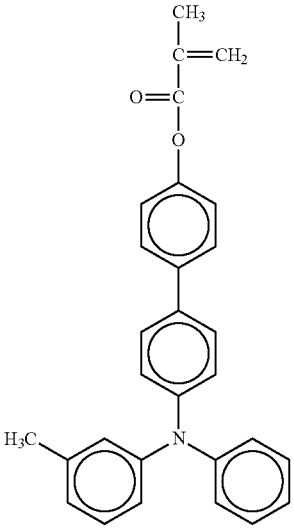

-continued
No. 76
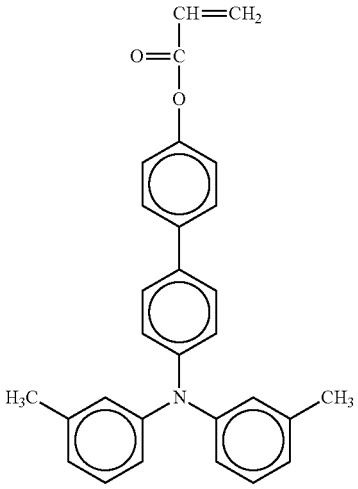
No. 77
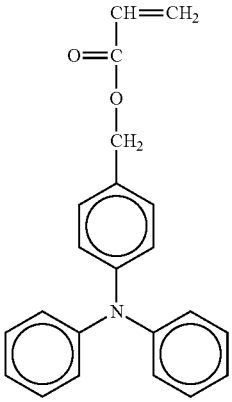
No. 78
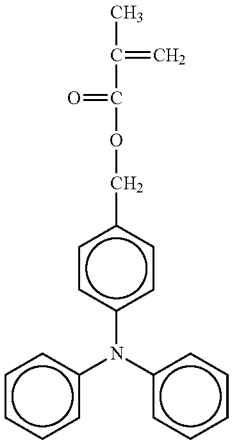
-continued
No. 79
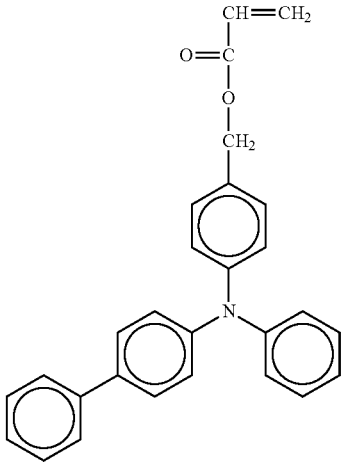
No. 80
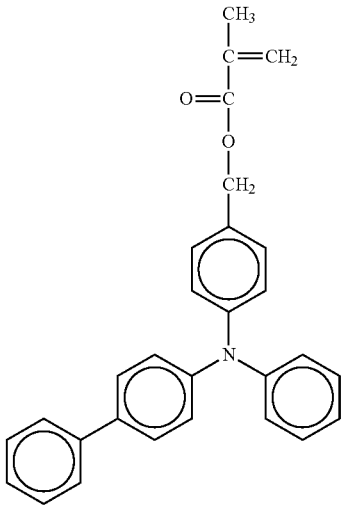
No. 81
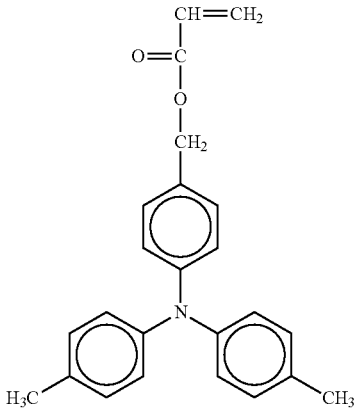

-continued
No. 82
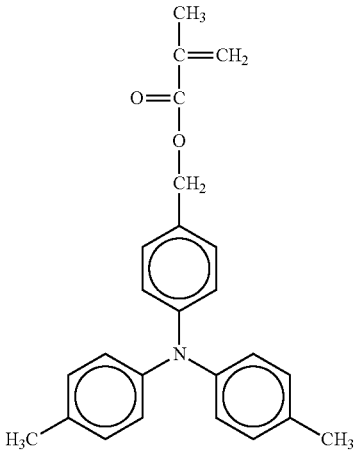
No. 83
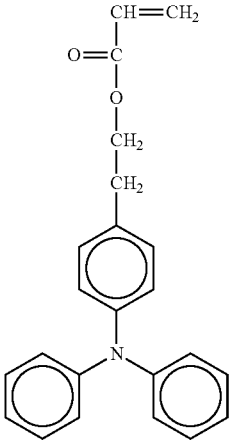
No. 84
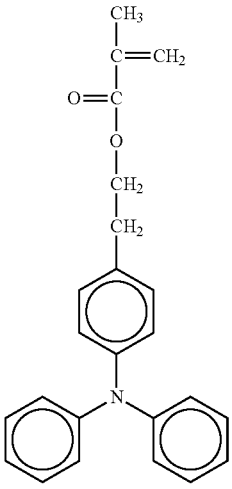
-continued
No. 85
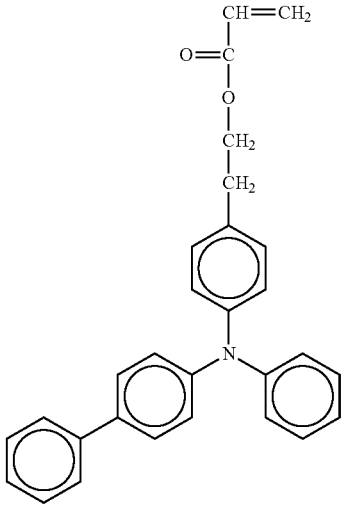
No. 86
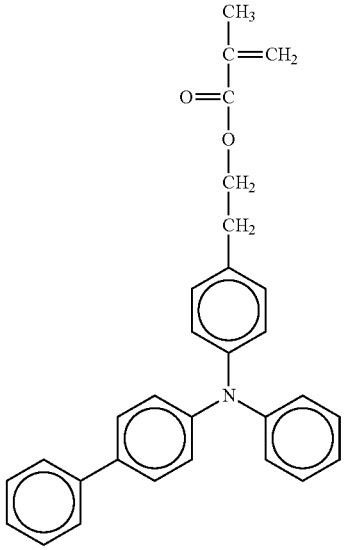
No. 87
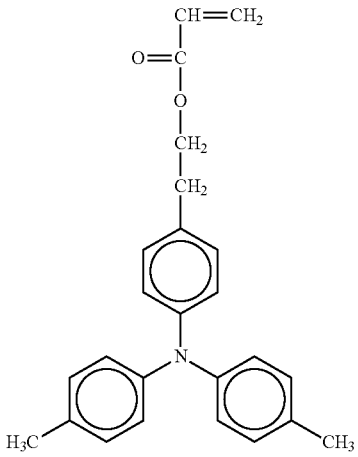

-continued
No. 88
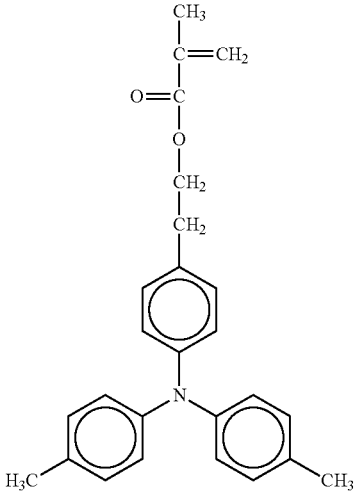
No. 89
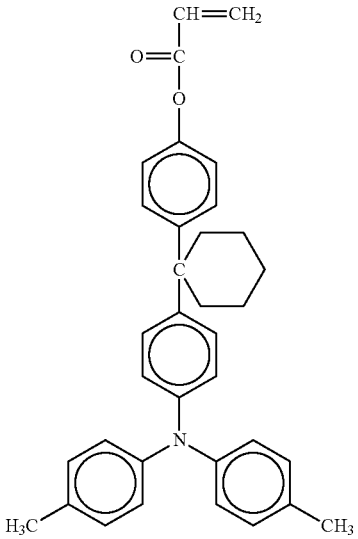
No. 90
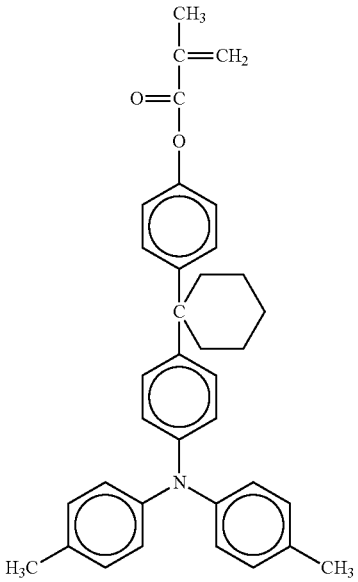
-continued
No. 91
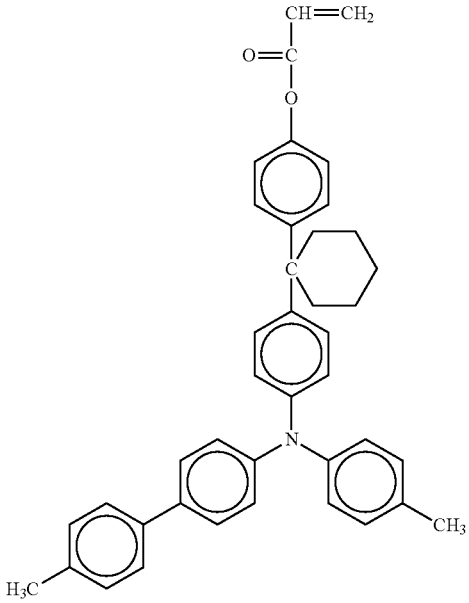
No. 92
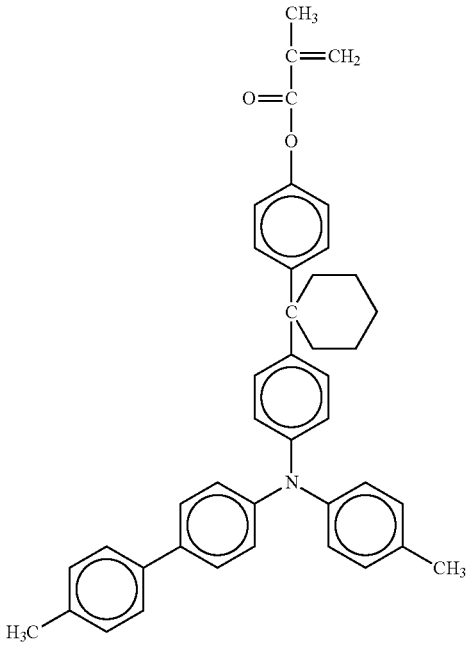

-continued
No. 93
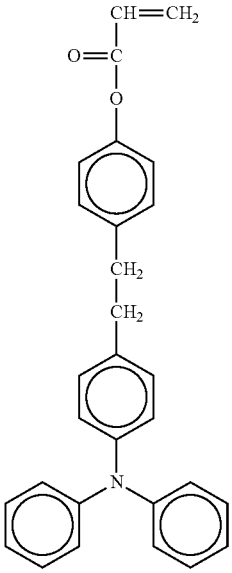
No. 94
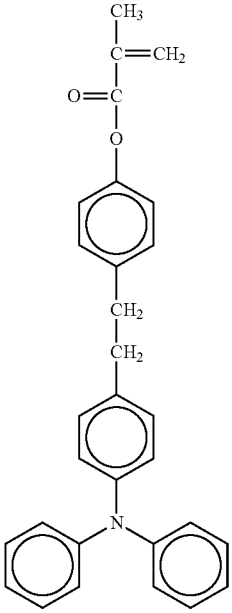
-continued
No. 95
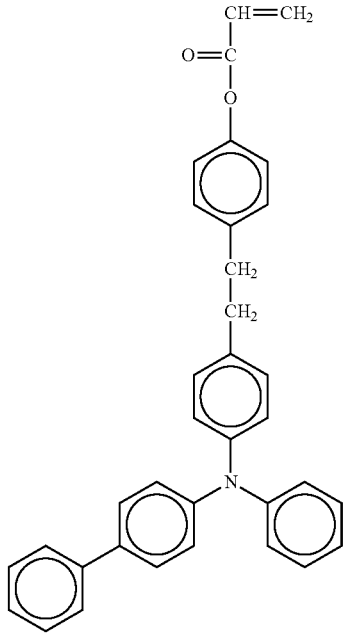
No. 96
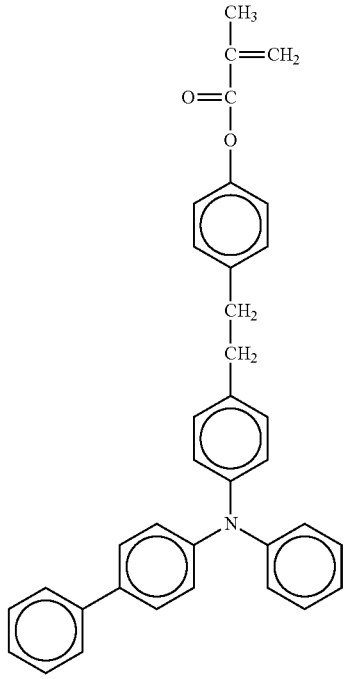

-continued
No. 97
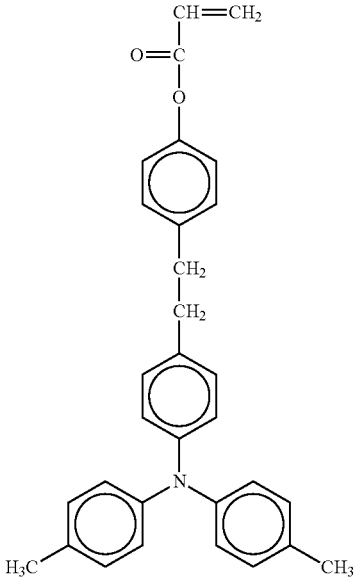
No. 98
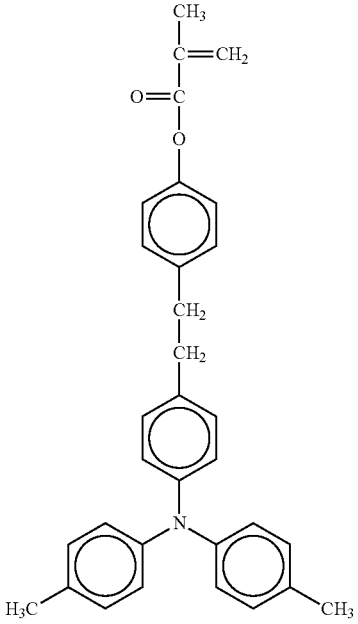
-continued
No. 99
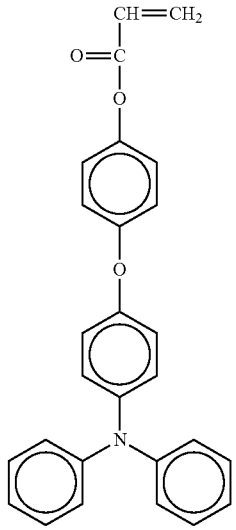
No. 100
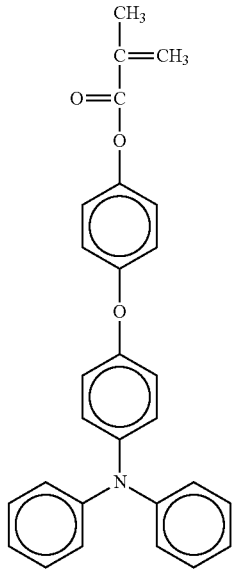

-continued
No. 101
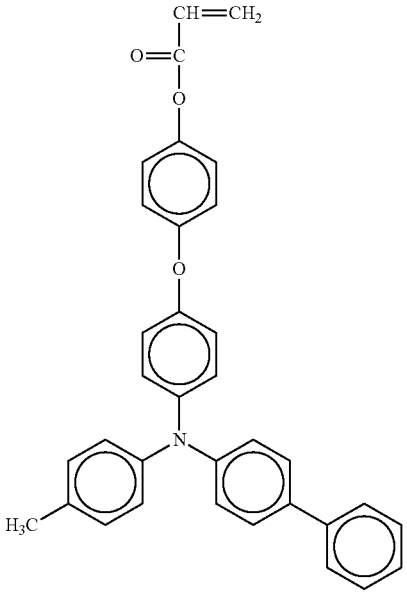
No. 102
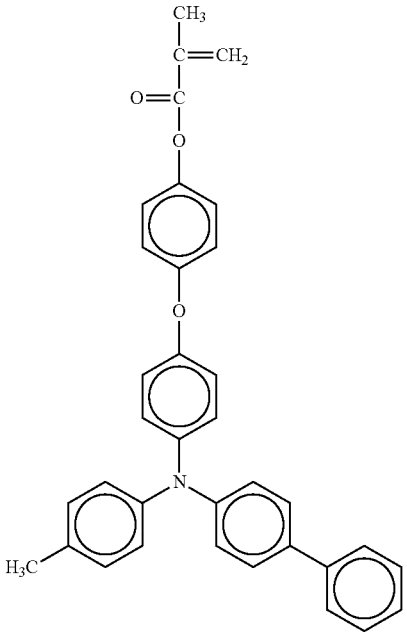
-continued
No. 103
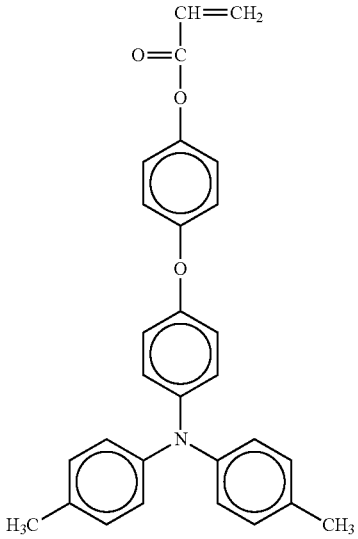
No. 104
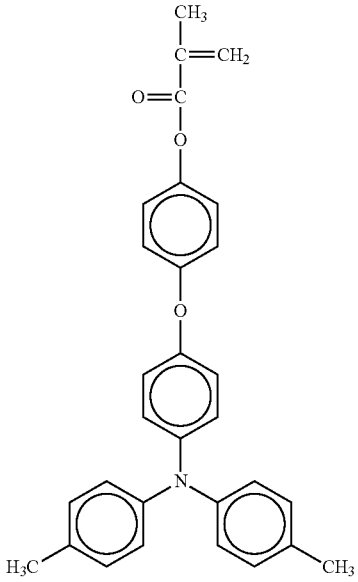

-continued
No. 105
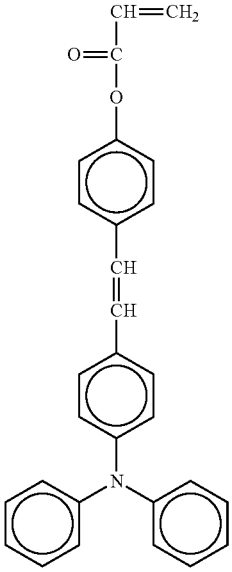
No. 106
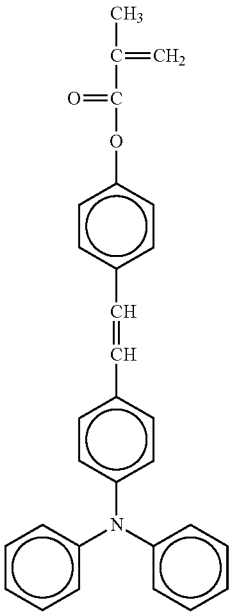
-continued
No. 107
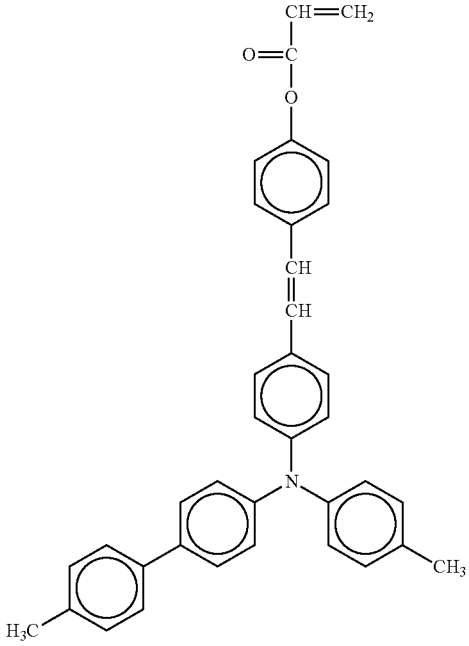
No. 108
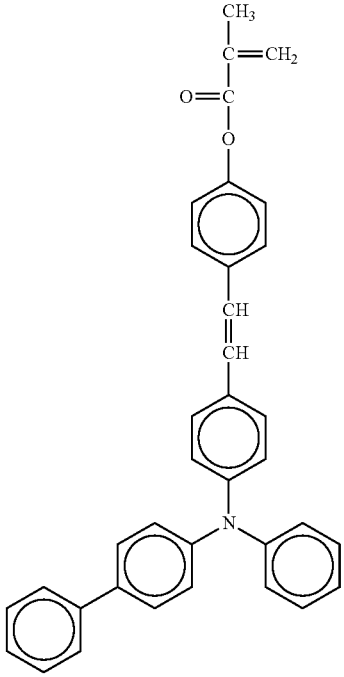

-continued
No. 109
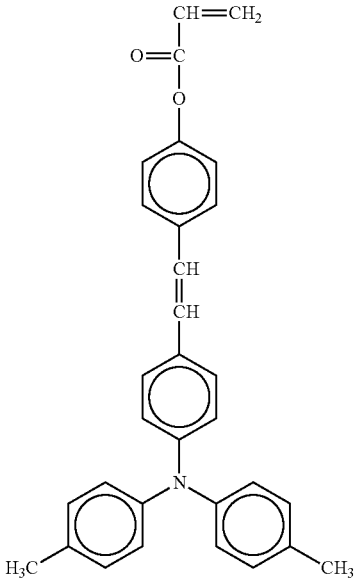
No. 110
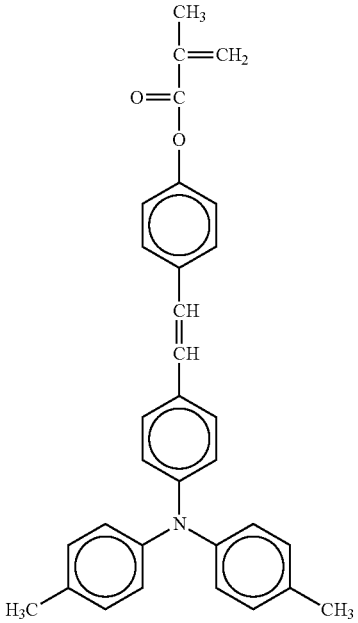
-continued
No. 111
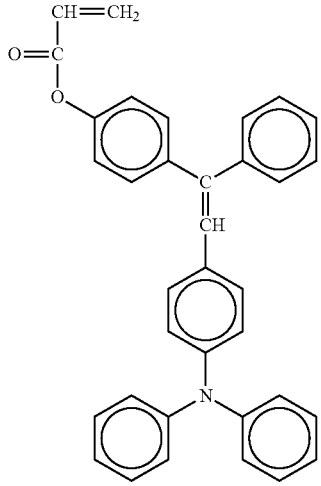
No. 112
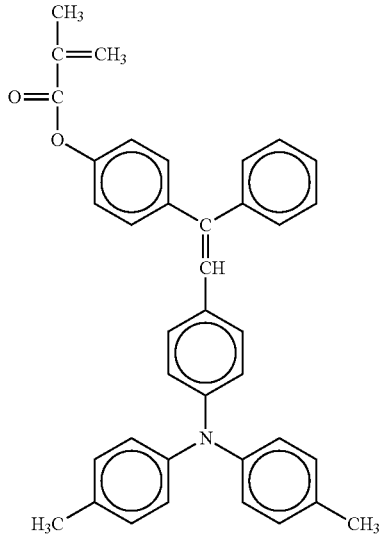
No. 113
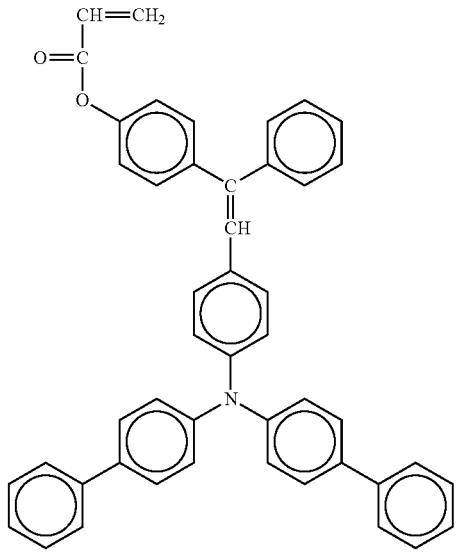

-continued
No. 114
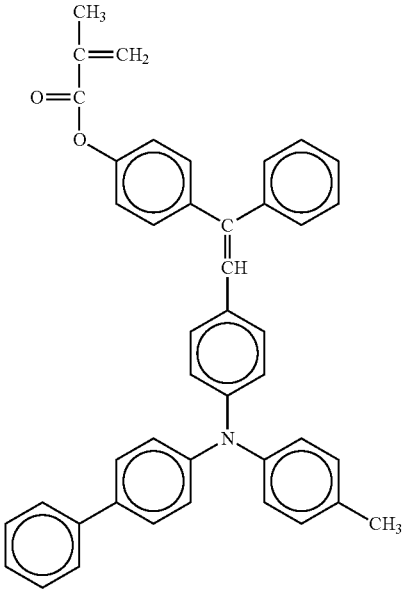
No. 115
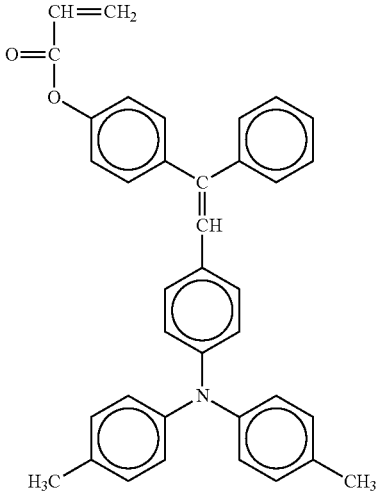
No. 116
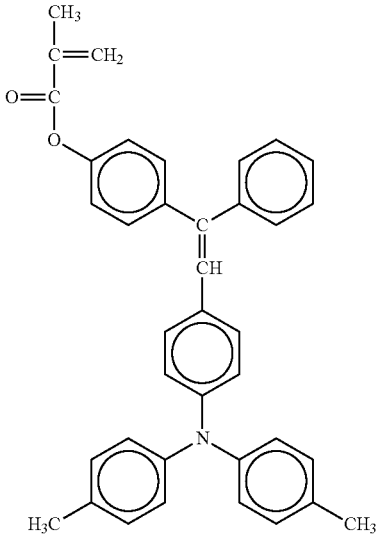
-continued
No. 117
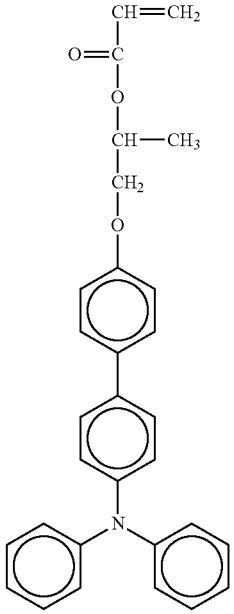
No. 118
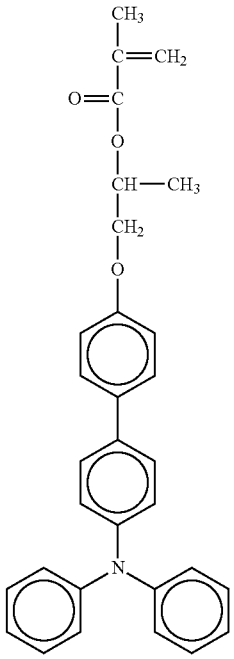

-continued
No. 119
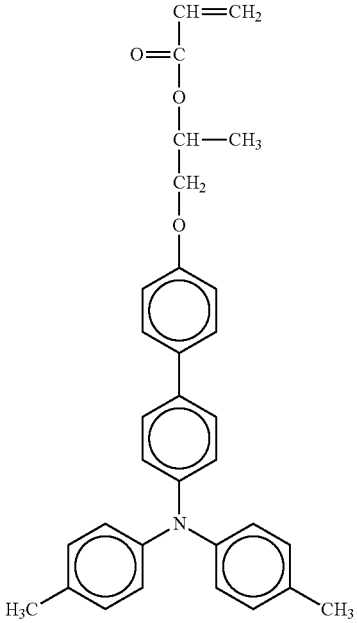
No. 120
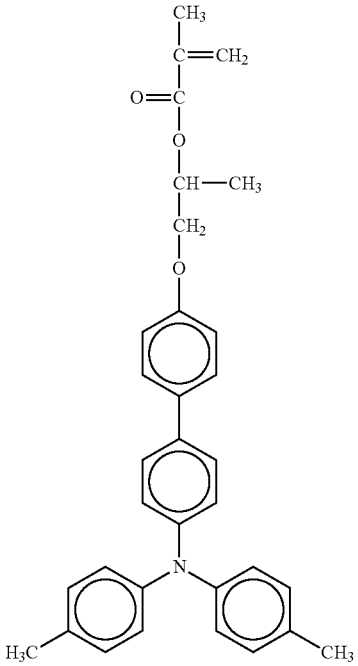
-continued
No. 121
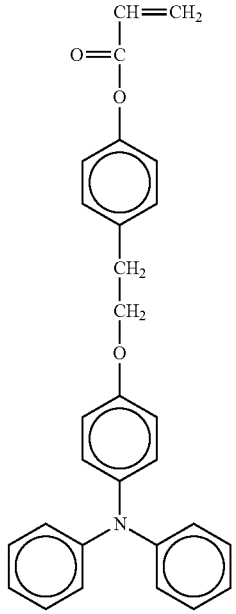
No. 122
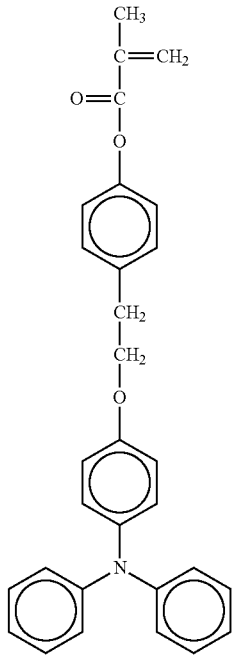

-continued
No. 123
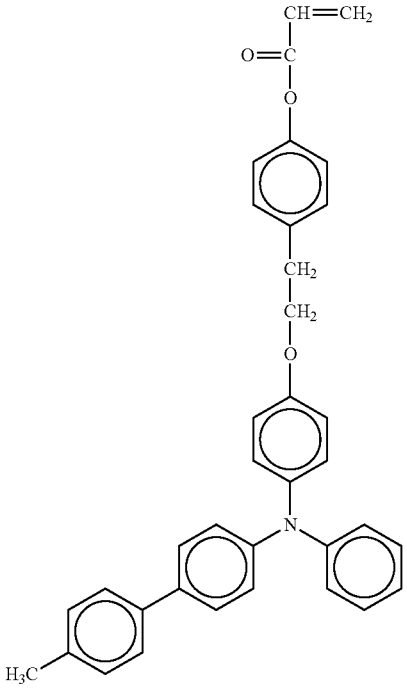
No. 124
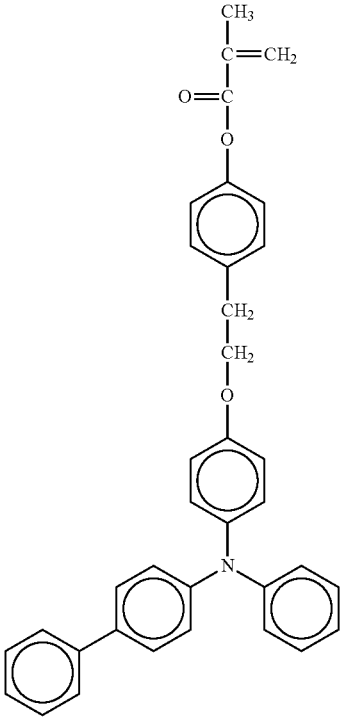
-continued
No. 125
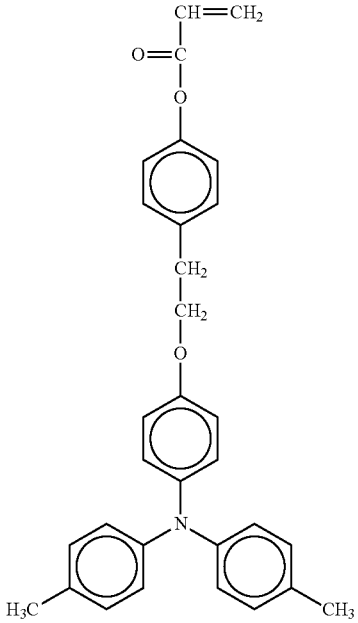
No. 126
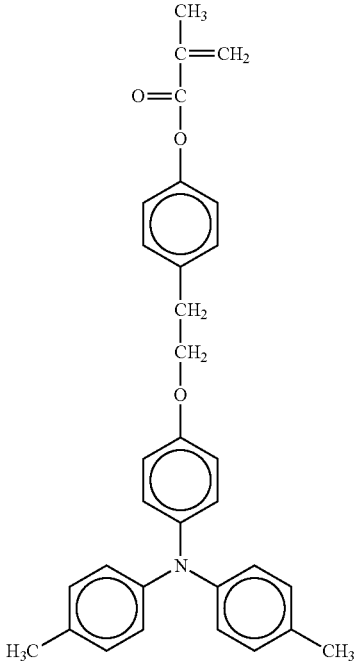

-continued
No. 127
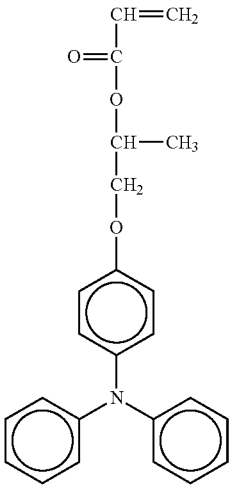
No. 128
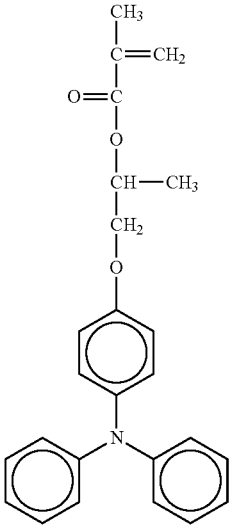
No. 129
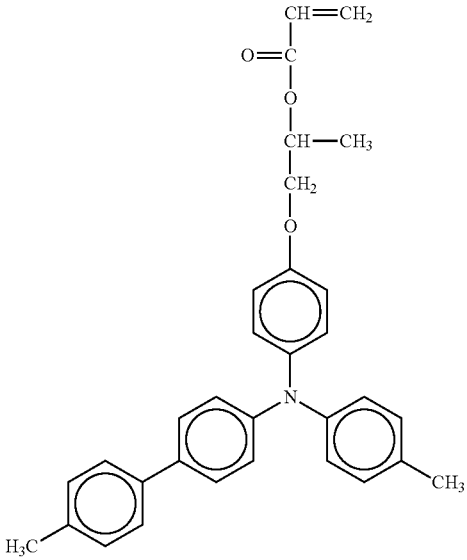
-continued
No. 130
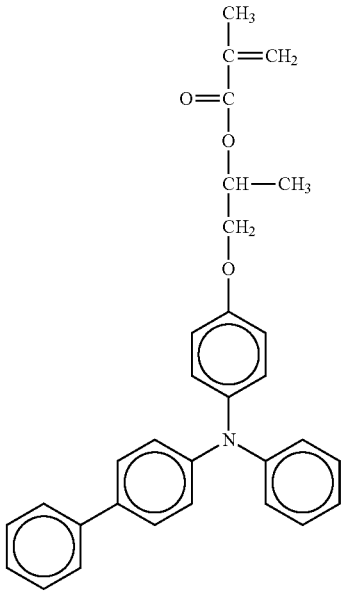
No. 131
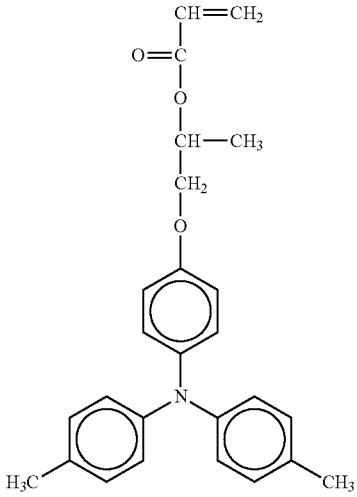
No. 132
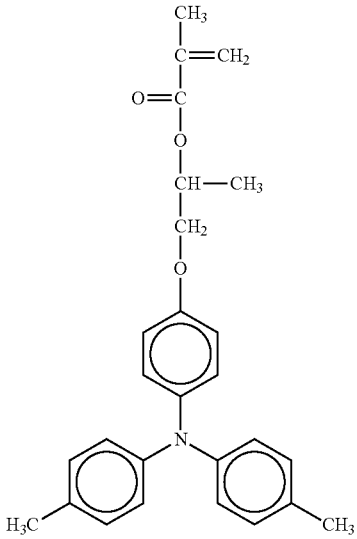

-continued
No. 133
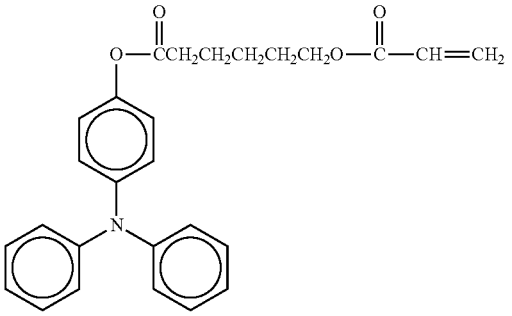
No. 134
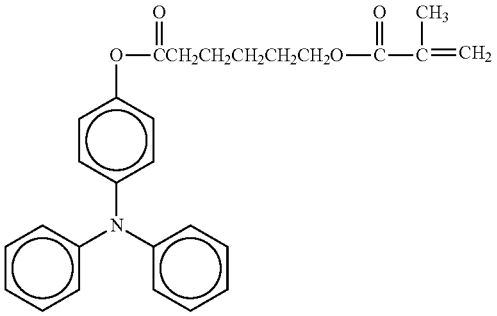
No. 135
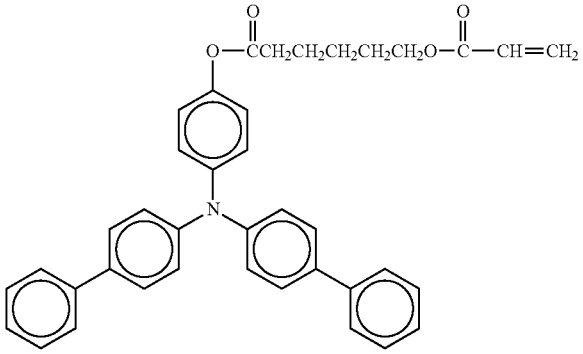
No. 136
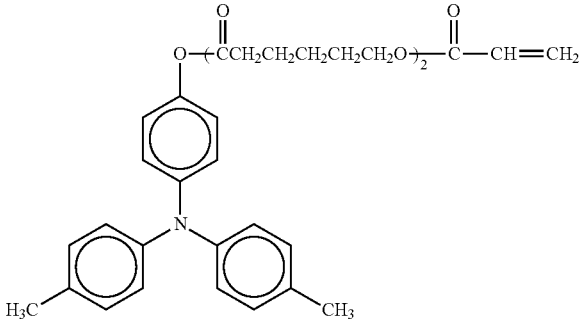
-continued
No. 137
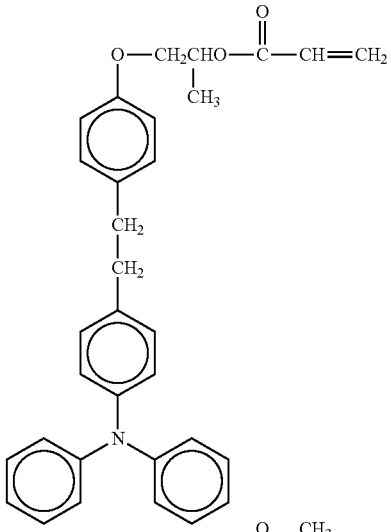
No. 138
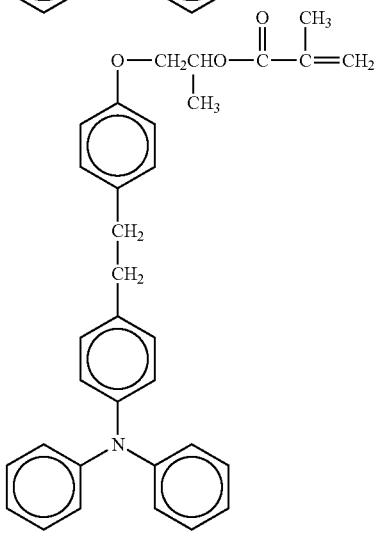
No. 139
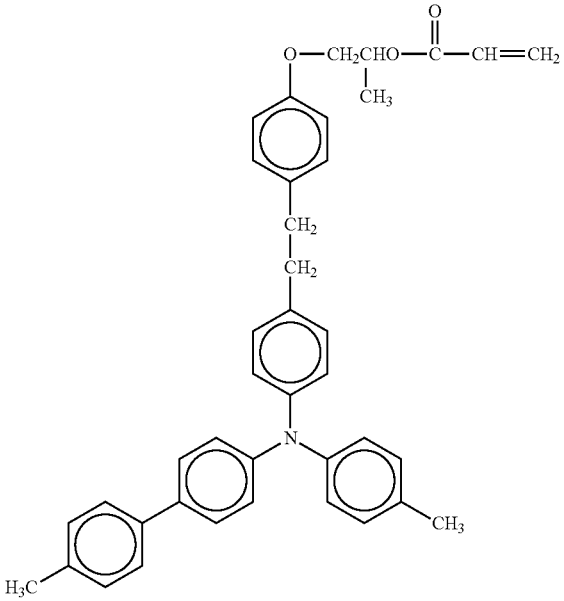

-continued
No. 140
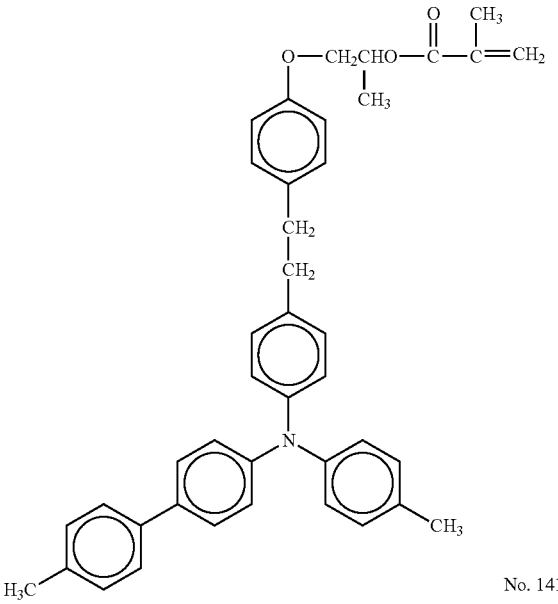
No. 141
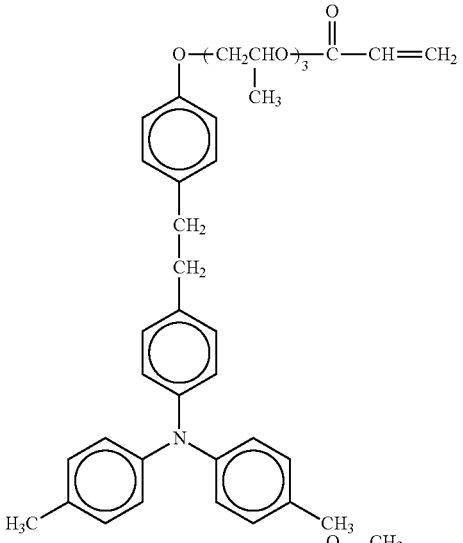
No. 142
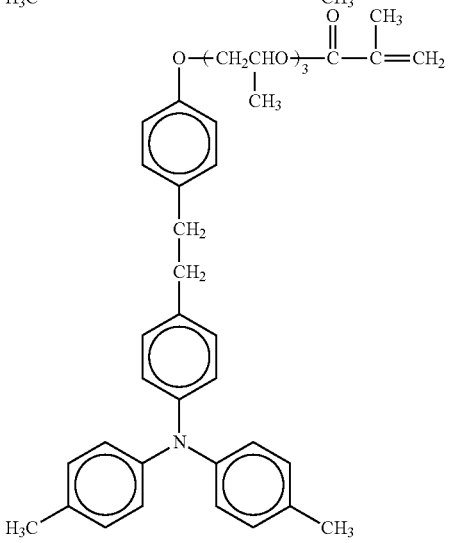
-continued
No. 143
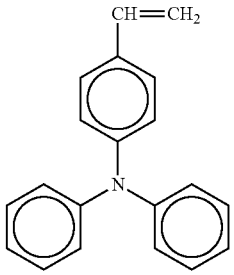
No. 144
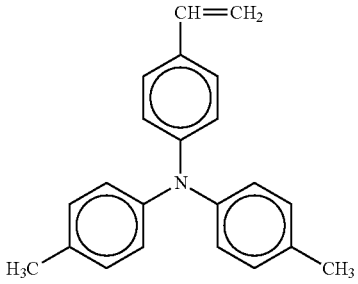
No. 145
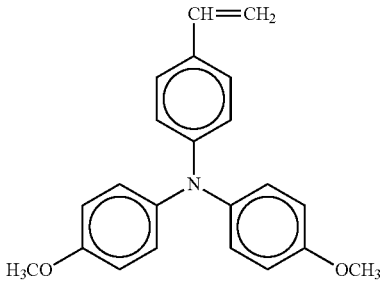
No. 146
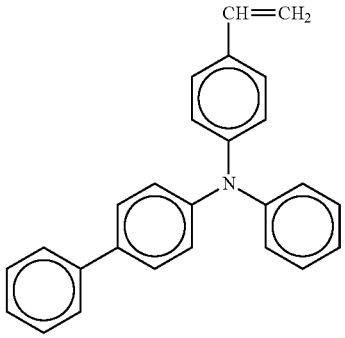
No. 147
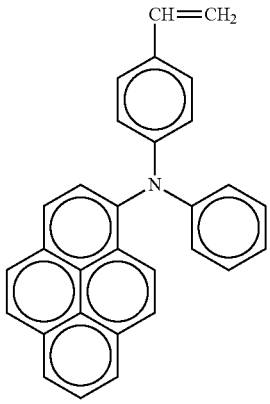

-continued
No. 148
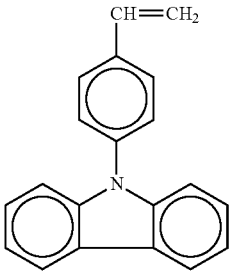
No. 149
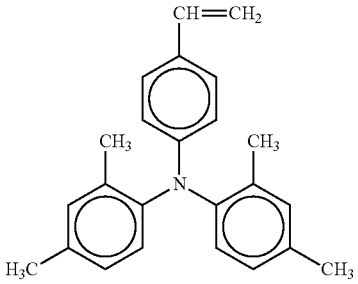
No. 150
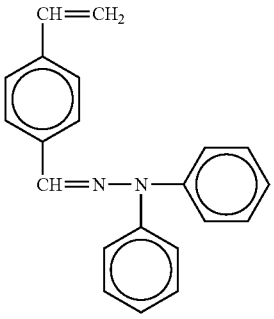
No. 151
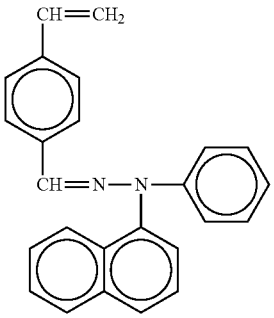
No. 152
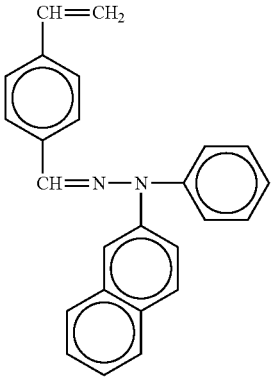
-continued
No. 153
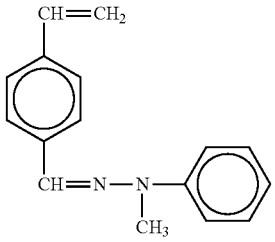
No. 154
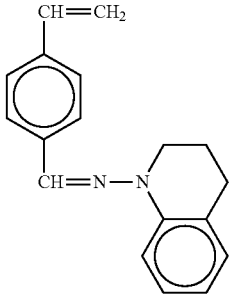
No. 155
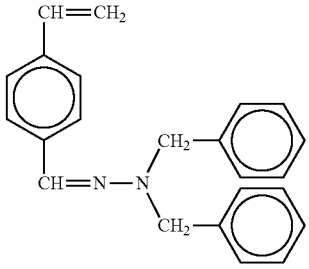
No. 156
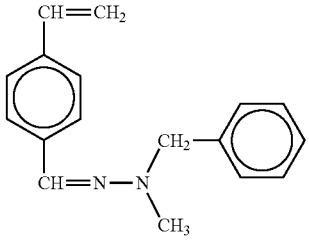
No. 157
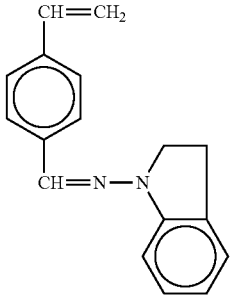
No. 158
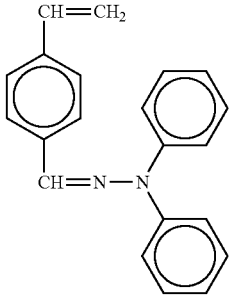

-continued

No. 159

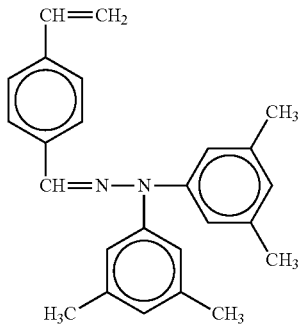

No. 160

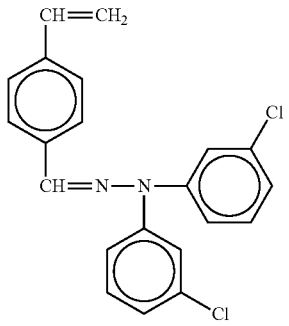

The monomer having one radical polymerizable functional group with a charge transport structure for use in the present invention imparts a charge transport function to a surface protective layer. The content thereof is from 20 to 80% by weight, and preferably from 30 to 70% by weight based on the total weight of the surface protective layer. When the content is too small, the charge transport function of the surface protective layer is not sustained, which may lead to the deterioration of the electric characteristics, for example, a decrease in the sensitivity and a rise in the residual voltage during repetitive use. When the content is too large, the content of the radical polymerizable monomer having at least three functional groups without a charge transport structure decreases. That is, the cross-linking density decreases, resulting in insufficient abrasion resistance. Desired electric characteristics and anti-abrasion property vary depending on the process. Therefore, it is difficult to jump to any conclusion but considering the balance of both characteristics and property, the addition amount is most preferably in the range of from 30 to 70% by weight.

The surface layer for use in the present invention is formed by curing at least a monomer having at least three radical polymerizable functional groups without a charge transport structure and a monomer having one radical polymerizable compound with a charge transport structure at the same time. In addition to these, a monomer or oligomer having one or more radical polymerizable functional groups and a functional monomer can be used to provide functions, for example, adjusting the viscosity upon coating, relaxing the stress in the surface protective layer, decreasing the surface energy, and reducing the friction index, etc. Any known radical polymerizable monomers and oligomers can be used.

Specific examples of the monomer having one or two radical polymerizable monomer which can be used in combination include the following but are not limited thereto:

2-ethylhexyl acrylate, 2-hydroxyethyl acrylate, 2-hydroxypropyl acrylate, tetrahydrofurfuryl acrylate, 2-ethylhexyl carbitol acrylate, 3-methoxybutyl acrylate, benzyl acrylate, cyclohexyl acrylate, isoamyl acrylate, isobutyl acrylate, methoxy triethylene glycol acrylate, phenoxy tetraethylene glycol acrylate, cetyl acrylate, isostearyl acrylate, stearyl acrylate, styrene, 1,3-butandiol diacrylate, 1,4-butane diol diacrylate, 1,4-butane diol dimethacrylate, 1,6-hexane diol diacrylate, 1,6-hexane diol dimethacrylate, diethylene glycol diacrylate, neopenthyl glycol diacrylate, bisphenol A-EO modified diacrylate, bisphenol F-EO modified diacrylate and neopenthyl glycol diacrylate.

Specific examples of the functional monomer include, but are not limited to, monomers in which a fluorine atom of, for example, octafluoro penthyl acrylate, 2-perfluorooctyl ethyl acrylate, 2-perfluorooctyl ethyl methacrylate and 2-perfluoroisononyl ethyl acrylate is substituted and also reactive additives having a radical polymerizable functional group can be used. These functional monomers can be used alone or in combination. The content of such a functional monomer is from 0.01 to 30% by weight and preferably from 0.05 to 20% by weight based on the solid portion of a liquid application forming a cross-linking layer.

Specific examples of the radical polymerizable oligomer include, but are not limited to, epoxyacrylate based, urethane acrylate based, and polyester acrylate based oligomers.

When a monomer having one or two radical polymerizable functional groups and/or a radical polymerizable oligomer are contained in a large amount, the three dimensional cross-linking density of the surface protective layer substantially decreases, which invites the deterioration of the anti-abrasion property. Therefore, the content of the monomer having one or two radical polymerizable functional groups and an oligomer is not greater than 150 parts by weight and preferably not greater than 100 parts by weight based on 100 parts by weight of the monomer mentioned above having at least three radical polymerizable functional groups with a charge transport structure.

The surface protective layer for use in the present invention is formed by simultaneously curing at least a monomer having at least three radical polymerizable functional groups without a charge transport structure and a monomer having a radical polymerizable functional group with a charge transport structure. To conduct the cross-linking reaction effectively, a polymerization initiator, for example, a thermal polymerization initiator, a photo polymerization initiator or a mixture thereof, can be added to the surface protective layer, if desired.

Specific examples of the thermal polymerization initiator include, but are not limited to, peroxide-based initiators, for example, 2,5-dimethylhexane-2,5-dihydroperoxide, dicumyl peroxide, benzoyl peroxide, t-butyl cumyl peroxide, 2,5-dimethyl-2,5-di(peroxybenzoyl)hexyne-3,di-t-butyl peroxide, t-butylhydroperoxide, cumene hydroperoxide and lauroyl peroxide, and azo based initiators, for example, azobis isobutylnitrile, azobiscyclohexane carbonitrile, azobis methyl isobutyric acid, azobis isobutyl amidine hydrochloride salts, and 4,4'-azobis-4-cyano valeric acid.

Specific examples of the photo polymerization initiators include, but are not limited to, acetophenone based or ketal based photo polymerization initiators, for example, diethoxy acetophenone, 2,2-dimethoxy-1,2-diphenylethane-1-one, 1-hydroxy cyclohexyl phenylketone, 4-(2-hydroxyethoxy) phenyl-(2-hydroxy-2-propyl)ketone, 2-benzyl-2-dimethylamino-1-(4-morpholinophenyl)butanone-1,2-hydroxy-2-methyl-1-phenylpropane-1-one, 2-methyl-2-morpholino(4-methylthiophenyl)propane-1-one, and 1-phenyl-1,2-propane dione-2-(o-ethoxycarbonyl)oxime; benzoin ether based photo polymerization initiators, for example, benzoine, benzoine methyl ether, benzoin ethyl ether, benzoine isobutyl ether and benzoine isopropyl ether; benzophenone based photo polymerization initiators, for example, benzophenone, 4-hydroxy benzophenone, o-benzoyl benzoic acid methyl, 2-benzoyl naphthalene, 4-benzoyl biphenyl, 4-benzoyl phenyl ether, acrylated benzophenone and 1,4-benzoyl benzene; and thioxanthone based photo polymerization initiators, for example, 2-isopropyl thioxanthone, 2-chloro thioxanthone, 2,4-dimethyl thioxanthone, 2,4-diethyl thioxanthone, and 2,4-dichloro thioxanthone.

Other photo polymerization initiators are, for example, ethylanthraquinone, 2,4,6-trimethyl benzoyl diphenyl phosphine oxide, 2,4,6-trimethyl benzoyl phenyl ethoxy phosphine oxide, bis(2,4,6-trimethyl benzoyl)phenyl phosphine oxide, bis(2,4-dimethoxy benzoyl)-2,4,4-trimethyl pentyl phosphine oxide, methylphenyl glyoxy esters, 9,10-phenanthrene, acridine based compounds, triadine based compounds, and imidazole based compounds.

In addition, compounds having photo polymerization promotion effect can be used alone or in combination with the photo polymerization initiators mentioned above. Specific examples thereof include, but are not limited to, triethanol amine, methyldiethanol amine, 4-dimethylamino ethyl benzoate, 4-dimethylamino isoamile benzoate, benzoic acid (2-dimethylamino)ethyl, and 4,4'-dimethylamino benzophenone.

These polymerization initiators can be used alone or in combination. The addition amount of the polymerization initiator is from 0.5 to 40 parts by weight and preferably from 1 to 20 parts by weight based on 100 parts by weight of the total weight of the radical polymerizable compound.

The surface protective layer for use in the present invention is formed by simultaneously curing at least a monomer having at least three radical polymerizable functional groups without a charge transport structure and a monomer having a radical polymerizable functional group with a charge transport structure. In addition, it is possible to contain filler particulates therein for improving the ant-abrasion property.

It is preferred that such a filler has an average primary particle diameter of from 0.01 to 0.5 μm in terms of light transmission and anti-abrasion property. An average primary particle diameter that is excessively small degrades the dispersion so that the effect of improvement of anti-abrasion property is not sufficient. An average primary particle diameter that is excessively large easily accelerates the sedimentation property of the filler in a liquid dispersion or causes filming of toner. The higher the material density of a filler in a surface layer, the higher the anti-abrasion performance thereof. However, anti-abrasion property that is excessively good may lead to side effects such that the residual voltage increases or writing light transmission of a surface layer decreases. Thus, the density of a filler is generally about not greater than 50% by weight and preferably about not 30% by weight based on the total weight of the solid portion.

In addition, these fillers can be subject to surface treatment by using at least one kind of surface active agents. Actually, it is preferred to conduct surface treatment to a filler in light of dispersion property thereof. This is because deterioration of the dispersion property of a filler causes deterioration of transparency of a coated layer, occurrence of layer deficiency and degradation of the anti-abrasion property in addition to a rise in the residual voltage, which may develops into large problems which prevent improvement on the durability and the quality of an image. Typical surface active agents can be used as such surface active agents, and a surface active agent that can maintain the insulation property of a filler is preferred.

The content of a surface active agent, which varies depending on the average primary particle diameter of a filler, is suitable from 3 to 30% by weight and preferably from 5 to 20% by weight based on the weight of the filler. When surface treatment is insufficient, the effect of dispersing a filler is not obtained. When surface treatment is excessive, the residual voltage significantly rises. These fillers are used alone or in combination.

Furthermore, the liquid application of the cross-linking surface protective layer for use in the present invention optionally contains various kinds of additives such as plasticizing agents for relaxing internal stress and improving adhesiveness or leveling agents. Known additives can be used and specific examples of such plasticizing agents include, but are not limited to, dibutyl phthalate, dioctyl phthalate, etc, which are used for a typical resin. The content thereof is not greater than 20% by weight and preferably not greater than 10% by weight based on the total weight of solid portion of a liquid application. As the leveling agents, it is possible to use silicone oils such as dimethyl silicone oil and methylphenyl silicone oil, or a polymer or oligomer having a perfluoroalkyl group in its side chain. The content thereof is not greater than 3% by weight based on the total weight of the solid portion of a liquid application.

With regard to the composition contained in a liquid application of a surface protective layer, it is possible to contain a binder resin therein as long as the binder resin does not degrade the smoothness, electric characteristics and/or durability of the surface of an image bearing member. However, when a polymer material such as a binder resin in a liquid application, phase separation occurs because of poor compatibility between the polymer material and a polymer produced from the curing reaction of a radical polymerizable compound (a radical polymerizable monomer and a radical polymerizable compound having a charge transport structure). Thus, the surface of the obtained surface protective layer is rough. As a result, it is preferred to avoid using a binder resin.

The surface protective layer for use in the present invention for use in the present invention is formed by coating and curing a liquid application containing at least a monomer having at least three radical polymerizable functional groups without having a charge transport structure and a radical polymerizable compound having a charge transport structure. When the monomer contained in a liquid application is liquid, it is possible to dissolve other components in the liquid application and coat the liquid application. A liquid application can be also diluted in a suitable solvent before coating, if desired. Specific examples of such solvents include, but are not limited to, an alcohol based solvent, such as methanol, ethanol, propanol and butanol; a ketone based solvent, such as acetone, methyl ethyl ketone, methyl isobutyl ketone, and cyclohexanone; an ester based solvent, such as ethyl acetate and butyl acetate; an ether based solution, such as tetrahydrofuran dioxane and propyl ether; a halogen based solvent, such as dichloromethane, dichloroethane, trichloroethane and chlorobenzene; an aromatic series based solvent, such as benzene, toluene and xylene; and a cellosolve based solvent, such as methyl cellosolve, ethyl cellosove and cellosolve acetate. These solvents can be used alone or in combination. The dilution ratio by these solvents depends on the solubility and the coating method of a composition, and a desired layer thickness. A dip coating method, a spray coating method, a beat coating method, a ring coating method, etc., can be used for coating the liquid application.

In the present invention, subsequent to the application of the liquid application, the cross-linked surface protective layer is formed upon curing by external energy, for example, heat, light and radiation. A method of applying heat energy can be used in which the cross-linked surface protective layer is heated from the application surface side or the substrate side using a gas, for example, air and nitrogen, vapor, or various kinds of heat media, infra-red radiation and electromagnetic waves. The heating temperature is preferably from 100° C. to 170° C. When the heating temperature is too low, the reaction speed is slow so that the curing reaction does not finish completely. When the heating temperature is too high, the curing reaction is not uniformly conducted. Thereby, the cross-linked surface layer is significantly distorted inside. To uniformly conduct the curing reaction, it is also effective to heat a cross-linked surface layer at a relatively low temperature, for example, lower than 100° C., followed by heating at a relatively high temperature, for example, higher than 100° C., to complete the curing reaction. As light energy, a UV irradiation light source, such as a high pressure mercury lamp or a metal halide lamp, having an emission wavelength mainly in the ultraviolet area can be used. A visible light source can be selected according to the absorption wavelength of a radical polymerizable compound and a photopolymerization initiator. The irradiation light amount is preferably from 50 mW/cm$^2$ to 1,000 mW/cm$^2$. When the irradiation light amount is too small, it takes a long time to complete the curing reaction. When the irradiation light amount is too large, the reaction is not uniformly conducted and the degree of roughness of the cross-linked surface layer increases. As radiation ray energy, electron beam can be used. Among these forms of energies, thermal or light energy is suitably used in terms of easiness of reaction speed control and simplicity of a device.

Layer Structure of Image Bearing Member

The present invention is described below based on its layer structure.

FIG. 1 is a cross section illustrating an example of the image bearing member of the present invention. The image bearing member has an laminate structure in which a charge generation layer 35 having a charge generation function, a charge transport layer 37 having a charge transport function, a cross-linking surface protective layer 39 are accumulated on an electroconductive substrate 31. As described above, it is also possible to provide a single or more undercoating layers 33 on the electroconductive substrate 31.

Electroconductive Substrate

Materials having a volume resistance of not greater than $10^{10}$ Ω·cm can be used as a material for the substrate 31. For example, there can be used plastic or paper having a film form or cylindrical form covered with a metal, such as aluminum, nickel, chrome, nichrome, copper, gold, silver, and platinum, or a metal oxide, such as tin oxide and indium oxide by depositing or sputtering. Also a board formed of aluminum, an aluminum alloy, nickel, and a stainless metal can be used. Further, a tube which is manufactured from the board mentioned above by a crafting technique, for example, extruding and extracting, and surface-treatment, such as cutting, super finishing and grinding, is also usable. In addition, an endless nickel belt and an endless stainless belt described in JOP S52-36016 can be used as the electroconductive substrate.

An electroconductive substrate can be also formed by applying to the substrate mentioned above a liquid application in which electroconductive powder is dispersed in a suitable binder resin and can be used as the electroconductive substrate for use in the present invention.

Specific examples of such electroconductive powders include, but are not limited to, carbon black, acetylene black, metal powder, such as powders of aluminum, nickel, iron, nichrome, copper, zinc and silver, and metal oxide powder, such as electroconductive tin oxide powder and ITO powder.

Specific examples of the binder resins which are used together with the electroconductive powder include, but are not limited to, thermoplastic resins, thermosetting resins, and optical curing resins, such as a polystyrene, a styrene-acrylonitrile copolymer, a styrene-butadiene copolymer, a styrene-anhydride maleic acid copolymer, a polyester, a polyvinyl chloride, a vinyl chloride-vinyl acetate copolymer, a polyvinyl acetate, a polyvinylidene chloride, a polyarylate (PAR) resin, a phenoxy resin, polycarbonate, a cellulose acetate resin, an ethyl cellulose resin, a polyvinyl butyral, a polyvinyl formal, a polyvinyl toluene, a poly-N-vinyl carbazole, an acrylic resin, a silicone resin, an epoxy resin, a melamine resin, an urethane resin, a phenol resin, and an alkyd resin. Such an electroconductive layer can be formed by dispersing the electroconductive powder and the binder resins mentioned above in a suitable solvent, for example, tetrahydrofuran (THF), dichloromethane (MDC), methyl ethyl ketone (MEK), and toluene and applying the resultant to an electroconductive substrate.

In addition, an electroconductive substrate formed by providing a heat contraction tube as an electroconductive layer on a suitable cylindrical substrate can be used as the electroconductive substrate in the present invention. The heat contraction tube can be formed of a material, such as polyvinyl chloride, polypropylene, polyester, polystyrene, polyvinylidene chloride, polyethylene, chloride rubber, and TEFLON® in which the electroconductive powder mentioned above is contained.

Charge Generation Layer

The charge generation layer 35 is a layer mainly formed of a charge generation material having a charge generation function. A binder resin can be used in combination, if desired. Any known charge generation material can be used for the charge generation layer 35. Specific examples thereof include, but are not limited thereto, phthalocyanine based pigments, such as metal phthalocyanine and non-metal phthalocyanine, azulenium salt pigments, methine squaric acid pigments, azo pigments having carbazole skeleton, azo pigments having triphenyl amine skeleton, azo pigments having dibenzothiophene skeleton, azo pigments having fluorenone skeleton, azo pigments having oxadiazole skeleton, azo pigments having bisstilbene skeleton, azo pigments having distyryl oxadiazole skeleton, azo pigments having distyryl carbazole skeleton, perylene based pigments, anthraquinone based or polycyclic quinone based pigments, quinone imine pigments, diphenyl methane based pigments, triphenyl methane based pigments, benzoquinone based pigments, naphthoquinone based pigments, cyanine based pigments, azomethine based pigments, indigoid based pigments, and bisbenzimidazole pigments. These charge generating materials can be used alone or in combination.

Furthermore, in the present invention, among these charge generation materials mentioned above, titanyl phthalocyanine pigment represented by the following Chemical formula 17 as one of the titanyl phthalocyanine pigments is especially preferred because the titanyl phthalocyanine pigment is highly sensitive and maintains excellent characteristics for repetitive use over an extended period of time.

Chemical formula 17

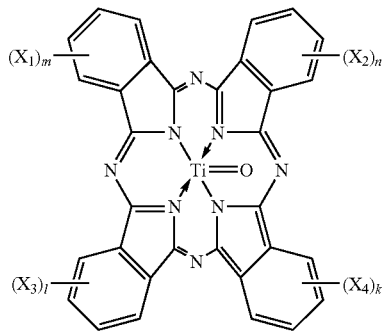

In Chemical formula 17, $X_1$, $X_2$, $X_3$ and $X_4$ independently represent a halogen atom and n, m, l and k independently represent an integer of from 0 to 4.

In addition, among the titanyl phthalocyanine pigments, titanyl phthalocyanine crystal having a crystal type having a diffraction spectrum such that a maximum diffraction peak is observed at a Bragg (2θ) angle of 27.2°, main peaks at a Bragg (2θ) angle of 9.4°, 9.6°, and 24.0°, and a peak at a Bragg (2θ) angle of 7.3° as the lowest angle diffraction peak, and having no peak between 9.4° and 7.3° and no peak at 26.3° is suitably used as the charge generation material for use in the image bearing member of the present invention since the titanyl phthalocyanine crystal is especially sensitive and maintains excellent characteristics that no abnormal images are produced in repetitive use for an extended period of time.

Furthermore, it is preferred to mix a bisazo pigment with the titanyl phthalocyanine pigment mentioned above. Especially, a mixture of the azo pigment represented by the following chemical formula 18 with the titanyl phthalocyanine is confirmed to have excellent characteristics that no abnormal images are produced for repetitive use over a more extended period of time and thus can be suitably used as the charge generation material for use in the image bearing member of the present invention.

Chemical formula 18

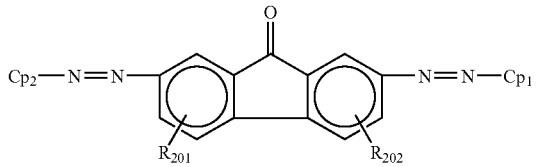

In Chemical formula 18, $Cp_1$ and $Cp_2$ represent coupler residual groups, $R_{201}$ and $R_{202}$ independently represent a hydrogen atom, a halogen atom, or an alkyl group, an alkoxy group or cyano group having a carbon chain number of from 1 to 4. $Cp_1$ and $Cp_2$ are represented by the following chemical formula 19.

Chemical formula 19

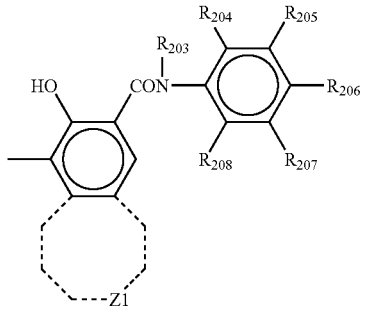

In Chemical formula 19, $R_{203}$ represents hydrogen atom, an alkyl group such as methyl group, ethyl group, or a phenyl group such as aryl group, $R_{204}$, $R_{205}$, $R_{206}$, $R_{207}$ and $R_{208}$ independently represent a hydrogen atom, nitro group, cyano group, a halogen atom such as fluorine atom, chlorine atom, bromine atom and iodine atom, an alkyl group such as trifluoromethyl group, methyl group, ethyl group, an alkoxy group such as methoxy group and ethoxy group, dialkyl amino group and hydroxyl group, and Z1 represents an atomic group required to form a substituted or non-substituted aromatic carbon ring or a substituted or non-substituted aromatic heterocyclic ring.

Specific examples of the optional binder resins for use in the charge generation layer include, but are not limited to, polyamides, polyurethanes, epoxy resins, polyketones, polycarbonates, silicone resins, acrylic resins, polyvinyl butyrals, polyvinyl formals, polyvinyl ketones, polystyrenes, poly-N-vinyl carbazoles and polyacrylamides. These can be used alone or in combination.

Specific examples of the optional binder resins for use in the charge generation layer include, but are not limited to, polyamides, polyurethanes, epoxy resins, polyketones, polycarbonates, silicone resins, acrylic resins, polyvinyl butyrals, polyvinyl formals, polyvinyl ketones, polystyrenes, poly-N-vinyl carbazoles and polyacrylamides. These can be used alone or in combination.

In addition to the binder resins mentioned above, charge transport polymers having a charge transport function can be used. For example, polymer materials such as polycarbonate resins polyester resins, polyurethane resins, polyether resins, polysiloxane resins and acryl resins having an arylamine skeleton, a benzidine skeleton, a hydrazone skeleton, a carbazole skeleton, a stilbene skeleton and/or a pyrazoline skeleton can be used. Also, polymer materials having a polysilane skeleton can be used.

Specific examples of the former charge transport polymers include, but are nor limited to, compounds described in JOPs H01-001728, H01-009964, H01-013061, H01-019049, H01-241559, H04-011627, H04-175337, H04-183719, H04-225014, H04-230767, H04-320420, H05-232727, H05-310904, H06-234836, H06-234837, H06-234838, H06-234839, H06-234840, H06-234840, H06-234841, H06-239049, H06-236050, H06-236051, H06-295077, H07-056374, H08-176293, H08-208820, H08-211640, H08-253568, H08-269183, H09-062019, H09043883, H09-71642, H09-87376, H09-104746, H09-110974, H09-110974, H09-110976, H09-157378, H09-221544, H09-227669, H09-221544, H09-227669, H09-235367, H09-241369, H09-268226, H09-272735, H09-272735, H09-302084, H09-302085 and H09-328539.

Specific examples of the latter charge transport polymers include, but are not limited to, polysiylene polymers described in JOPs S63-285552, H05-19497, H05-70595 and H10-73944.

The charge generation layer can contain a charge transport material having a low molecular weight.

There are two types of the charge transport materials which can be used for a charge generation layer. These are positive hole transport materials and electron transport materials.

Specific examples of such electron transport materials include, but are not limited to, electron acceptance materials such as chloranil, bromanil, tetracyano ethylene, tetracyanoquino dimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophene-4-one, 1,3,7-trinitrodibenzothhiophene-5,5-dioxide, and diphenoquinone derivatives.

These electron transport materials can be used alone or in combination.

Specific examples of such positive hole transport materials include, but are not limited to, oxazole derivatives, oxadiazole derivatives, imidazole derivatives, monoaryl amine derivatives, diaryl amine derivatives, triaryl amine derivatives, stilbene derivatives, α-phenyl stilbene derivatives, benzidine derivatives, diaryl methane derivatives, triaryl methane derivatives, 9-styryl anthracene derivatives, pyrazoline derivatives, divinyl benzene derivatives, hydrazone derivatives, indene derivatives, butadiene derivatives, pyrene derivatives, bisstilbene derivatives, enamine derivatives and other known materials. These positive hole transport materials can be used alone or in combination.

Specific examples of the vacuum thin layer manufacturing method include, but are not limited to, a vacuum deposition method, a glow discharging decomposition method, an ion plating method, a sputtering method, and a reactive sputtering method and a chemical vacuum deposition (CVD) method.

Both inorganic materials and organic materials can be used for forming a charge generation layer.

When a casting method is used, if desired, it is possible to form a charge generation layer by applying a suitably diluted liquid dispersion obtained by dispersing the inorganic material or the organic material mentioned above in a solvent together with a binder resin using a dispersion device. Specific examples of the solvent include, but are not limited to, tetrahydrofuran, dioxane, dioxolan, toluene, dichloromethane, monochlorobenzene, dichloroethane, cyclohexanone, cyclopentanone, anisole, xylene, methylethylketone, acetone, ethyl acetate and butyl acetate. Specific examples of the dispersing device include, but are not limited to, a ball mill, an attritor, a sand mill, and a bead mill. In addition, if desired, a leveling agent, for example, dimethyl silicone oil and methylphenyl silicone oil, can be added to the liquid dispersion mentioned above. Furthermore, the application mentioned above is performed by a dip coating method, a spray coating method, a bead coating method and a ring coating method.

In the present invention, the thickness of the charge transport layer is preferably from 0.01 to 5 μm and more preferably from 0.05 to 2 μm.

Charge Transport Layer

The charge transport layer 37 is a layer having a charge transport function. In the present invention, the charge transport layer 37 is provided between the charge generation layer 35 and the cross-linking surface protective layer 33.

In the present invention, the charge transport layer contains the compound represented by Chemical formula I, V, or VI as the charge transport material:

Chemical formula I

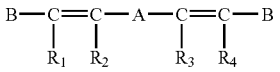

In Chemical formula I, $R_1$ to $R_4$ independently represent a hydrogen atom, an alkyl group having 1 to 4 carbon atoms, an alkoxy group having 1 to 4 carbon atoms, or a phenyl group which can be substituted by an alkyl group having 1 to 4 carbon atoms or an alkoxy group having 1 to 4 carbon atoms, A represents a substituted or non-substituted arylene group or a compound represented by chemical formula II:

Chemical formula II

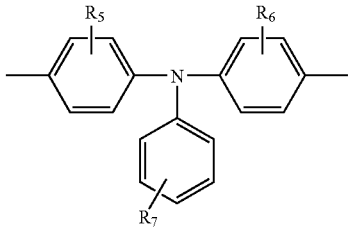

(In Chemical formula II, $R_5$, $R_6$ and $R_7$ independently represent a hydrogen atom, an alkyl group having 1 to 4 carbon atoms, an alkoxy group having 1 to 4 carbon atoms, or a phenyl group which can be substituted by an alkyl group having 1 to 4 carbon atoms or an alkoxy group having 1 to 4 carbon atoms), B represents a substituted or non-substituted aryl group or a compound represented by Chemical formula III:

Chemical formula III

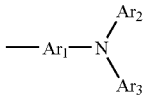

(In Chemical formula III, $Ar_1$ represents an arylene group which can be substituted by an alkyl group or alkoxy group having 1 to 4 carbon atoms. $Ar_2$ and $Ar_3$ independently represent an aryl group which can be substituted by an alkyl group or alkoxy group having 1 to 4 carbon atoms), and C represents a carbon atom.

Among these, the distyryl benzene derivative represented by Chemical formula IV, can especially avoid a phenomenon in which a residual image due to charges reversely charged remaining in the charge transport layer during transfer produces abnormal images.

Chemical formula IV

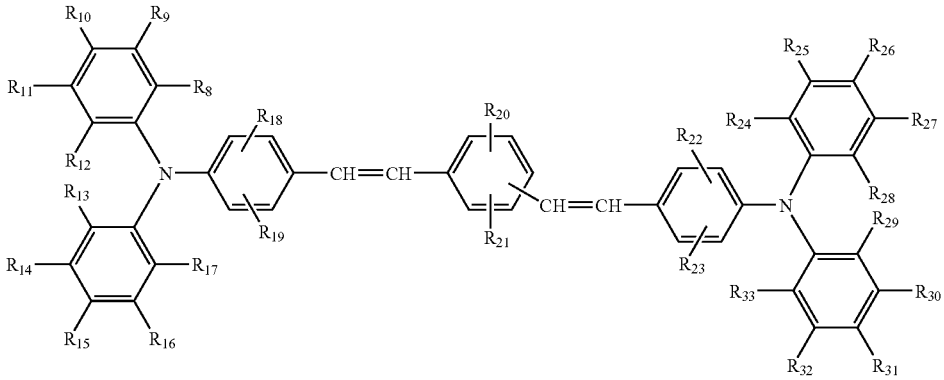

In Chemical formula IV, $R_8$ to $R_{33}$ independently represent a hydrogen atom, an alkyl group having 1 to 4 carbon atoms, an alkoxy group having 1 to 4 carbon atoms, or a substituted or non-substituted phenyl group.
Specific examples of the charge transport materials represented by Chemical formula I include, but are not limited to, the following:
No. 1
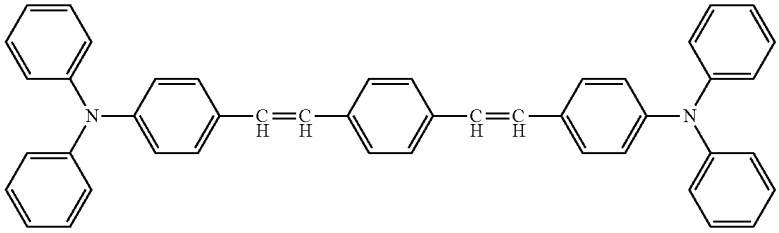
No. 2
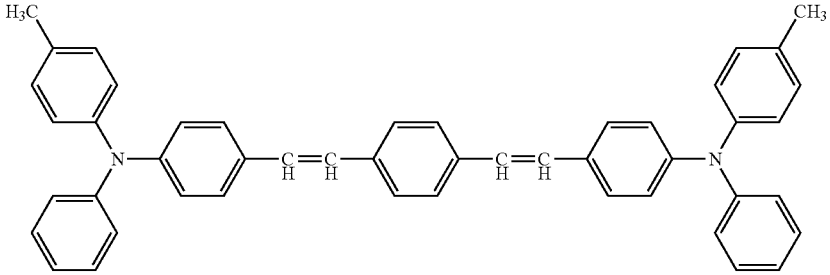
No. 3
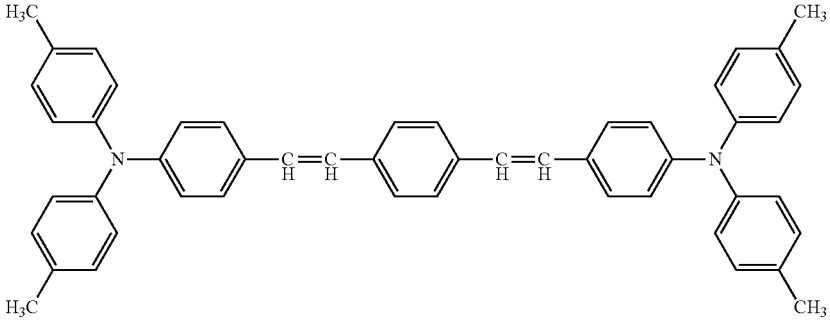
No. 4
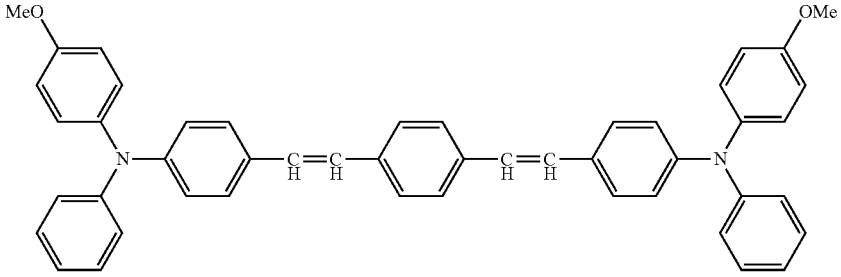
No. 5
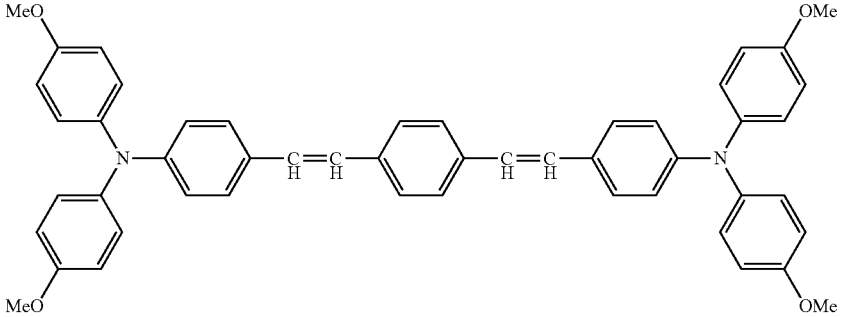

-continued
No. 6
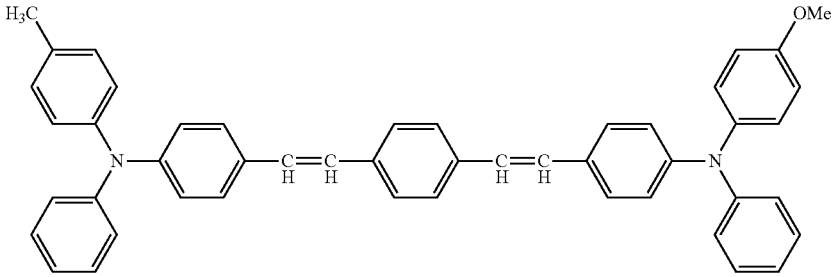
No. 7
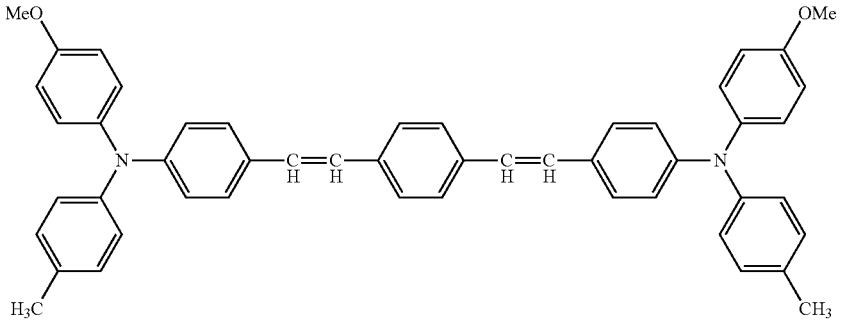
No. 8
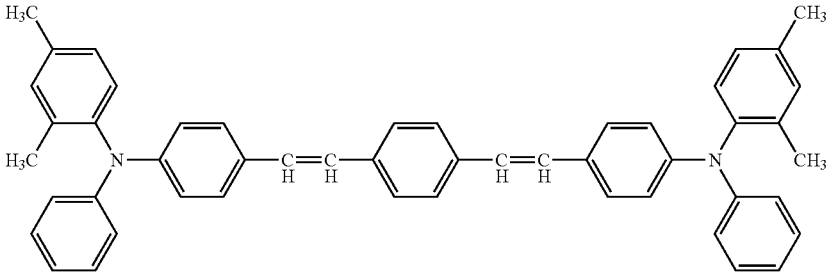
No. 9
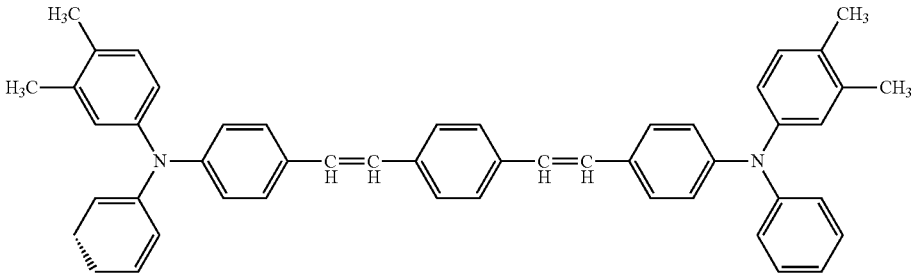
No. 10
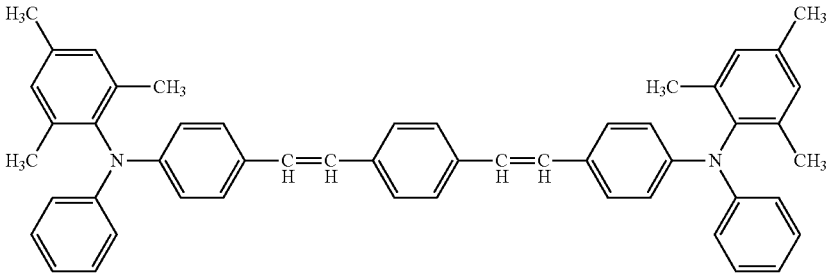

-continued
No. 11
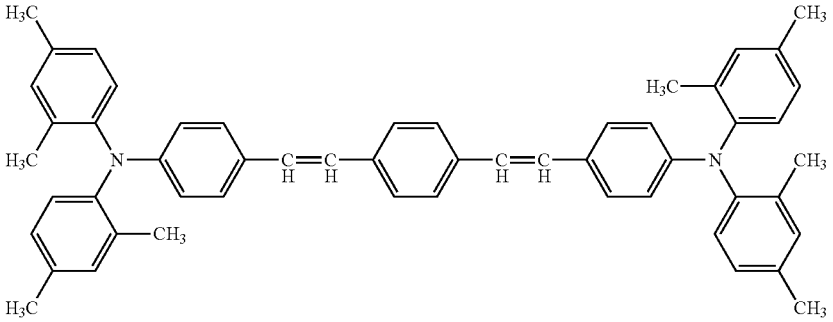
No. 12
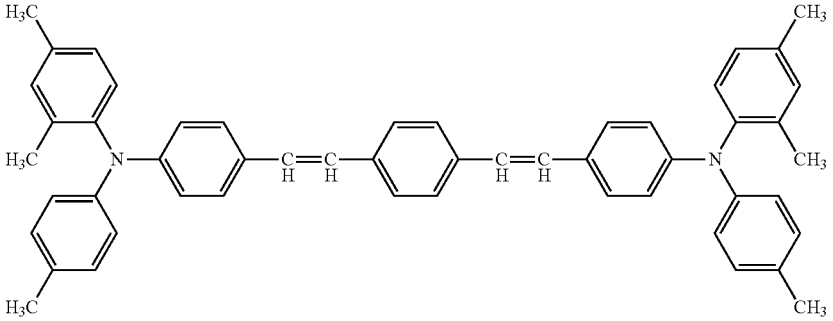
No. 13
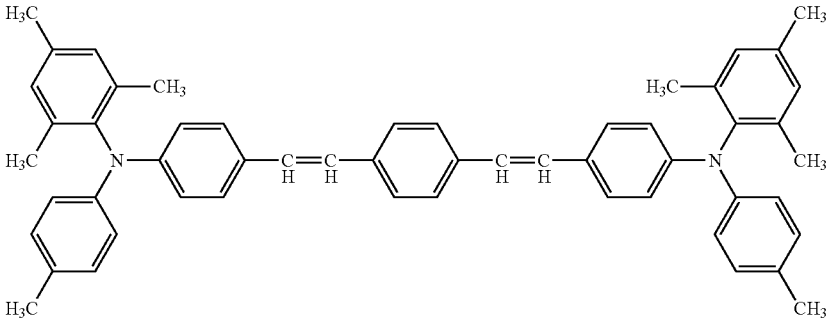
No. 14
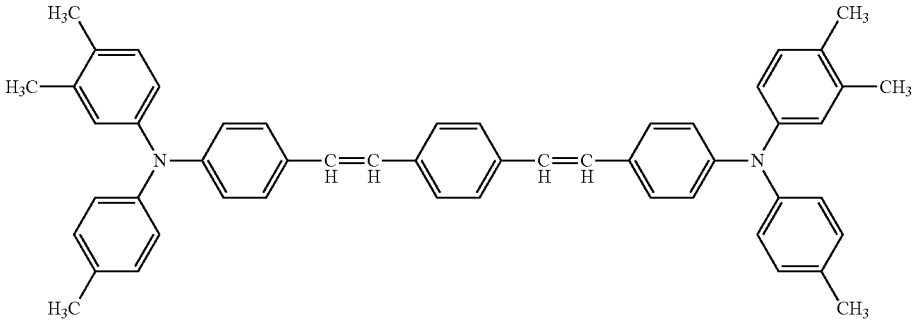
No. 15
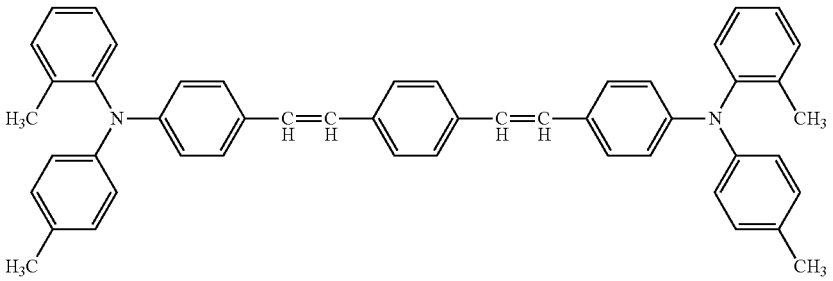

-continued
No. 16
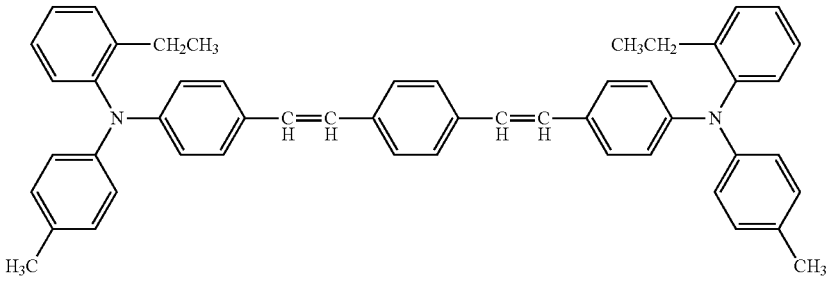
No. 17
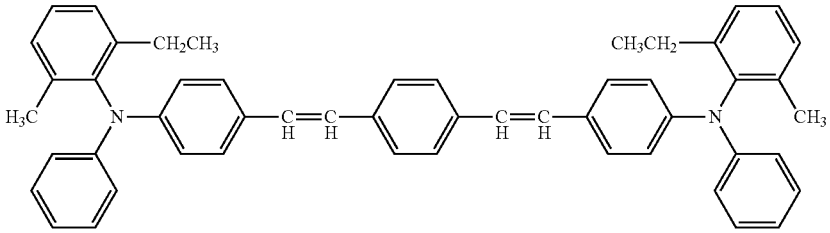
No. 18
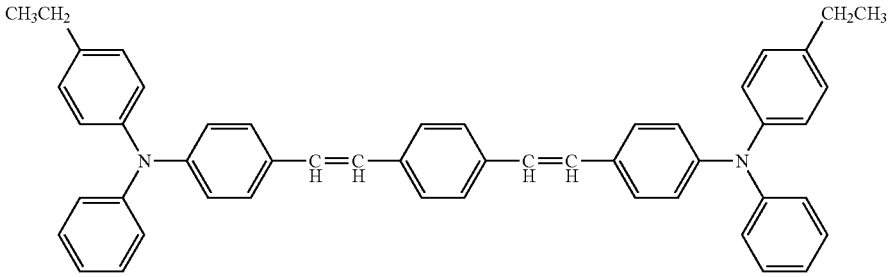
No. 19
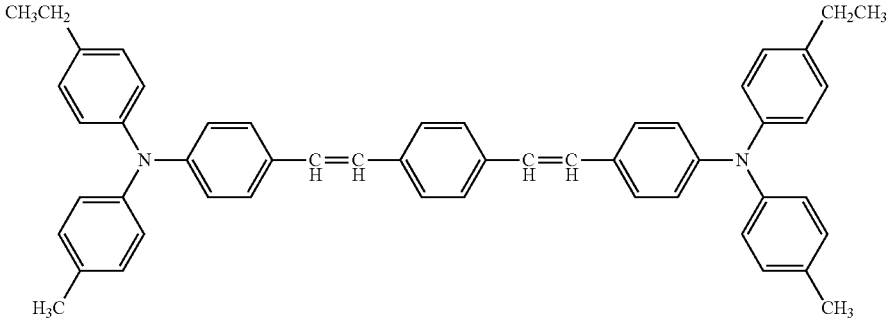
No. 20
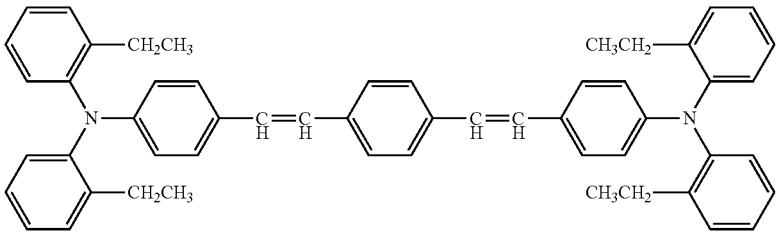

-continued
No. 21
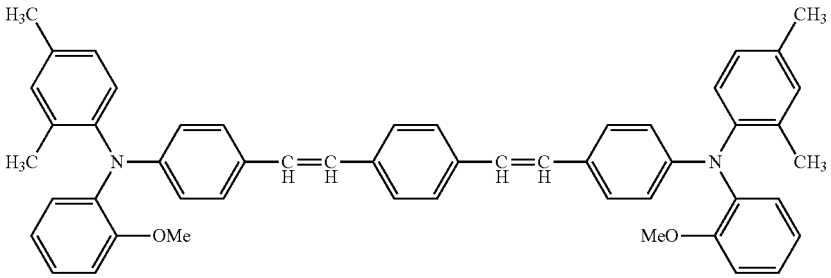
No. 22
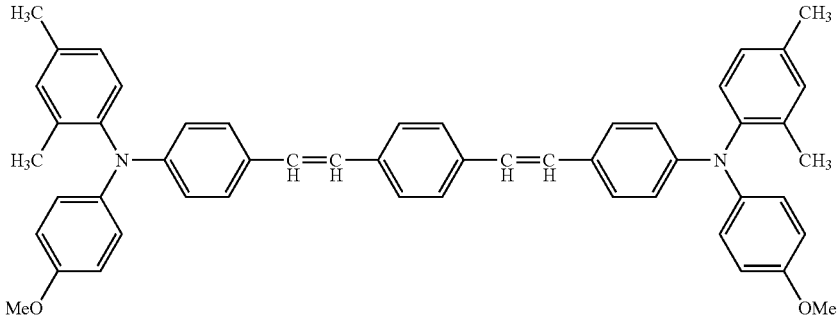
No. 23
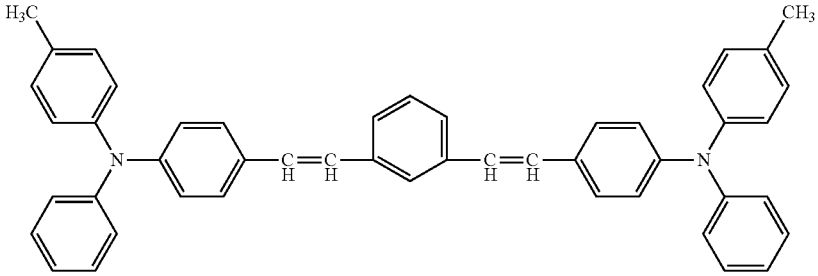
No. 24
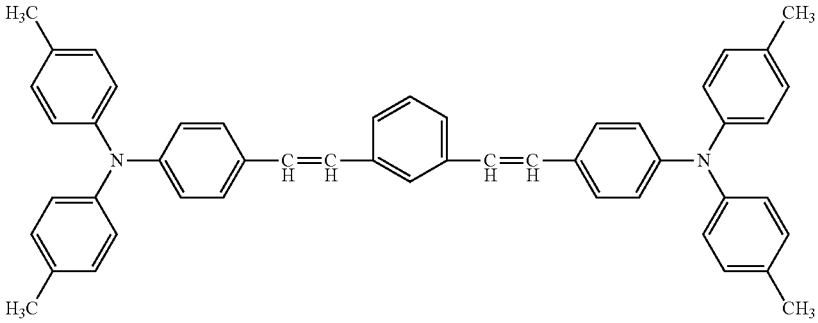
No. 25
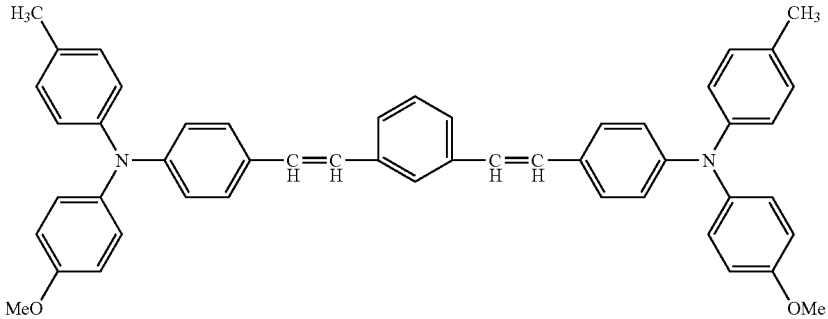

-continued
No. 26
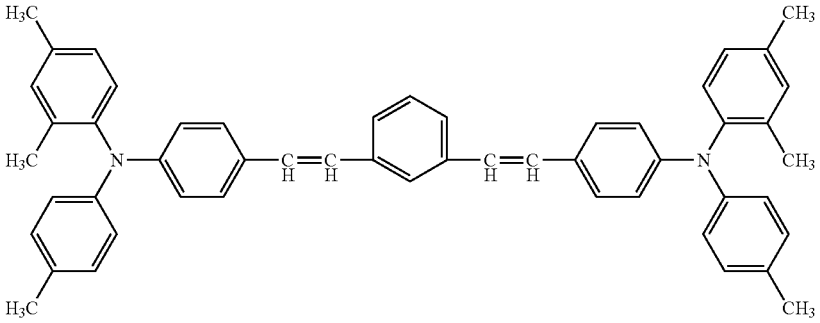
No. 27
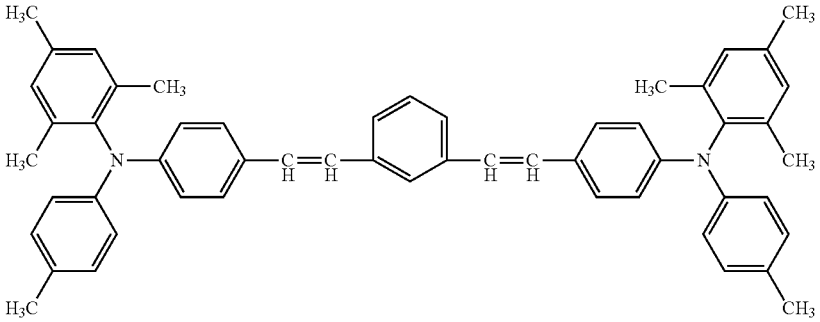
No. 28
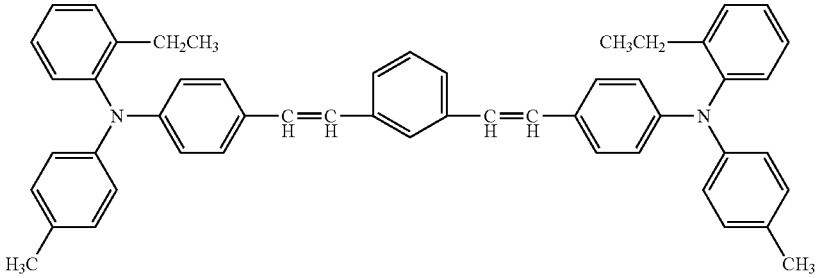
No. 29
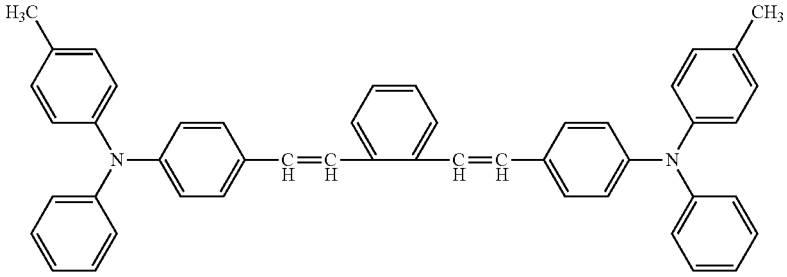
No. 30
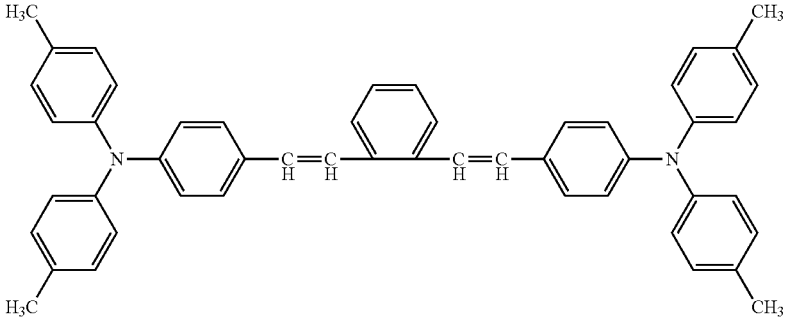

-continued
No. 31
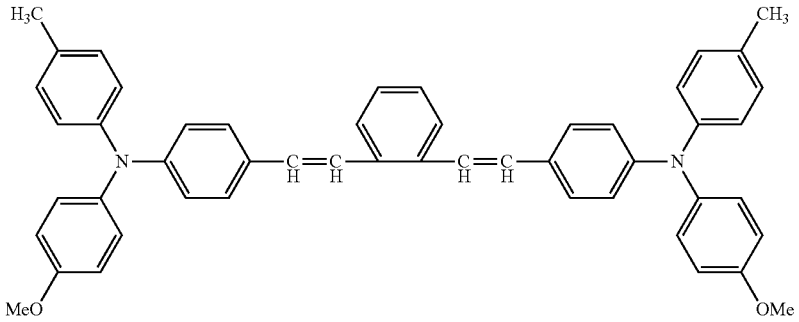
No. 32
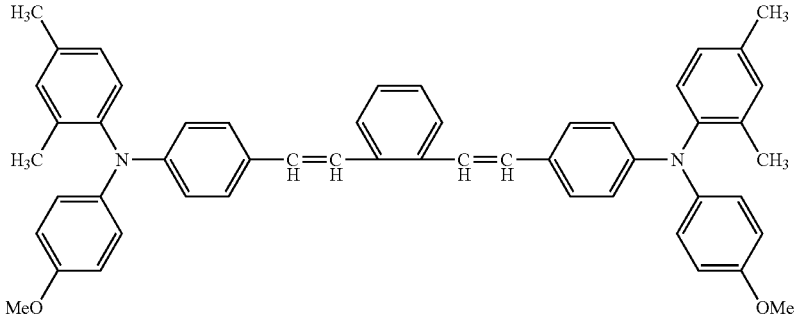
No. 33
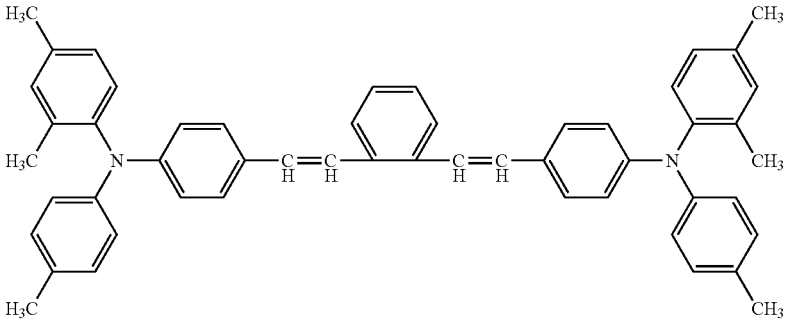
No. 34
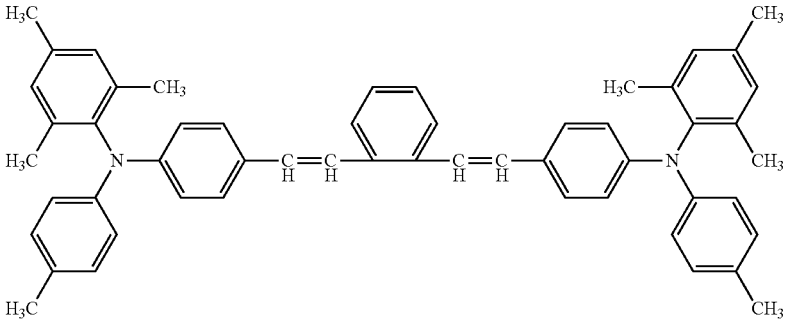
No. 35
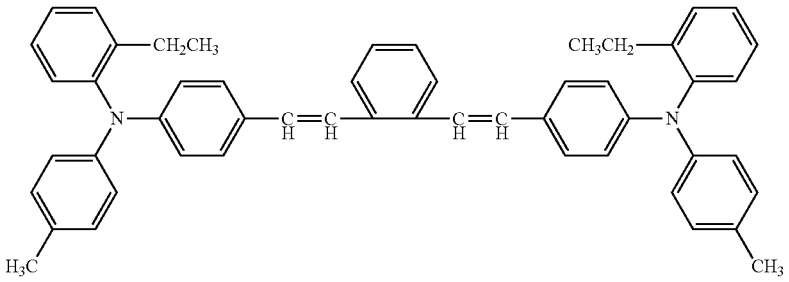

-continued
No. 36
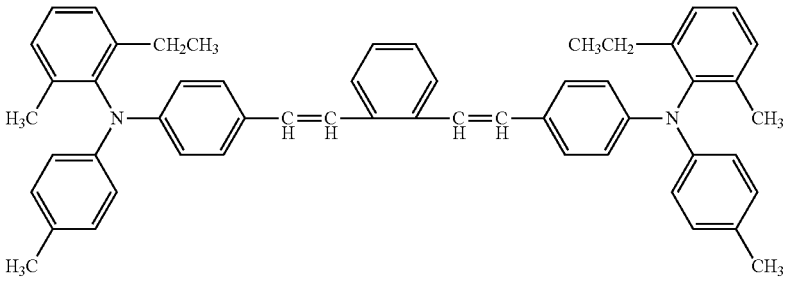
No. 37
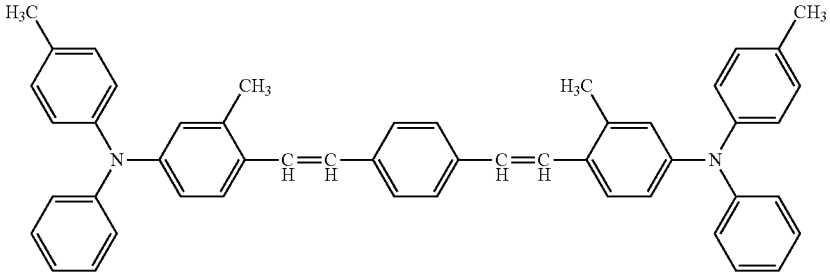
No. 38
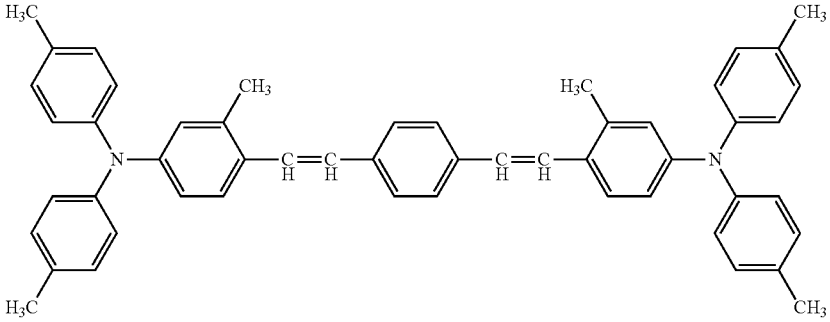
No. 39
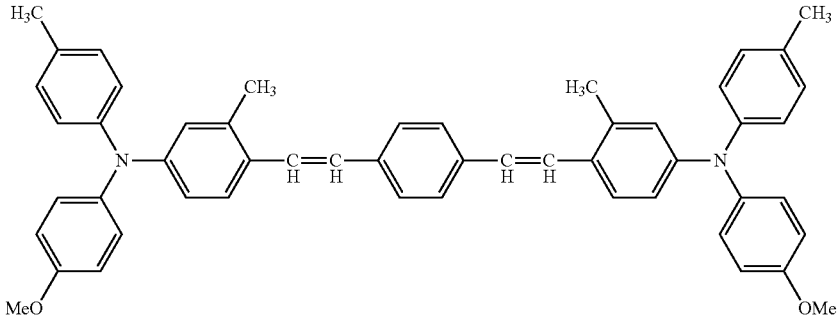
No. 40
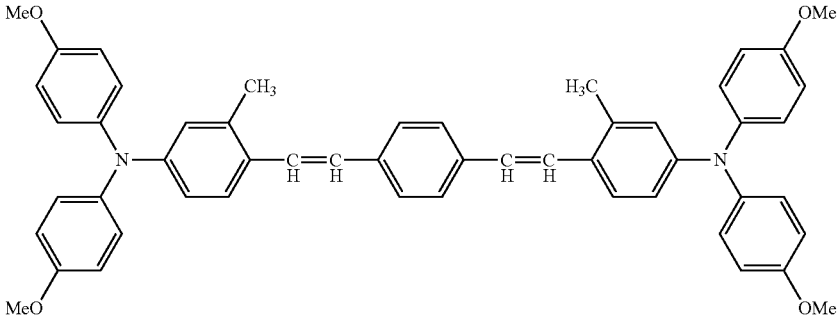

-continued
No. 51
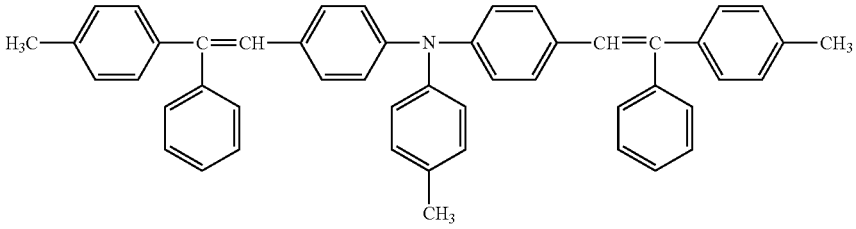
No. 52
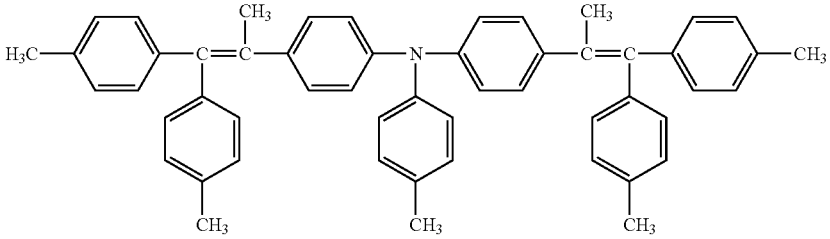
No. 53
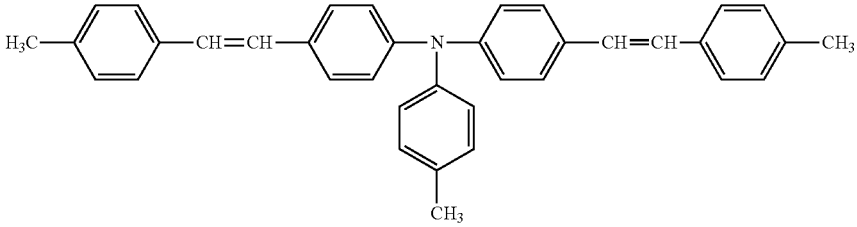
No. 54
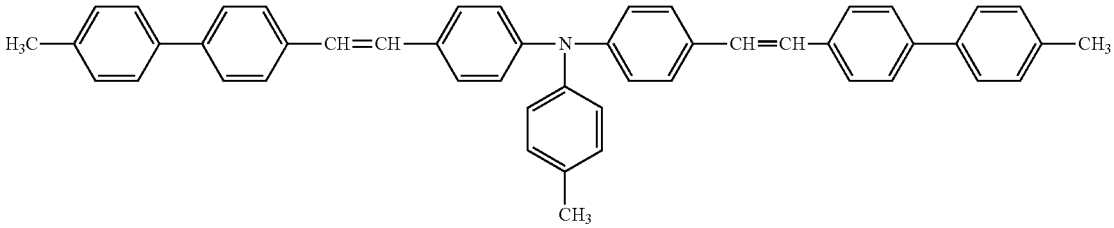
No. 55
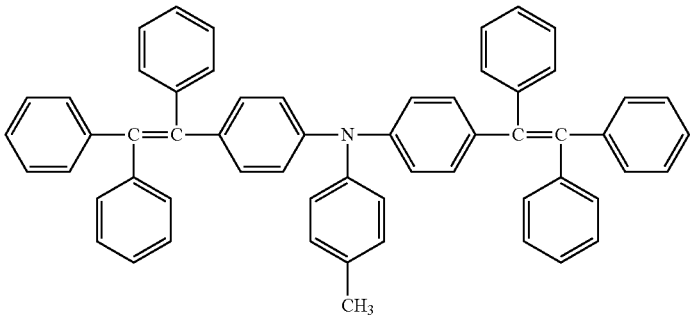

-continued

No. 56

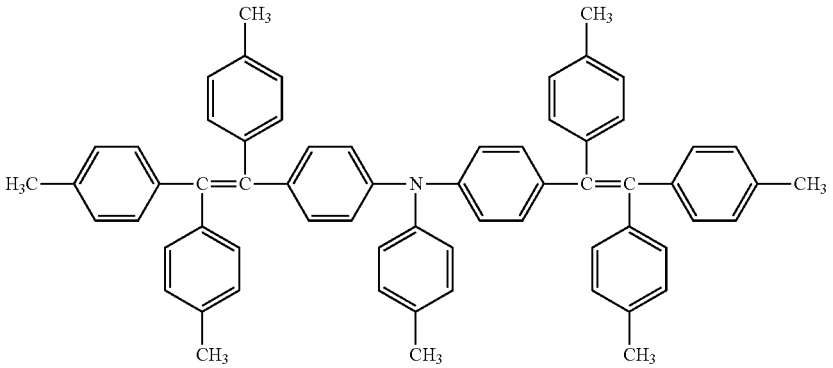

No. 57

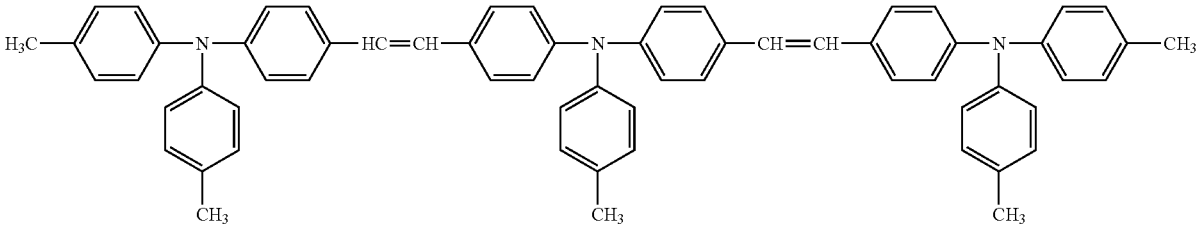

No. 58

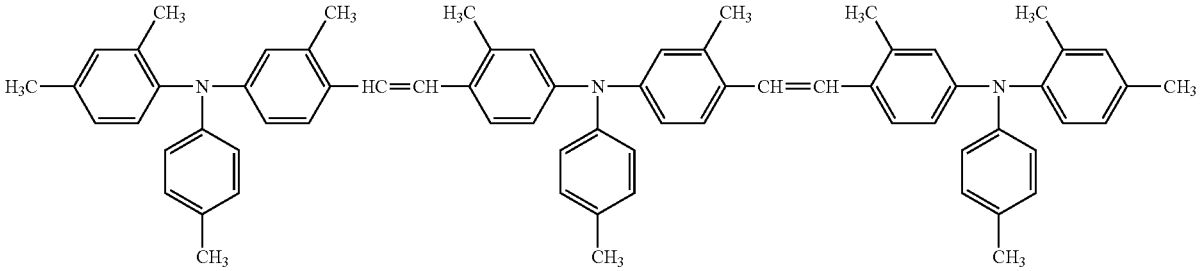

Chemical formula V

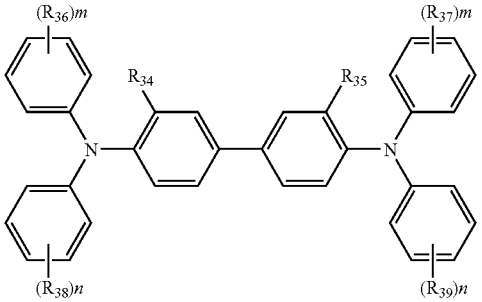

In Chemical formula V, $R_{34}$ and $R_{35}$ independently hydrogen atom, a halogen atom, an alkyl group, or an alkoxy group, $R_{36}$ to $R_{39}$ independently represents hydrogen atom, a halogen atom, an alkyl group, an alkoxy group or a dialkylamino group and m and n independently represents 1 or 2.

Specific examples of the combinations of $R_{34}$ to $R_{39}$ of the charge transport compound represented by the chemical formula V include, but are not limited to, the following shown in Table 1.

TABLE 1

| Compound No. | $R_{34}$, $R_{35}$ | $(R_{36})m$, $(R_{37})n$ | $(R_{38})m$, $(R_{39})n$ |
|---|---|---|---|
| BN-01 | $CH_3$ | H | H |
| BN-02 | $CH_3$ | 2-$CH_3$ | H |
| BN-03 | $CH_3$ | 3-$CH_3$ | H |
| BN-04 | $CH_3$ | 4-$CH_3$ | H |
| BN-05 | $CH_3$ | 4-$CH_3$ | 2-$CH_3$ |
| BN-06 | $CH_3$ | 4-$CH_3$ | 3-$CH_3$ |
| BN-07 | $CH_3$ | 4-$CH_3$ | 4-$CH_3$ |
| BN-08 | $CH_3$ | 3,4-$CH_3$ | H |
| BN-09 | $CH_3$ | 3,4-$CH_3$ | 3,4-$CH_3$ |

TABLE 1-continued

| Compound No. | $R_{34}$, $R_{35}$ | $(R_{36})m$, $(R_{37})n$ | $(R_{38})m$, $(R_{39})n$ |
|---|---|---|---|
| BN-10 | $CH_3$ | 4-$C_2H_5$ | H |
| BN-11 | $CH_3$ | 4-$C_3H_7$ | H |
| BN-12 | $CH_3$ | 4-$C_4H_9$ | H |
| BN-13 | $CH_3$ | 4-$C_2H_5$ | 2-$CH_3$ |
| BN-14 | $CH_3$ | 4-$C_2H_5$ | 3-$CH_3$ |
| BN-15 | $CH_3$ | 4-$C_2H_5$ | 4-$CH_3$ |
| BN-16 | $CH_3$ | 4-$C_2H_5$ | 3,4-$CH_3$ |
| BN-17 | $CH_3$ | 4-$C_3H_7$ | 3-$CH_3$ |
| BN-18 | $CH_3$ | 4-$C_3H_7$ | 4-$CH_3$ |
| BN-19 | $CH_3$ | 4-$C_4H_9$ | 3-$CH_3$ |
| BN-20 | $CH_3$ | 4-$C_4H_9$ | 4-$CH_3$ |
| BN-21 | $CH_3$ | 4-$C_2H_5$ | 4-$C_2H_5$ |
| BN-22 | $CH_3$ | 4-$C_2H_5$ | 4-$OCH_3$ |
| BN-23 | $CH_3$ | 4-$C_3H_7$ | 4-$CH_3$ |
| BN-24 | $CH_3$ | 4-$C_3H_7$ | 4-$OCH_3$ |
| BN-25 | $CH_3$ | 4-$C_4H_9$ | 4-$C_4H_9$ |
| BN-26 | $CH_3$ | 4-$C_4H_9$ | 4-$OCH_3$ |
| BN-27 | H | 3-$CH_3$ | H |
| BN-28 | Cl | H | H |
| BN-29 | Cl | 2-$CH_3$ | H |
| BN-30 | Cl | 3-$CH_3$ | H |
| BN-31 | Cl | 4-$CH_3$ | H |
| BN-32 | Cl | 4-$CH_3$ | 2-$CH_3$ |
| BN-33 | Cl | 4-$CH_3$ | 3-$CH_3$ |
| BN-34 | Cl | 4-$CH_3$ | 4-$CH_3$ |
| BN-35 | $C_2H_5$ | H | H |
| BN-36 | $C_2H_5$ | 2-$CH_3$ | H |
| BN-37 | $C_2H_5$ | 3-$CH_3$ | H |
| BN-38 | $C_2H_5$ | 4-$CH_3$ | H |
| BN-39 | $C_2H_5$ | 4-$CH_3$ | 4-$CH_3$ |
| BN-40 | $C_2H_5$ | 4-$C_2H_5$ | 4-$CH_3$ |
| BN-41 | $C_2H_5$ | 4-$C_3H_7$ | 4-$CH_3$ |
| BN-42 | $C_2H_5$ | 4-$C_4H_9$ | 4-$CH_3$ |
| BN-43 | $OCH_3$ | H | H |
| BN-44 | $OCH_3$ | 2-$CH_3$ | H |
| BN-45 | $OCH_3$ | 3-$CH_3$ | H |
| BN-46 | $OCH_3$ | 4-$CH_3$ | H |
| BN-47 | $OCH_3$ | 4-$CH_3$ | 4-$CH_3$ |
| BN-48 | $OCH_3$ | 4-$C_2H_5$ | 4-$CH_3$ |
| BN-49 | $OCH_3$ | 4-$C_3H_7$ | 4-$CH_3$ |
| BN-50 | $OCH_3$ | 4-$C_4H_9$ | 4-$CH_3$ |
| BN-51 | $CH_3$ | 2-$N(CH_3)_2$ | H |
| BN-52 | $CH_3$ | 3-$N(CH_3)_2$ | H |
| BN-53 | $CH_3$ | 4-$N(CH_3)_2$ | H |
| BN-54 | $CH_3$ | 2-Cl | H |

Chemical formula VII

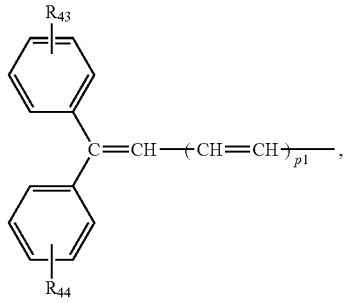

Chemical formula VIII

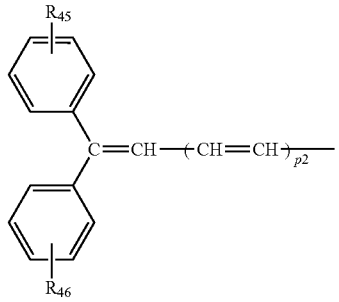

or

Chemical formula IX

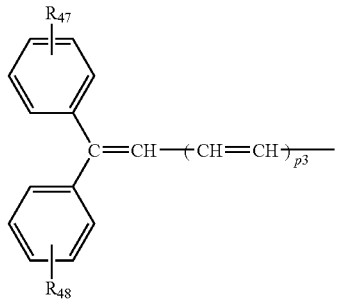

In the formulae, $R_{43}$ to $R_{46}$, P1 and P2 represent independently represent 0 or 1, $R_{47}$ and $R_{48}$ independently represent Chemical formula VI

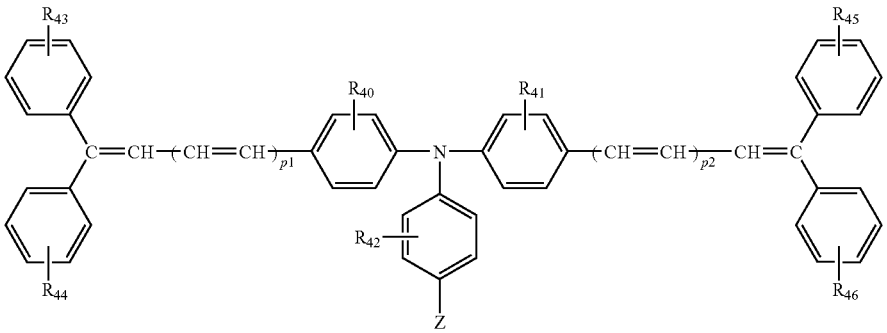

In the formula, $R_{41}$ to $R_{47}$ independently represent a hydrogen atom, a lower alkyl group, an alkoxy group, a phenoxy group, a halogen atom or a substituted or non-substituted aryl group. p1 and p2 independently represent 0 or 1. Z represents hydrogen atom, a lower alkyl group, an alkoxy group, a phenoxy group, a halogen atom, a substituted or non-substituted aryl group or a group represented by Chemical formula VII, Chemical formula VIII or Chemical formula IX:

a hydrogen atom, a lower alkyl group, an alkoxy group, a phenoxy group, a halogen atom, or a substituted or non-substituted aryl group, and p3 represents 0 or 1.

Specific examples of the combinations of $R_{41}$ to $R_{47}$, p1 and p2 of the charge transport compound represented by the chemical formula VI include, but are not limited to, the following shown in Table 2.

TABLE 2

| Compound No. | $R_{41}$ | $R_{42}$ | $R_{43}$ | $R_{44}$ | $R_{45}$ | $R_{46}$ | $R_{47}$ | P1 | P2 |
|---|---|---|---|---|---|---|---|---|---|
| BTA-01 | H | H | H | H | H | H | H | 0 | 0 |
| BTA-02 | H | H | H | 4-$CH_3$ | 4-$CH_3$ | 4-$CH_3$ | 4-$CH_3$ | 0 | 0 |
| BTA-03 | H | 3-$CH_3$ | H | H | H | 4-$CH_3$ | 4-$CH_3$ | 0 | 0 |
| BTA-04 | H | H | H | 4-$CH_3$ | H | 4-$CH_3$ | H | 0 | 0 |
| BTA-05 | H | H | H | 3-$CH_3$ | H | 3-$CH_3$ | H | 0 | 0 |
| BTA-06 | H | H | H | H | H | 4-Cl | 4-Cl | 0 | 0 |
| BTA-07 | H | H | 4-$CH_3$ | H | H | H | H | 0 | 0 |
| BTA-08 | H | H | 4-$CH_3$ | 4-$CH_3$ | 4-$CH_3$ | 4-$CH_3$ | 4-$CH_3$ | 0 | 0 |
| BTA-09 | 3-$CH_3$ | 3-$CH_3$ | 4-$CH_3$ | H | H | 4-$CH_3$ | 4-$CH_3$ | 0 | 0 |
| BTA-10 | H | H | 4-$CH_3$ | 4-$CH_3$ | H | 4-$CH_3$ | H | 0 | 0 |
| BTA-11 | H | H | 4-$CH_3$ | 3-$CH_3$ | H | 3-$CH_3$ | H | 0 | 0 |
| BTA-12 | H | H | 4-$CH_3$ | H | H | 4-Cl | 4-Cl | 0 | 0 |
| BTA-13 | H | H | 2-$CH_3$ | H | H | H | H | 0 | 0 |
| BTA-14 | H | H | 2-$CH_3$ | 4-$CH_3$ | 4-$CH_3$ | 4-$CH_3$ | 4-$CH_3$ | 0 | 0 |
| BTA-15 | H | H | 2-$CH_3$ | H | H | 4-$CH_3$ | 4-$CH_3$ | 0 | 0 |
| BTA-16 | H | H | 2-$CH_3$ | 4-$CH_3$ | H | 4-$CH_3$ | H | 0 | 0 |
| BTA-17 | H | 3-$OCH_3$ | 2-$CH_3$ | 3-$CH_3$ | H | 3-$CH_3$ | H | 0 | 0 |
| BTA-18 | H | H | 2-$CH_3$ | H | H | 4-Cl | 4-Cl | 0 | 0 |
| BTA-19 | H | H | 4-$CH_3$ | H | H | H | H | 0 | 0 |
| BTA-20 | H | H | 4-$CH_3$ | 4-$CH_3$ | 4-$CH_3$ | 4-$CH_3$ | 4-$CH_3$ | 0 | 0 |
| BTA-21 | H | H | 4-$CH_3$ | H | H | 4-$CH_3$ | 4-$CH_3$ | 0 | 0 |
| BTA-22 | H | H | 4-$CH_3$ | 4-$CH_3$ | H | 4-$CH_3$ | H | 0 | 0 |
| BTA-23 | H | H | 4-$CH_3$ | 3-$CH_3$ | H | 3-$CH_3$ | H | 0 | 0 |
| BTA-24 | H | H | 4-$CH_3$ | H | H | 4-Cl | 4-Cl | 0 | 0 |
| BTA-25 | H | H | 4-Br | 4-$CH_3$ | 4-$CH_3$ | 4-$CH_3$ | 4-$CH_3$ | 0 | 0 |
| BTA-26 | H | H | 4-Br | 4-$CH_3$ | H | 4-$CH_3$ | H | 0 | 0 |
| BTA-27 | H | H | 4-Br | 4-F | 4-F | 4-F | 4-F | 0 | 0 |
| BTA-28 | H | H | 4-Br | H | H | H | H | 0 | 0 |
| BTA-29 | H | H | H | H | H | H | H | 1 | 0 |
| BTA-30 | H | H | H | 4-$CH_3$ | 4-$CH_3$ | 4-$CH_3$ | 4-$CH_3$ | 1 | 0 |
| BTA-31 | H | H | H | H | H | 4-$CH_3$ | 4-$CH_3$ | 1 | 0 |
| BTA-32 | H | H | H | 4-$CH_3$ | H | 4-$CH_3$ | H | 1 | 0 |
| BTA-33 | H | H | H | 4-$CH_3$ | 4-$CH_3$ | H | H | 1 | 0 |
| BTA-34 | H | H | H | H | H | 4-Cl | 4-Cl | 1 | 0 |
| BTA-35 | H | H | 4-$CH_3$ | H | H | H | H | 1 | 0 |
| BTA-36 | H | H | 4-$CH_3$ | 4-$CH_3$ | 4-$CH_3$ | 4-$CH_3$ | 4-$CH_3$ | 1 | 0 |
| BTA-37 | 3-$CH_3$ | 3-$CH_3$ | 4-$CH_3$ | H | 4-$CH_3$ | 4-$CH_3$ | 4-$CH_3$ | 11 | 0 |
| BTA-38 | H | H | 4-$CH_3$ | 4-$CH_3$ | H | 4-$CH_3$ | H | 1 | 0 |
| BTA-39 | H | H | 4-$CH_3$ | 3-$CH_3$ | H | 3-$CH_3$ | H | 1 | 0 |
| BTA-40 | H | H | 4-$CH_3$ | H | H | 4-Cl | 4-Cl | 1 | 0 |
| BTA-41 | H | H | 2-$CH_3$ | H | H | H | H | 1 | 0 |
| BTA-42 | H | H | 2-$CH_3$ | 4-$CH_3$ | 4-$CH_3$ | 4-$CH_3$ | 4-$CH_3$ | 1 | 0 |
| BTA-43 | H | H | 2-$CH_3$ | H | H | 4-$CH_3$ | 4-$CH_3$ | 1 | 0 |
| BTA-44 | H | H | 2-$CH_3$ | 4-$CH_3$ | H | 4-$CH_3$ | H | 1 | 0 |
| BTA-45 | H | 3-$OCH_3$ | 2-$CH_3$ | 3-$CH_3$ | H | 3-$CH_3$ | H | 1 | 0 |
| BTA-46 | H | H | 2-$CH_3$ | H | H | 4-Cl | 4-Cl | 1 | 0 |
| BTA-47 | H | H | 4-$OCH_3$ | H | H | H | H | 1 | 0 |
| BTA-48 | H | H | 4-$OCH_3$ | 4-$CH_3$ | 4-$CH_3$ | 4-$CH_3$ | 4-$CH_3$ | 1 | 0 |
| BTA-49 | H | H | 4-$OCH_3$ | H | H | 4-$CH_3$ | 4-$CH_3$ | 1 | 0 |
| BTA-50 | H | H | 4-$OCH_3$ | 4-$CH_3$ | H | 4-$CH_3$ | H | 1 | 0 |
| BTA-51 | H | H | 4-$OCH_3$ | 3-$CH_3$ | H | 3-$CH_3$ | H | 1 | 0 |
| BTA-52 | H | H | 4-$OCH_3$ | H | H | 4-Cl | 4-Cl | 1 | 0 |
| BTA-53 | H | H | 4-Br | 4-$CH_3$ | 4-$CH_3$ | 4-$CH_3$ | 4-$CH_3$ | 1 | 0 |
| BTA-54 | H | H | 4-Br | 4-$CH_3$ | H | 4-$CH_3$ | H | 1 | 0 |
| BTA-55 | H | H | 4-Br | 4-F | 4-F | 4-F | 4-F | 1 | 0 |
| BTA-56 | H | H | 4-Br | H | H | H | H | 1 | 0 |
| BTA-57 | H | H | H | H | H | H | H | 1 | 1 |
| BTA-58 | H | H | H | 4-$CH_3$ | 4-$CH_3$ | 4-$CH_3$ | 4-$CH_3$ | 1 | 1 |
| BTA-59 | H | 3-$CH_3$ | H | H | H | 4-$CH_3$ | 4-$CH_3$ | 1 | 1 |
| BTA-60 | H | H | H | 4-$CH_3$ | H | 4-$CH_3$ | H | 1 | 1 |
| BTA-61 | H | H | H | 4-$CH_3$ | H | 3-$CH_3$ | H | 1 | 1 |
| BTA-62 | H | H | H | H | H | 4-Cl | 4-Cl | 1 | 1 |
| BTA-63 | H | H | 4-$CH_3$ | H | H | H | H | 1 | 1 |
| BTA-64 | H | H | 4-$CH_3$ | 4-$CH_3$ | 4-$CH_3$ | 4-$CH_3$ | 4-$CH_3$ | 1 | 1 |
| BTA-65 | 3-$CH_3$ | 3-$CH_3$ | 4-$CH_3$ | H | H | 4-$CH_3$ | 4-$CH_3$ | 1 | 1 |
| BTA-66 | H | H | 4-$CH_3$ | 4-$CH_3$ | H | 4-$CH_3$ | H | 1 | 1 |
| BTA-67 | H | H | 4-$CH_3$ | 3-$CH_3$ | H | 3-$CH_3$ | H | 1 | 1 |
| BTA-68 | H | H | 4-$CH_3$ | H | H | 4-Cl | 4-Cl | 1 | 1 |
| BTA-69 | H | H | 2-$CH_3$ | H | H | H | H | 1 | 1 |
| BTA-70 | H | H | 2-$CH_3$ | 4-$CH_3$ | 4-$CH_3$ | 4-$CH_3$ | 4-$CH_3$ | 1 | 1 |

TABLE 2-continued

| Compound No. | $R_{41}$ | $R_{42}$ | $R_{43}$ | $R_{44}$ | $R_{45}$ | $R_{46}$ | $R_{47}$ | P1 | P2 |
|---|---|---|---|---|---|---|---|---|---|
| BTA-71 | H | H | 2-$CH_3$ | H | H | 4-$CH_3$ | 4-$CH_3$ | 1 | 1 |
| BTA-72 | H | H | 2-$CH_3$ | 4-$CH_3$ | H | 4-$CH_3$ | H | 1 | 1 |
| BTA-73 | H | 3-$OCH_3$ | 2-$CH_3$ | 3-$CH_3$ | H | 3-$CH_3$ | H | 1 | 1 |
| BTA-74 | H | H | 2-$CH_3$ | H | H | 4-Cl | 4-Cl | 1 | 1 |
| BTA-75 | H | H | 4-$OCH_3$ | H | H | H | H | 1 | 1 |
| BTA-76 | H | H | 4-$OCH_3$ | 4-$CH_3$ | 4-$CH_3$ | 4-$CH_3$ | 4-$CH_3$ | 1 | 1 |
| BTA-77 | H | H | 4-$OCH_3$ | H | H | 4-$CH_3$ | 4-$CH_3$ | 1 | 1 |
| BTA-78 | H | H | 4-$OCH_3$ | 4-$CH_3$ | H | 4-$CH_3$ | H | 1 | 1 |
| BTA-79 | H | H | 4-$OCH_3$ | 3-$CH_3$ | H | 3-$CH_3$ | H | 1 | 1 |
| BTA-80 | H | H | 4-$OCH_3$ | H | H | 4-Cl | 4-Cl | 1 | 1 |
| BTA-81 | H | H | 4-Br | 4-$CH_3$ | 4-$CH_3$ | 4-$CH_3$ | 4-$CH_3$ | 1 | 1 |
| BTA-82 | H | H | 4-Br | 4-$CH_3$ | H | 4-$CH_3$ | H | 1 | 1 |
| BTA-83 | H | H | 4-Br | 4-F | 4-F | 4-F | 4-F | 1 | 1 |
| BTA-84 | H | H | 4-Br | H | H | H | H | 1 | 1 |

Furthermore, in the present invention, in addition to the compounds of Chemical formula I, V or VI, the compound represented by the chemical formula IV can be optionally contained in the charge transport layer to improve the effect of reducing the occurrence of abnormal images in repetitive use for an extended period of time.

Chemical formula X

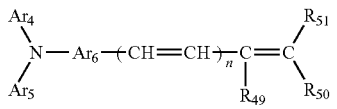

In Chemical formula X, $Ar_4$ and $Ar_5$ independently represent a substituted or non-substituted aryl group or a substituted or non-substituted heterocyclic ring, $R_{49}$, $R_{50}$ and $R_{51}$ independently represent hydrogen bond, a substituted or non-substituted alkyl group, a substituted or non-substituted alkoxy group, a substituted or non-substituted aryl group, or a substituted or non-substituted heterocyclic group, $R_{50}$ an $R_{51}$ optionally share bond connectivity to form a ring, $Ar_6$ represents a substituted or non-substituted arylene group and n represents 0 or 1.

Specific examples of the compound of Chemical formula X include, but not are limited to, the following (n=0) shown in Table 3:

TABLE 3
| | $Ar_4$ | $Ar_5$ | $Ar_6$ | $R_{49}$ | $R_{50}$ | $R_{51}$ |
|---|---|---|---|---|---|---|
| II-1 | 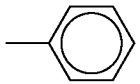 | 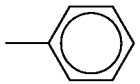 | 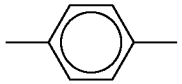 | —H | —H | 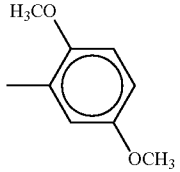  |
| II-2 | 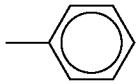 | 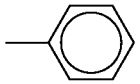 | 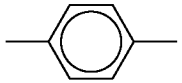 | —H | —H | 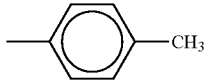  |
| II-3 | 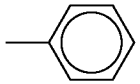 | 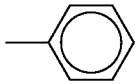 | 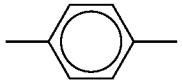 | —H | —H | 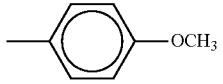  |
| II-4 | 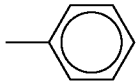 | 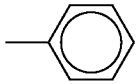 | 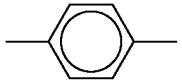 | —H | —H | 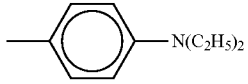  |
| II-5 | 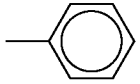 | 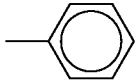 | 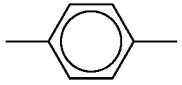 | —H | 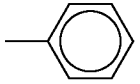 | 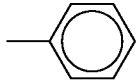 |
| II-6 | 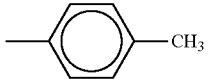  | 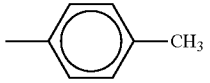  | 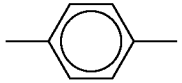 | —H | 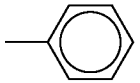 | 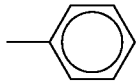 |
| II-7 | 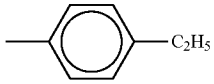  | 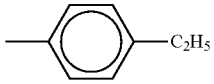  | 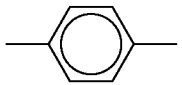 | —H | 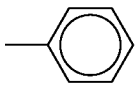 | 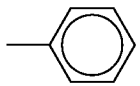 |
| II-8 | 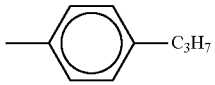  | 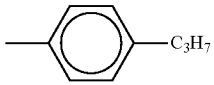  | 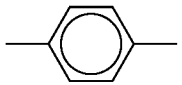 | —H | 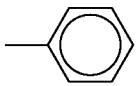 | 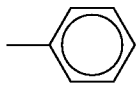 |
| II-9 | 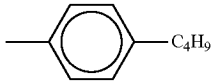  | 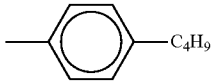  | 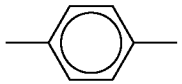 | —H | 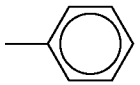 | 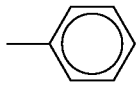 |

TABLE 3-continued
| | $Ar_4$ | $Ar_5$ | $Ar_6$ | $R_{49}$ | $R_{50}$ | $R_{51}$ |
|---|---|---|---|---|---|---|
| II-10 | 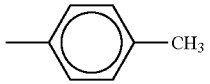 | 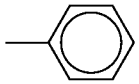 | 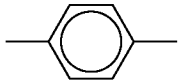 | —H | 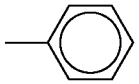 | 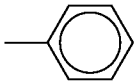 |
| II-11 | 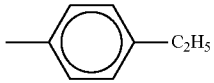 | 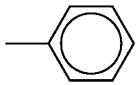 | 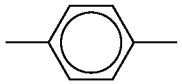 | —H | 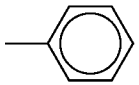 | 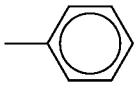 |
| II-12 | 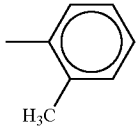 | 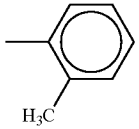 | 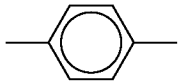 | —H | 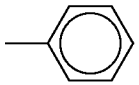 | 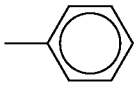 |
| II-13 | 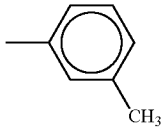 | 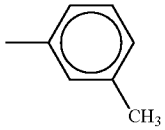 | 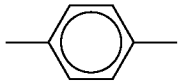 | —H | 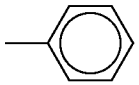 | 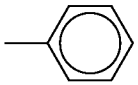 |
| II-14 | 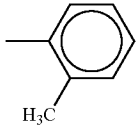 | 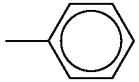 | 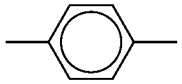 | —H | 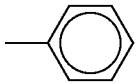 | 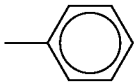 |
| II-15 | 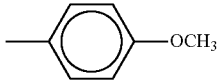 | 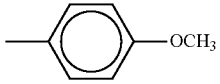 | 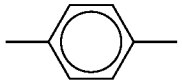 | —H | 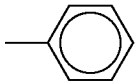 | 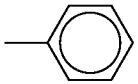 |
| II-16 | 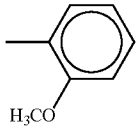 | 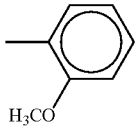 | 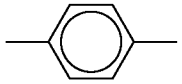 | —H | 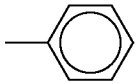 | 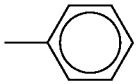 |
| II-17 | 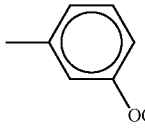 | 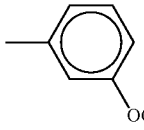 | 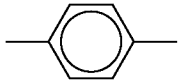 | —H | 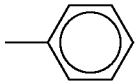 | 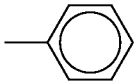 |

TABLE 3-continued

| | $Ar_4$ | $Ar_5$ | $Ar_6$ | $R_{49}$ | $R_{50}$ | $R_{51}$ |
|---|---|---|---|---|---|---|
| II-18 | —$OCH_3$ | | | —H | | |
| II-19 | —$OC_2H_5$ | | | —H | | |
| II-20 | —$CH_3$ | —$OCH_3$ | | —H | | |
| II-21 | —$CH_3$ | Cl | | —H | | |
| II-22 | —Cl | —Cl | | —H | | |
| II-23 | —$N(CH_3)_2$ | —$N(CH_3)_2$ | | —H | | |
| II-24 | —$N(C_2H_5)_2$ | —$N(C_2H_5)_2$ | | —H | | |
| II-25 | —$N(CH_3)_2$ | | | —H | | |
| II-26 | —$N(C_2H_5)_2$ | | | —H | | |
| II-27 | | | | —H | —H | —$CH_3$ |

TABLE 3-continued
| | $Ar_4$ | $Ar_5$ | $Ar_6$ | $R_{49}$ | $R_{50}$ | $R_{51}$ |
|---|---|---|---|---|---|---|
| II-28 | 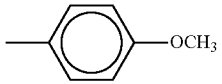 | 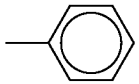 | 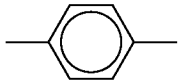 | —H | —H | 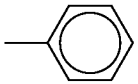 |
| II-29 | 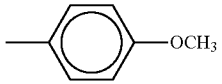 | 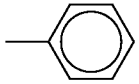 | 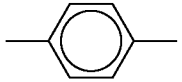 | —H | —H | 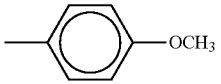 |
| II-30 | 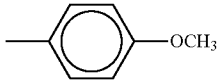 | 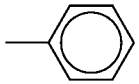 | 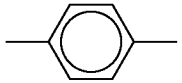 | —H | —H | 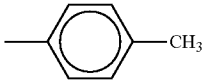 |
| II-31 | 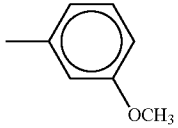 | 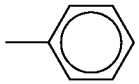 | 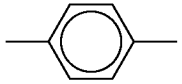 | —H | 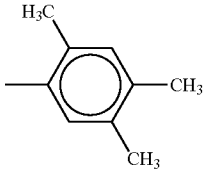 | 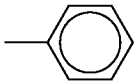 |
| II-32 | 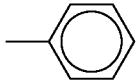 | 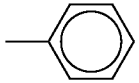 | 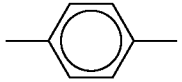 | —H | —H | 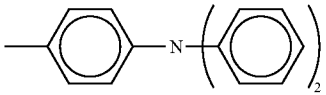 |
| II-33 | 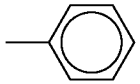 | 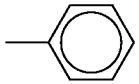 | 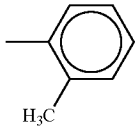 | —H | —H | 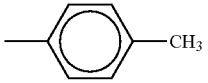 |
| II-34 | 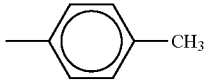 | 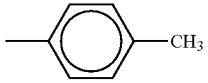 | 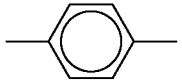 | —H | —H | 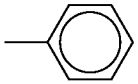 |
| II-35 | 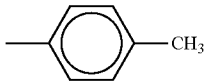 | 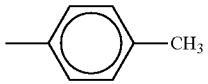 | 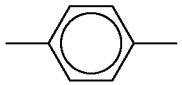 | —H | —H | 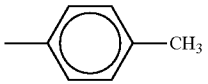 |

TABLE 3-continued
| | $Ar_4$ | $Ar_5$ | $Ar_6$ | $R_{49}$ | $R_{50}$ | $R_{51}$ |
|---|---|---|---|---|---|---|
| II-36 | 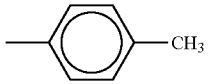 | 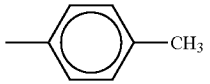 | 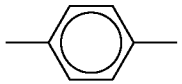 | —H | —H | 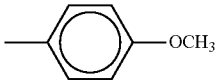 |
| II-37 | 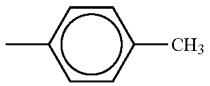 | 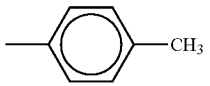 | 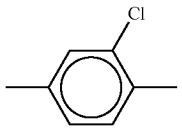 | —H | —H | 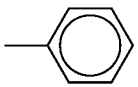 |
| II-38 | 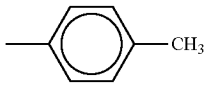 | 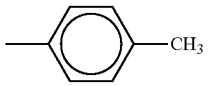 | 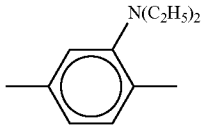 | —H | —H | 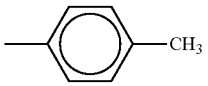 |
| II-39 | 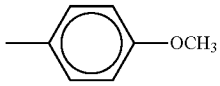 | 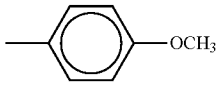 | 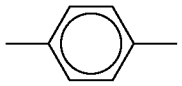 | —H | —H | 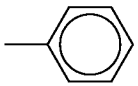 |
| II-40 | 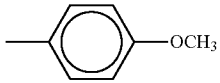 | 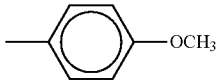 | 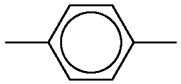 | —H | —H | 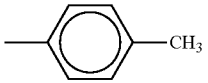 |
| II-41 | 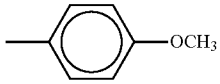 | 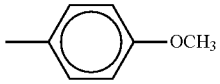 | 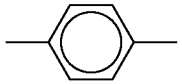 | —H | —H | 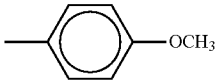 |
| II-42 | 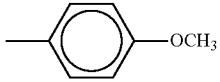 | 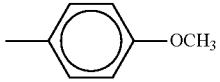 | 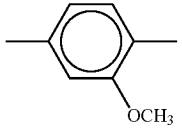 | —H | —H | 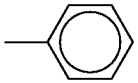 |
| II-43 | 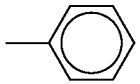 | 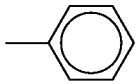 | 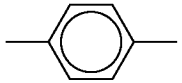 | —H | —H | 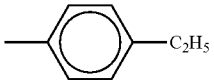 |
| II-44 | 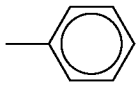 | 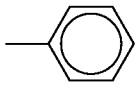 | 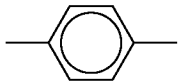 | —H | —H | 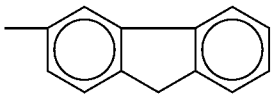 |

TABLE 3-continued
| | $Ar_4$ | $Ar_5$ | $Ar_6$ | $R_{49}$ | $R_{50}$ | $R_{51}$ |
|---|---|---|---|---|---|---|
| II-45 | 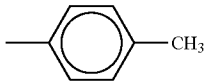 | 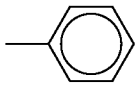 | 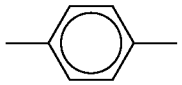 | —H | —H | 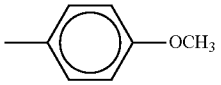 |
| II-46 | 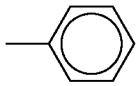 | 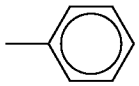 | 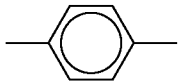 | —H | —H | 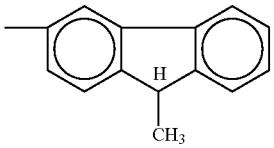 |
| II-47 | 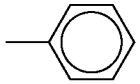 | 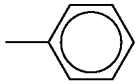 | 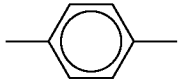 | —H | —H | 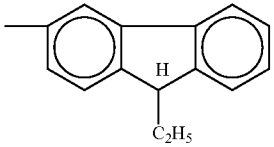 |
| II-48 | 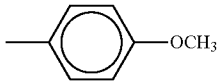 | 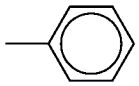 | 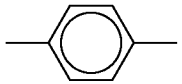 | —H | —H | 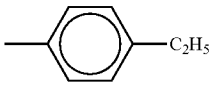 |
| II-49 | 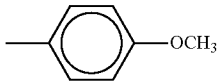 | 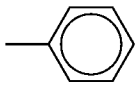 | 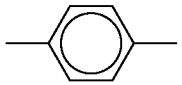 | —H | —H | 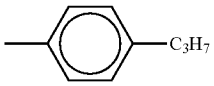 |
| II-50 | 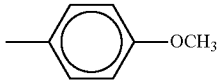 | 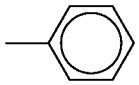 | 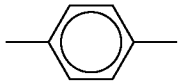 | —H | —H | 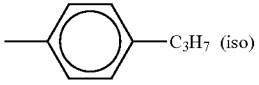 |
| II-51 | 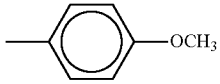 | 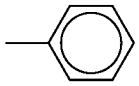 | 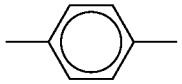 | —H | —H | 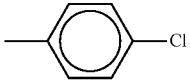 |
| II-52 | 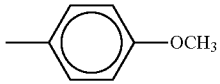 | 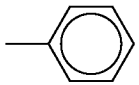 | 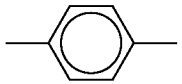 | —H | —H | 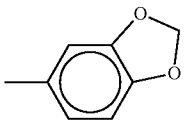 |

TABLE 3-continued
| | $Ar_4$ | $Ar_5$ | $Ar_6$ | $R_{49}$ | $R_{50}$ | $R_{51}$ |
|---|---|---|---|---|---|---|
| II-53 | 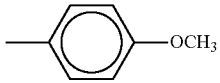 | 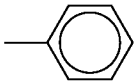 | 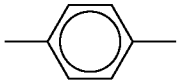 | —H | —H | 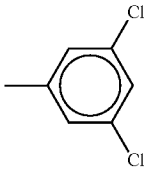 |
| II-54 | 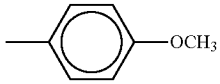 | 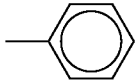 | 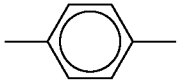 | —H | —H | 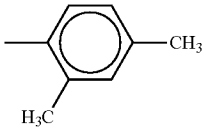 |
| II-55 | 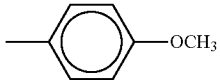 | 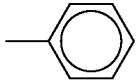 | 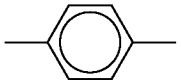 | —H | —H | 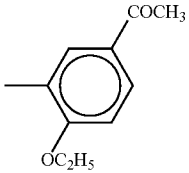 |
| II-56 | 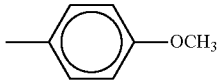 | 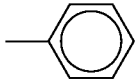 | 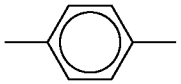 | —H | —H | 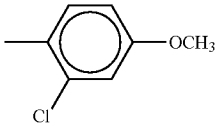 |
| II-57 | 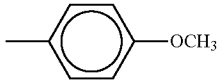 | 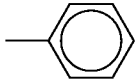 | 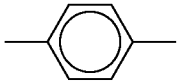 | —H | —H | 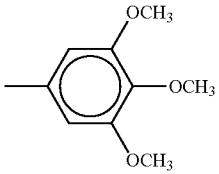 |
| II-58 | 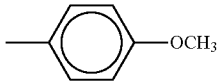 | 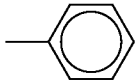 | 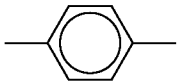 | —H | —H | 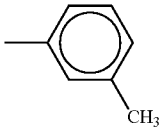 |

TABLE 3-continued
| | $Ar_4$ | $Ar_5$ | $Ar_6$ | $R_{49}$ | $R_{50}$ | $R_{51}$ |
|---|---|---|---|---|---|---|
| II-59 | 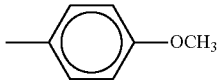 | 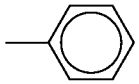 | 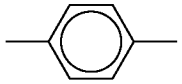 | —H | —H | 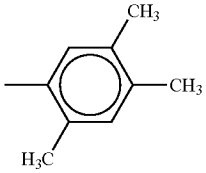 |
| II-60 | 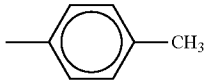 | 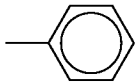 | 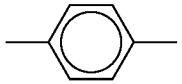 | —H | —H | 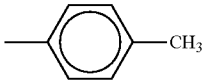 |
| II-61 | 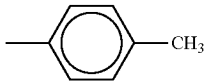 | 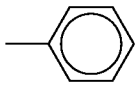 | 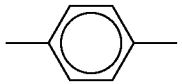 | —H | —H | 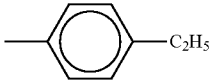 |
| II-62 | 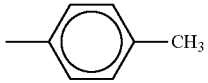 | 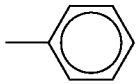 | 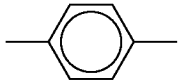 | —H | —H | 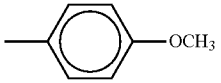 |
| II-63 | 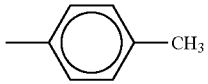 | 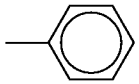 | 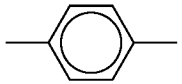 | —H | —H | 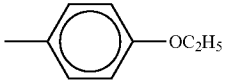 |
| II-64 | 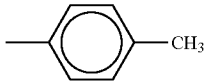 | 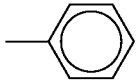 | 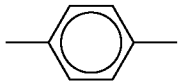 | —H | —H | 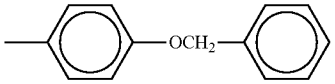 |
| II-65 | 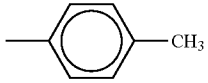 | 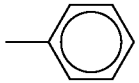 | 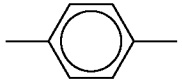 | —H | —H | 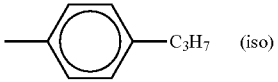 (iso) |
| II-66 | 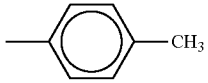 | 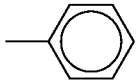 | 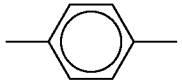 | —H | —H | 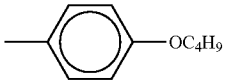 |
| II-67 | 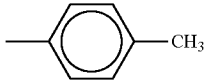 | 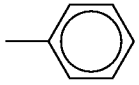 | 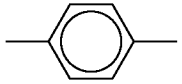 | —H | —H | 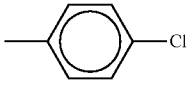 |

TABLE 3-continued
| | $Ar_4$ | $Ar_5$ | $Ar_6$ | $R_{49}$ | $R_{50}$ | $R_{51}$ |
|---|---|---|---|---|---|---|
| II-68 | 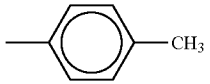 | 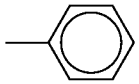 | 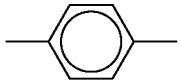 | —H | —H | 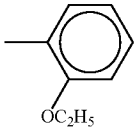 |
| II-69 | 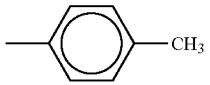 | 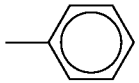 | 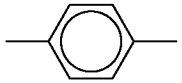 | —H | —H | 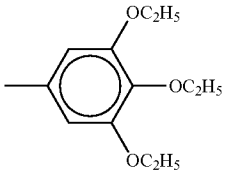 |
| II-70 | 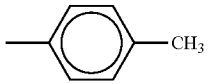 | 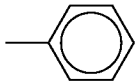 | 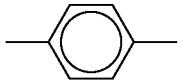 | —H | —H | 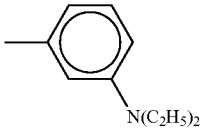 |
| II-71 | 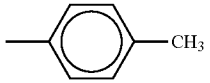 | 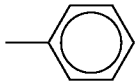 | 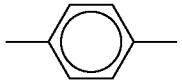 | —H | —H | 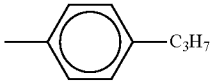 |
| II-72 | 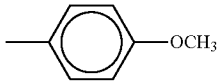 | 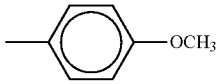 | 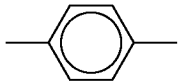 | —H | —H | 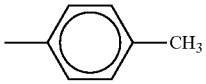 |
| II-73 | 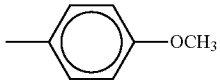 | 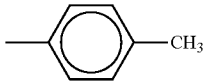 | 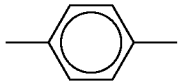 | —H | —H | 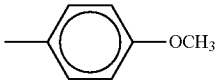 |
| II-74 | 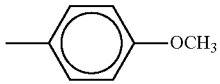 | 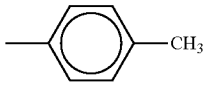 | 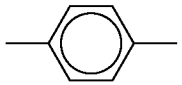 | —H | —H | 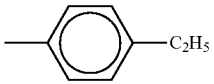 |
| II-75 | 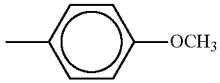 | 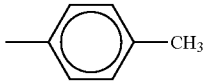 | 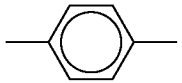 | —H | —H | 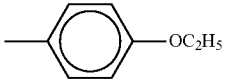 |

TABLE 3-continued
| | $Ar_4$ | $Ar_5$ | $Ar_6$ | $R_{49}$ | $R_{50}$ | $R_{51}$ |
|---|---|---|---|---|---|---|
| II-76 | 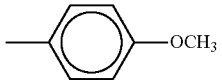 | 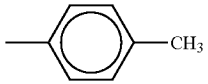 | 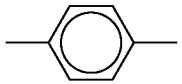 | —H | —H | 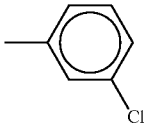 |
| II-77 | 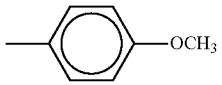 | 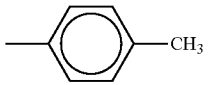 | 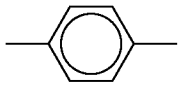 | —H | —H | 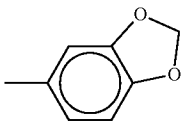 |
| II-78 | 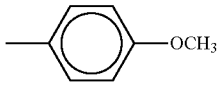 | 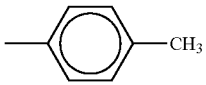 | 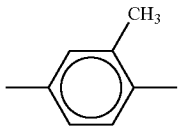 | —H | —H | 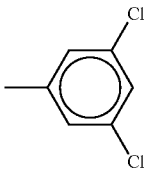 |
| II-79 | 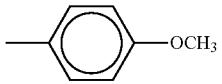 | 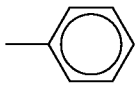 | 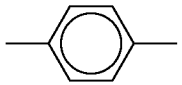 | —H | —H | 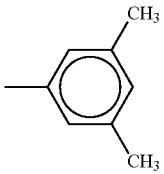 |
| II-80 | 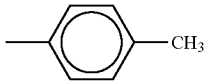 | 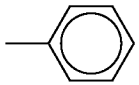 | 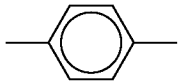 | —H | —H | 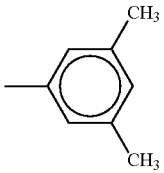 |
| II-81 | 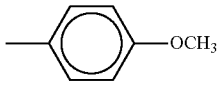 | 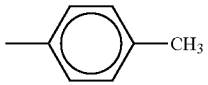 | 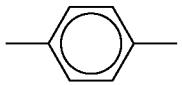 | —H | —H | 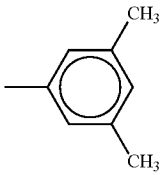 |

TABLE 3-continued
| | $Ar_4$ | $Ar_5$ | $Ar_6$ | $R_{49}$ | $R_{50}$ | $R_{51}$ |
|---|---|---|---|---|---|---|
| II-82 | 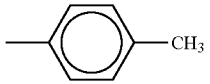 | 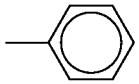 | 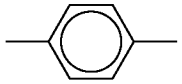 | —H | —H | 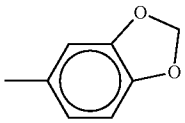 |
| II-83 | 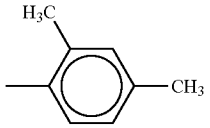 | 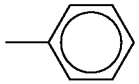 | 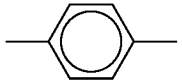 | $-CH_3$ | —H | 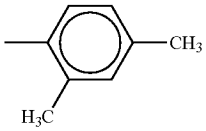 |
| II-84 | 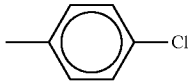 | 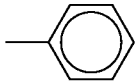 | 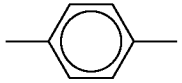 | $-CH_3$ | —H | 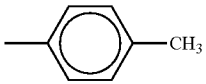 |
| II-85 | 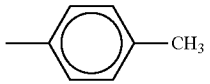 | 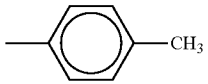 | 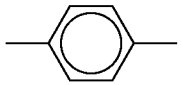 | —H | $-CH_3$ | 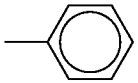 |
| II-86 | 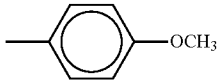 | 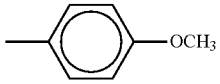 | 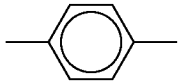 | —H | $-CH_3$ | 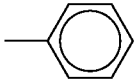 |
| II-87 | 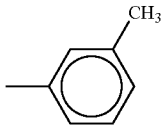 | 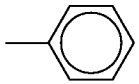 | 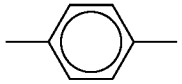 | —H | 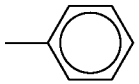 | 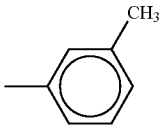 |
| II-88 | 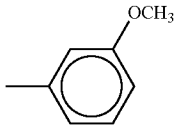 | 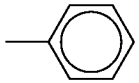 | 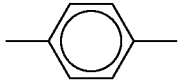 | —H | 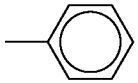 | 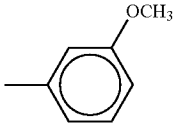 |
| II-89 | 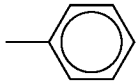 | 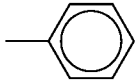 | 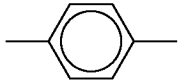 | —H | 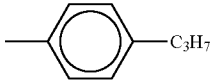 | 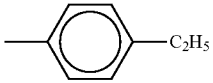 |

TABLE 3-continued
| | $Ar_4$ | $Ar_5$ | $Ar_6$ | $R_{49}$ | $R_{50}$ | $R_{51}$ |
|---|---|---|---|---|---|---|
| II-90 | 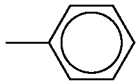 | 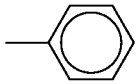 | 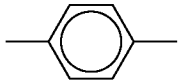 | —H | —H | 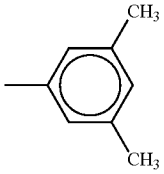 |
| II-91 | 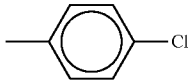 | 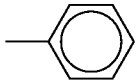 | 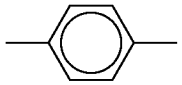 | —H | —H | 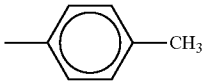 |
| II-92 | 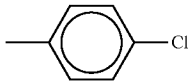 | 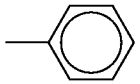 | 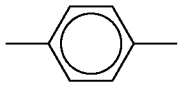 | —H | 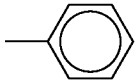 | 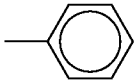 |
| II-93 | 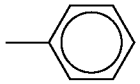 | 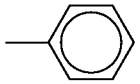 | 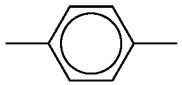 | —H | 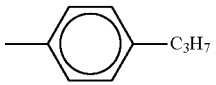 | 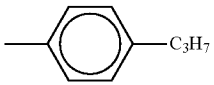 |
| II-94 | 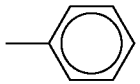 | 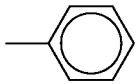 | 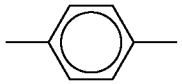 | —H | —H | 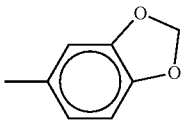 |
| II-95 | 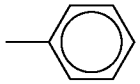 | 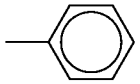 | 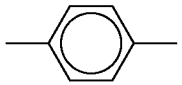 | —H | 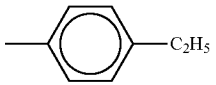 | 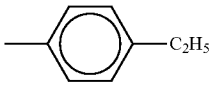 |
| II-96 | 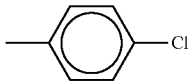 | 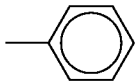 | 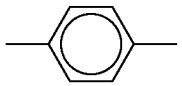 | —H | —H | 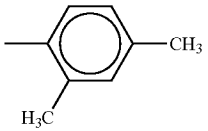 |
| II-97 | 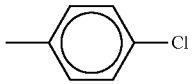 | 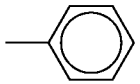 | 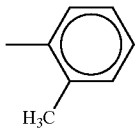 | —H | 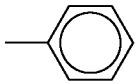 | 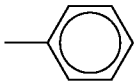 |

TABLE 3-continued
| | $Ar_4$ | $Ar_5$ | $Ar_6$ | $R_{49}$ | $R_{50}$ | $R_{51}$ |
|---|---|---|---|---|---|---|
| II-98 | 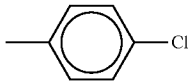 | 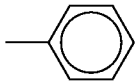 | 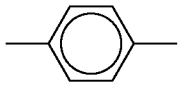 | —H | —H | 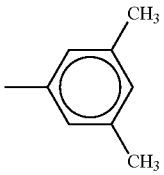 |
| II-99 | 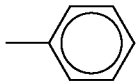 | 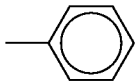 | 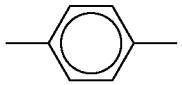 | —H | —H | 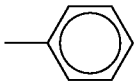 |
| II-100 | 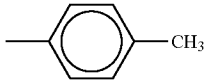 | 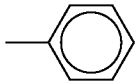 | 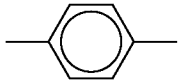 | —H | —H | 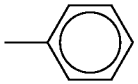 |
| II-101 | | 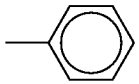 | 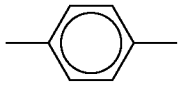 | —H | 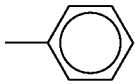 | 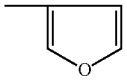 |

TABLE 3-continued
| | $Ar_4$ | $Ar_5$ | $Ar_6$ | $R_{49}$ | $R_{50}$ | $R_{51}$ |
|---|---|---|---|---|---|---|
| II-102 | 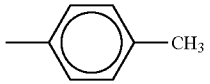 | 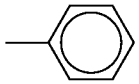 | 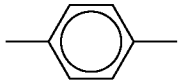 | —H | —H | 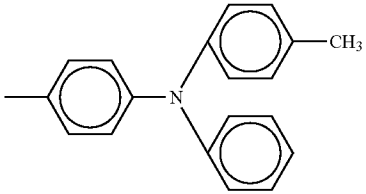 |
| II-103 | 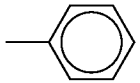 | 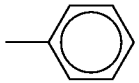 | 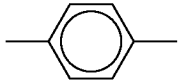 | —H | 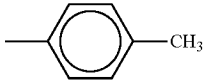 | 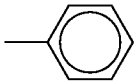 |
| II-104 | 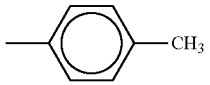 | 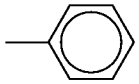 | 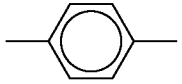 | —H | 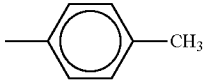 | 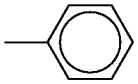 |
| II-105 | 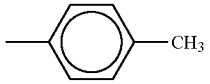 | 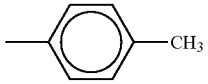 | 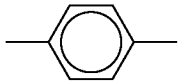 | —H | 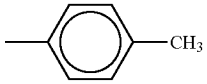 | 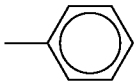 |
| II-106 | 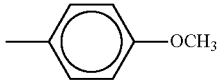 | 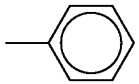 | 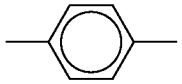 | —H | 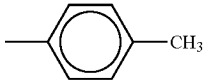 | 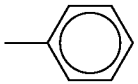 |
| II-107 | 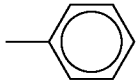 | 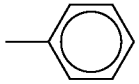 | 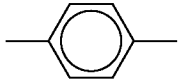 | —H | 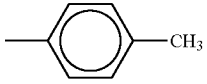 | 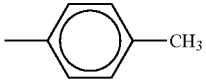 |
| II-108 | 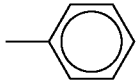 | 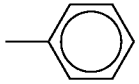 | 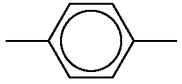 | —H | | 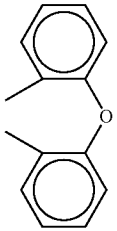 |

TABLE 3-continued
| | $Ar_4$ | $Ar_5$ | $Ar_6$ | $R_{49}$ | $R_{50}$ | $R_{51}$ |
|---|---|---|---|---|---|---|
| II-109 | 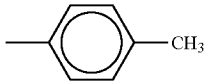 | 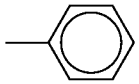 | 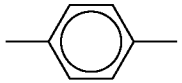 | —H | | 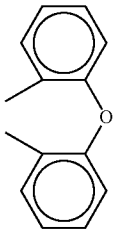 |
| II-110 | 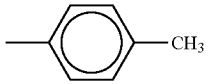 | 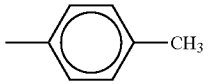 | 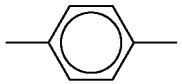 | —H | | 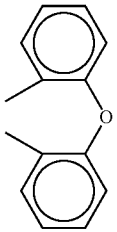 |
| II-111 | 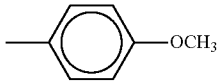 | 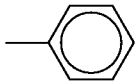 | 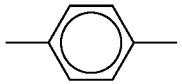 | —H | | 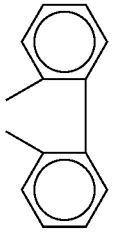 |
| II-112 | 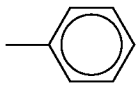 | 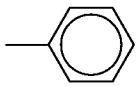 | 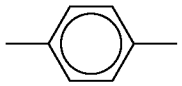 | —H | | 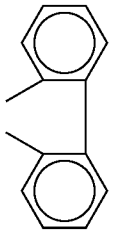 |

TABLE 3-continued
| | $Ar_4$ | $Ar_5$ | $Ar_6$ | $R_{49}$ | $R_{50}$ | $R_{51}$ |
|---|---|---|---|---|---|---|
| II-113 | 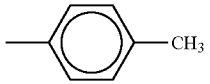 | 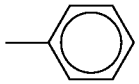 | 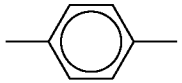 | —H | | 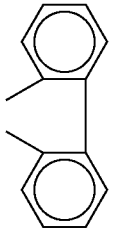 |
| II-114 | 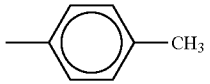 | 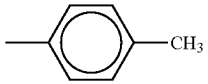 | 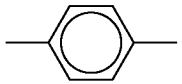 | —H | | 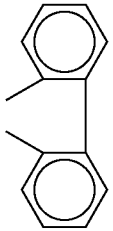 |
| II-115 | 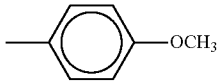 | 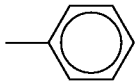 | 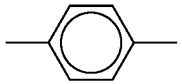 | —H | | 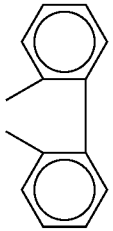 |
| II-116 | 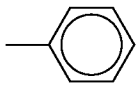 | 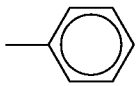 | 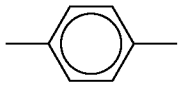 | —H | | 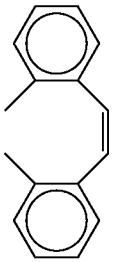 |

TABLE 3-continued
| | $Ar_4$ | $Ar_5$ | $Ar_6$ | $R_{49}$ | $R_{50}$ | $R_{51}$ |
|---|---|---|---|---|---|---|
| II-117 | 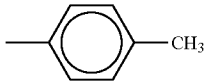 | 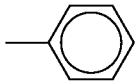 | 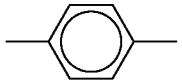 | —H | | 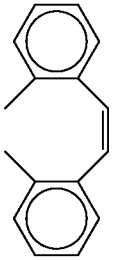 |
| II-118 | 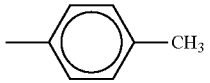 | 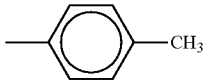 | 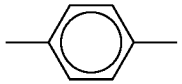 | —H | | 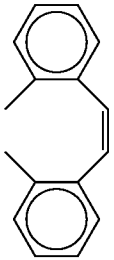 |
| II-119 | 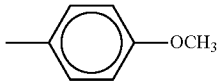 | 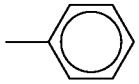 | 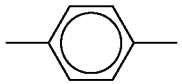 | —H | | 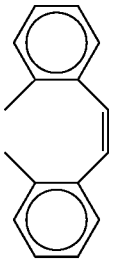 |

Specific examples of the compounds of Chemical formula X include, but are not limited to, the following (n=1) shown in Table 4.

TABLE 4

| | Chemical Structure |
|---|---|
| II-120 | 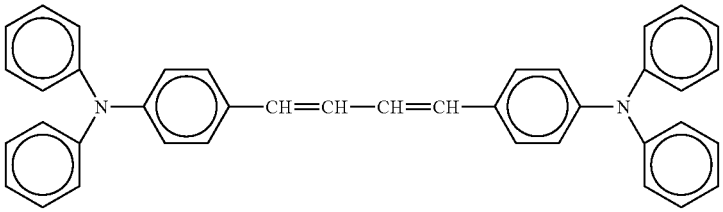 |
| II-121 | 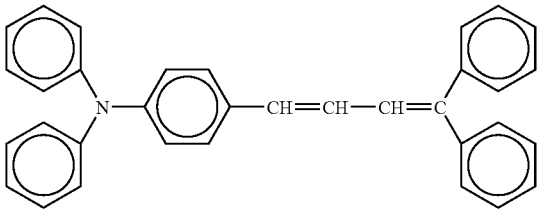 |
| II-122 | 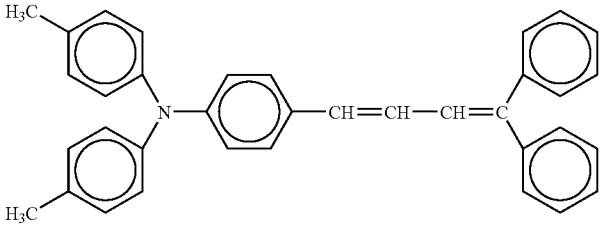 |

In addition to the compound of Chemical formula I, V or VI or the mixture of the compound of Chemical formula I, V or VI with the compound represented by Chemical formula X, it is possible to use the electron transport material, positive hole transport materials and the charge transport polymers described in the description about the charge generation layer. Among these, the charge transport polymers are especially useful because the charge transport polymers reduce the solubility of the under layers when a surface layer is applied.

When the compound of Chemical formula of I, V or VI is mixed with the compound of Chemical formula X, the content of the compound of Chemical formula of I, V or VI is suitably from 0 to 50% by weight and preferably from 10 to 40% by weight based on the content of the compound of Chemical formula X.

Specific examples of the binder resins include, but are not limited to, thermoplastic resins and thermosetting resins, for example, a polystyrene, a styrene-acrylonitrile copolymer, a styrene-butadiene copolymer, a styrene-anhydride maleic acid copolymer, a polyester, a polyvinyl chloride, a vinyl chloride-vinyl acetate copolymer, a polyvinyl acetate, a polyvinylidene chloride, a polyarylate (PAR) resin, a phenoxy resin, polycarbonate, a cellulose acetate resin, an ethyl cellulose resin, a polyvinyl butyral, a polyvinyl formal, a polyvinyl toluene, a poly-N-vinyl carbazole, an acrylic resin, a silicone resin, an epoxy resin, a melamine resin, an urethane resin, a phenol resin, and an alkyd resin.

The content of the charge transport material is from 20 to 300 parts by weight and preferably from 40 to 150 parts by weight based on 100 parts by weight of a binder resin.

As a solvent for use in application of the charge transport layer, the same solvent as the solvents for the charge generation layer can be used. It is suitable to use a solvent that suitably dissolves a charge transport material and a binder resin. These solvents can be used alone or in combination. To form a charge transport layer, the same method as in the case of the charge generation layer can be used.

In the present invention, a plasticizing agent and/or a leveling agent can be contained, if desired.

Specific examples of the plasticizing agent for use in the charge transport layer include, but are not limited to, dibutyl phthalate and dioctyl phthalate, which are used for a typical resin. The addition amount of the plasticizing agent is preferably from 0 to 30 parts by weight based on 100 parts by weight of a binder resin.

Specific examples of the leveling agent for use in the charge transport layer include, but are not limited to, silicone oils, for example, dimethyl silicone oil and methyl phenyl silicone oil, and polymers or oligomers having perfluoroalkyl groups in its side chain. The addition amount of the leveling agent is preferably from 0 to 1 part by weight based on 100 parts by weight of a binder resin.

The layer thickness of the charge transport layer for use in the present invention is preferably from 10 to 20 μm in consideration of the balance with the layer thickness of the surface protective layer to secure the stability for an extended period of time.

Undercoating Layer

In the image bearing member of the present invention, an undercoating layer can be provided between an electroconductive substrate and a photosensitive layer. Typically, such an undercoating layer is mainly made of a resin. Considering that a photosensitive layer is formed on such an undercoating layer (i.e., resin) using a solvent, the resin is preferably hardly soluble in a typically used organic solvent. Specific examples of such resins include, but are not limited to, water soluble resins, such as polyvinyl alcohol, casein, and sodium polyacrylate, alcohol soluble resins, such as copolymerized nylon and methoxymethylized nylon and curing resins which form a three dimension mesh structure, such as polyurethane, melamine resins, phenol resins, alkyd-melamine resins and epoxy resins. In addition, to prevent moiré and reduce the residual voltage, it is possible to add to an undercoating layer fine powder pigments of metal oxide, such as titanium oxides, silica, alumina, zirconium oxides, tin oxides and indium oxides.

These undercoating layers can be formed by using a suitable solvent and a suitable coating method as described for the photosensitive layer. Silane coupling agents, titanium coupling agents and chromium coupling agents can be used in for the undercoating layer. Furthermore, an undercoating layer can be formed by using a material formed by anodizing $Al_2O_3$, or an organic compound, such as polyparaxylylene (parylene) or an inorganic compound, such as $SiO_2$, $SnO_2$, $TiO_2$, ITO, and $CeO_2$ by a vacuum thin-film forming method.

The layer thickness of such an undercoating layer is suitably from 0 to 5 μm.

Addition of Anti-Oxidizing Agent

Furthermore, in the present invention, to improve the environmental resistance, in particular, to prevent the degradation of sensitivity and the rise in residual potential, an anti-oxidizing agent can be added to layers, for example, a surface protective layer, a charge generation layer, a charge transport layer, an undercoating layer and an intermediate layer. Specific examples of the anti-oxidizing agent include, but are not limited to, phenol compounds, paraphenylene diamines, hydroquinones, organic sulfur compounds, and organic phosphorous compounds.

Specific examples of the phenol compound include, but are not limited to, 2,6-di-t-butyl-p-cresol, butylated hydroxyanisol, 2,6-di-t-butyl-4-ethylphenol, stearyl-β-(3,5-di-t-butyl-4-hydroxyphenyl)propionate, 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3',5'-di-t-butyl-4'-hydroxyphenyl) propionate]methane, bis[3,3'-bis(4'-hydroxy-3'-t-butylphenyl)butyric acid]glycol ester, and tocopherols.

Specific examples of the paraphenylene diamines include, but are not limited to, N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, and N,N'-dimethyl-N,N'-di-t-butyl-p-phenylenediamine.

Specific examples of the hydroquinones include, but are not limited to, 2,5-di-t-octylhydroquinone, 2,6-didodecylhydroquinone, 2-dodecylhydroquinone, 2-dodecyl-5-chlorohydroquinone, 2-t-octyl-5-methylhydroquinone, and 2-(2-octadecenyl)-5-methylhydroquinone.

Specific examples of the organic sulfur compounds include, but are not limited to, dilauryl-3,3'-thiodipropionate, distearyl-3,3'-thiodipropyonate, dimyristyl-3,3'-thiodipropionate, ditetradecyl-3,3'-thiodipropyonate and pentaerythritol tetrakis(3-lauryl thiopropionate).

Specific examples of the organic phosphorous compounds include, but are not limited to, triphenylphosphate, tri(nonylphenyl)phosphate, tri(dinonylphenyl)phosphate, tris(2-ethylhexyl)phosphate, tridecyl phosphate, tris(tridecyl)phosphate, diphenylmono(2-ethylhexyl) phosphate, diphenylmonodecyl phosphate, tris(2,4,di-t-butylphenyl) phosphate, distearylpentaerythritol diphosphate, bis(2,4,di-t-butylphenyl)pentaerythritol phosphate, 2,2-methylenebis(4,6-di-t-butylphenyl)octyl phosphate, tetrakis(2,4-di-t-butylphenyl)-4,4'-biphenylene-di-phosphonite, dilaurylhydrogen phosphate, diphenylhydrogen phosphate, tetraphenyl dipropyleneglycol diphosphate, tetraphenyltetra (tridecyl)pentaerythritol tetraphosphite, tetra(tridecyl)-4,4'isopropylidene diphenyl diphosphate, bis(nonylphenyl) pentaerylthritol diphosphate, and hydrogenerated bisphenol A.pentaerythritol phosphate polymer.

These compounds are known as anti-oxidizing agents for rubbers, plastics, and oils, and commercial products thereof are readily available.

The addition amount of the anti-oxidizing agent is preferably 0.01 to 10 parts by weight based on the total weight of the layer to which the anti-oxidizing agent is added.

Image Forming Apparatus

The image forming apparatus of the present invention is described in detail with reference to accompanying drawings.

The image forming apparatus of the present invention include, but are not limited to, processes (devices) of: charging the image bearing member of the present invention; irradiating the image bearing member with light to form a latent electrostatic image; developing the latent image with toner; transferring the toner image to an image carrying body (transfer medium); fixing the toner image; and cleaning the surface of the image bearing member.

Figure 2:
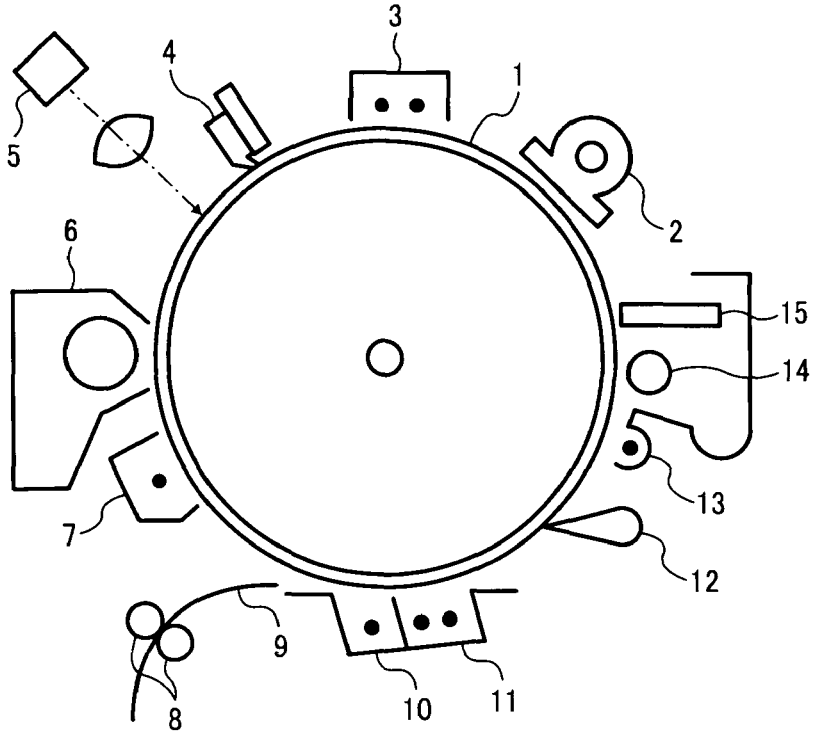
FIG. 2 is a diagram illustrating an examples of the image forming apparatus of the present invention.

FIG. 2 is a schematic diagram of illustrating an example of the image forming apparatus. A charging device 3 is used as a device to uniformly charge an image bearing member 1. Specific examples of the charging device 3 include, but are not limited to, a corotron device, a scorotron device, a solid discharging element, a needle electrode device, a roller charger, and an electroconductive brush device and any known method can be used.

Next, an image irradiation portion 5 is used to form a latent electrostatic image on the uniformly charged image bearing member 1. As the light source of the image irradiation portion 5, typical illuminating materials, for example, a fluorescent lamp, a tungsten lamp, a halogen lamp, a mercury lamp, a sodium lamp, a light emitting diode (LED), a semiconductor laser (LD), and electroluminescence (EL), can be used. To irradiate an image bearing member with light having only a particular wavelength, various kinds of optical filters, for example, a sharp cut filter, a band-pass filter, a near infrared filter, a dichroic filter, a coherent filter and a color conversion filter, can be used.

Next, a developing unit 6 is used for visualizing the latent electrostatic image formed on the image bearing member 1. As the developing method, there are a one-component developing method and a two-component development method using a dry toner, and a wet-developing method using a wet toner. When an image bearing member is positively (or negatively) charged and irradiated, a positive (or negative) latent electrostatic image is formed on the image bearing member. When the latent electrostatic image is developed with a negatively (or positively) charged toner (volt-detecting fine particles), a positive image is formed. When the latent electrostatic image is developed using a positively (or negatively) charged toner, a negative image is formed.

A transfer charging device 10 is used for transferring a toner image visualized on the image bearing member 1 to a transfer body 9. To more preferably perform the transferring, a pre-transfer charging device 7 can be used. As the charging device, a transfer roller, a transfer belt, etc. can be used other than the transfer charging device.

In the present invention, an image forming apparatus is preferred which directly transfers a developed image on the image bearing member rotating at a linear speed of not less than 500 mm/s to a transfer medium and in which the polarity of the surface of the image bearing member after the developed image is transferred to the transfer medium is opposite to the polarity when the image bearing member is charged. Thereby, the toner on the image bearing member rotating at a high speed is efficiently transferred to the transfer medium. Furthermore, the surface protective layer for use in the present invention can prevent charges having an opposite polarity from flowing into the inside of a charge transport layer or charge generation layer. Therefore, quality images having no residual image can be produced for an extended period of time during which image formation is repetitively performed.

Next, a separation charging device 11 and a separation pawl 12 are used to separate the transfer body 9 from the image bearing member 1. The charging device mentioned above can be used as the separation charging device 11. Other separation methods that can be used are, for example, electrostatic sucking inducing separation, side edge belt separation, front edge grip conveyance and curvature separation.

A fur brush 14 and/or a cleaning blade 15 are used for cleaning a toner remaining on the image bearing member 1 after transfer. A pre-cleaning charging device 13 can be used for efficiently performing cleaning. As the other cleaning methods, there are a web system and a magnet brush system. These systems can be employed alone or in combination.

A discharging unit can be optionally used for removing a latent image on the image bearing member 1. As the discharging unit, a discharging lamp 2 or a discharging device can be used. The irradiation light source and the charging device mentioned above can be used.

In addition, with regard to the processes that are performed not in the vicinity of the image bearing member 1, i.e., reading an original, sheet-feeding, fixing, paper-discharging, known devices and methods in the art can be used.

The image forming apparatus uses the image bearing member of the present invention in the image formation unit as described above.

Figure 3:
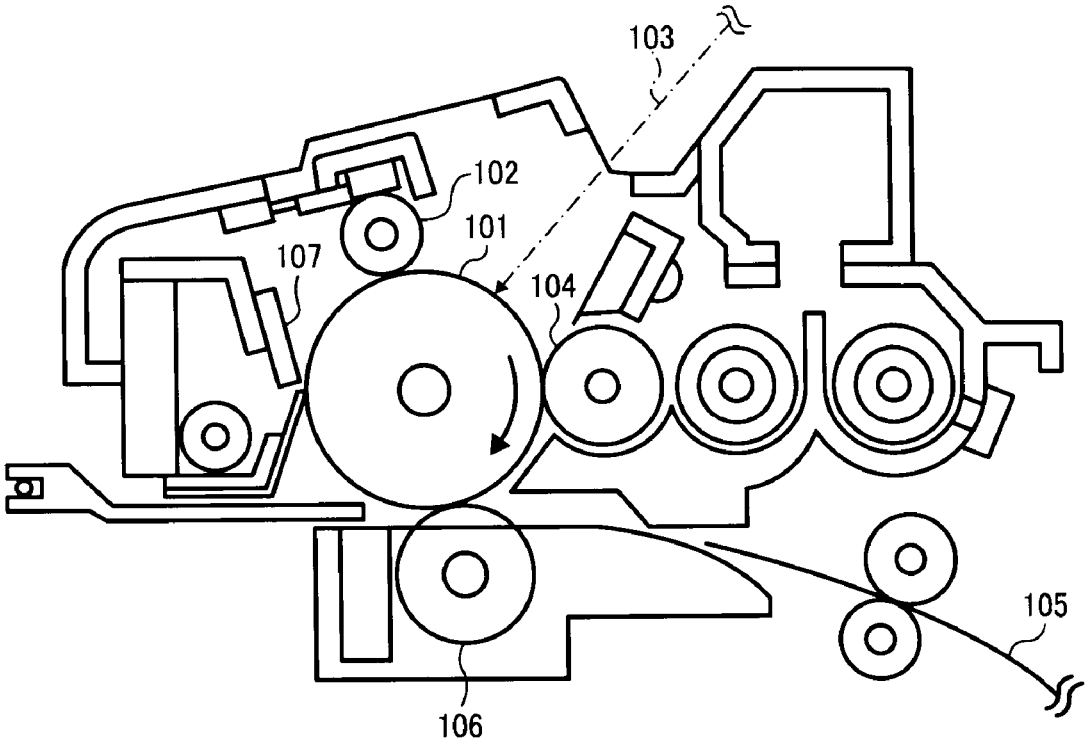
FIG. 3 is a schematic diagram illustrating an example of the process cartridge for use in the image forming apparatus of the present invention.

The image formation unit may be fixed in and incorporated into a photocopier, a facsimile machine, or a printer, or may be detachably incorporated into these devices in a form of a process cartridge. FIG. 3 is a diagram illustrating an example of the process cartridge.

The process cartridge for use in an image forming apparatus is a device (or component) that integrates an image bearing member 101 therein, includes at least one device selected from a charging device 102, a developing device 104, a transfer device 106, a cleaning device 107 and a discharging device (not shown) and is detachably mounted to the main body of an image forming apparatus.

The image forming process using the device exemplified in FIG. 6 will be described. While the image bearing member 101 having a drum form rotates in the direction indicated by the arrow, a latent electrostatic image corresponding to the exposed image is formed on the surface of the image bearing member 101 through charging and irradiating the surface thereof by a charging device 102 and an irradiating device 103. This latent electrostatic image is developed with a toner by the developing device 104, and the toner image is transferred to a transferring body 105 by a transfer device 106. The surface of the image bearing member 101 after the image transfer is cleaned by the cleaning device 107 and discharged by a discharging device (not shown) to be ready for the next cycle.

According to the present invention, a process cartridge for use in an image forming apparatus is provided which includes the image bearing member of the present invention integrated with at least one device selected from a charging device, a developing device, a cleaning device and a discharging device.

As seen in the description above, the image bearing member of the present invention can be used not only to an electrophotographic apparatus but also to an applied electrophotography field, for example, a laser beam printer, a CRT printer, an LED printer, a liquid crystal printer and a laser printing.

Synthesis Example of Compound Having Charge Transport Structure

The compound having radical polymerizable functional group with a charge transport structure for use in the present invention can be synthesized by, for example, the method described in JP 3164426. Specific examples thereof are as follows:

(1) Synthesis of Hydroxy Group Substituted Triarylamine Compound (Chemical Structure B)

240 ml of sulfolane is added to 113.85 g (0.3 mol) of a methoxy group-substituted triarylamine compound (represented by the following chemical structure A), and 138 g (0.92 mol) of sodium iodide. The resultant is heated to 60° C. in nitrogen atmosphere. 99 g (0.91 mol) of trimethylchlorosilane is dropped to the resultant solution in one hour. Thereafter, the solution is stirred for 4.5 hours at around 60° C. and the reaction is terminated. To the reaction liquid, approximately 1,500 ml of toluene is added, and the reaction liquid is cooled down to the room temperature followed by repetitive washing with water and a sodium carbonate aqueous solution. Then, the solvent is removed from the toluene solution, and the solution is purified by column chromatography (absorption medium: silica gel; developing solvent: toluene:ethyl acetate=20:1). Cyclohexane is added to the obtained cream-colored oil to precipitate crystals. 88.1 g (yield constant: 80.4%) of white-color crystals represented by the following chemical structure B is thus obtained.

Melting point: 64.0 to 66.0° C.

Element analytical values (%) are shown in Table 5.

TABLE 5

| | C | H | N |
|---|---|---|---|
| Measured value | 85.06 | 6.41 | 3.73 |
| Calculated value | 85.44 | 6.34 | 3.83 |

(2) Synthesis of Triarylamine Group-Substituted Acrylate Compound (Compound Example No. 54 Illustrated Above)

82.9 g (0.227 mol) of the hydroxy group-substituted triarylamine compound obtained in (1) (Chemical structure B) is dissolved in 400 ml of tetrahydrofuran, and a sodium hydroxide solution (NaOH: 12.4 g, water: 100 ml) is dropped into the dissolved solution in a nitrogen atmosphere. The solution is cooled down to 5° C., and 25.2 g (0.272 mol) of acrylic acid chloride is dropped thereto in 40 minutes. Thereafter, the solution is stirred for 3 hours at 5° C., and the reaction is terminated. The reaction liquid is poured to water and extracted using toluene. The extract is repetitively washed with a sodium hydrogen carbonate aqueous solution and water. Thereafter, the solvent is removed from the toluene solution, and the solution is purified by column chromatography (absorption medium: silica gel; developing solvent: toluene). Then, n-hexane is added to the obtained colorless oil to precipitate crystals. 80.73 g (yield constant: 84.8%) of white-color crystals of Compound Example No. 54 illustrated above is obtained. Melting point: 117.5 to 119.0° C.

Element analytical values (%) are shown in Table 6.

TABLE 6

| | C | H | N |
|---|---|---|---|
| Measured value | 83.13 | 6.01 | 3.16 |
| Calculated value | 83.02 | 6.00 | 3.33 |

Synthesis Example of Titanyl Phthalocyanine

According to JOP 2001-19871, a pigment is prepared. 29.2 g of 1,3-diiminoisoindoline and 200 ml of sulfolane are mixed and 20.4 g of titanium tetrabutoxido is dropped thereto in nitrogen atmosphere. Thereafter, the temperature is gradually raised to 180° C., and the resultant is stirred for reaction for 5 hours while the reaction temperature is maintained in the range of from 170 to 180° C. After the reaction, the resultant is naturally cooled down and the precipitation is filtered. The filtered resultant is washed with chloroform until the obtained powder indicates the color of blue. Next, the resultant powder is washed with methanol several times. Further, subsequent to washing with hot water of 80° C. several times and drying, a coarse titanyl phthalocyanine is obtained. The titanyl phthalocyanine is dissolved in strong sulfuric acid, the amount of which is 20 times as much as that of the titanyl phthalocyanine. The resultant is dropped to iced water, the amount of which is 100 times as much as the resultant. The precipitated crystal is filtered and water-washed until the washing water is neural (The pH value of the deionized water after washing is 6.8). A wet cake (water paste) of titanyl phthalocyanine pigment is thus obtained. 40 g of the thus obtained wet cake (water paste) is put in 200 g of tetrahydrofuran and stirred for 4 hours. After filtration and drying, titanyl phthalocyanine powder is obtained.

The thus obtained titanyl phthalocyanine powder has an X ray diffraction spectrum of characteristic X ray of CuKα having a wavelength of 1.542 Å such that the maximum diffraction peak is observed at a Bragg (2θ) angle of 27.2°, the main peaks are observed at a Bragg (2θ) angle of 9.4°, 9.6°, and 24.0°, and a peak is observed at a Bragg (2θ) angle of 7.3° as the lowest angle diffraction peak while there is no peak between 9.4° and 7.3° and there is no peak at 26.3°.

Having generally described preferred embodiments of this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

The liquid application for undercoating layer, the liquid application for charge generation layer and the liquid application for charge transport layer having the following compositions are sequentially coated on an aluminum cylinder by a dip coating method. Subsequent to drying, an undercoating layer having a thickness of 3.5 μm, a charge generation layer having a thickness of 0.2 μm and a charge transport layer having a thickness of 15 μm are formed.

| Liquid Application for Undercoating Layer | |
|---|---|
| Alkyd resin (Beckozole 1307-60-EL, available from Dainippon Ink and Chemicals, Inc.) | 6 parts |
| Melamine resin (Super-beckamine, available from Dainippon Ink and Chemicals, Inc.) | 4 parts |
| Titanium oxide | 40 parts |
| Methylethylketone | 50 parts |
| **Liquid Application for Charge Generation Layer** | |
| Titanyl phthalocyanine pigment synthesized above: | 1.5 parts |
| Polyvinyl acetate: (BM-S, manufactured by Sekisui Chemical Co., Ltd.) | 0.5 parts |
| Methylethyl ketone | 70 parts |
| **Liquid Application for Charge Transport Layer** | |
| Bisphenol Z type polycarbonate resin (PANLITE TS-2050, manufactured by Teijin Chemicals Ltd.) | 10 parts |
| Charge transport compound represented by the chemical structure No. 12 | 10 parts |

Chemical structure No. 12

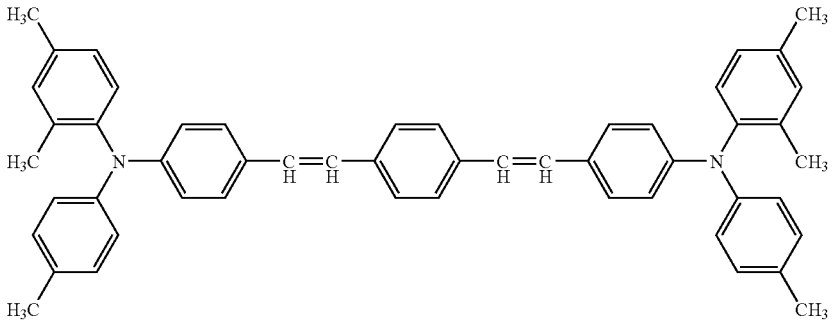

| | |
|---|---|
| Tetrahydrofuran: | 100 parts |
| Tetrahydrofuran solution of 1% silicone oil (KF50-100CS, manufactured by Shin-Etsu Chemical Co., Ltd.) | 1 part |

The image bearing member of the present invention is obtained by spray-coating a liquid application for surface protective layer having the following recipe on the charge transport layer and irradiating with light by a metal halide lamp under the condition of irradiation intensity of 500 mW/cm$^2$ and an irradiation time of 240 seconds followed by drying at 130° C. for 30 minutes to form a surface protective layer having a thickness of 15 μm.

| Liquid Application for Surface Protective Layer | |
|---|---|
| Monomer having at least three radical polymerizable functional groups without a charge transport structure | |
| (1) Trimethylolpropantriacrylate represented by Chemical formula 20 (TMPTA, manufactured by Tokyo Chemical Industry Co., Ltd.) | 55 parts |

Chemical formula 20

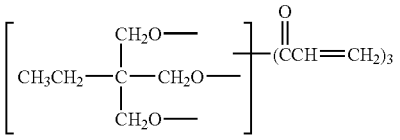

| | |
|---|---|
| (2) Alkyl modified dipenta erythritol pentaacrylate represented by Chemical formula 21: (KAYARADD-310, manufactured by Nippon Kayaku Co., Ltd.) | 40 parts |

Chemical formula 21

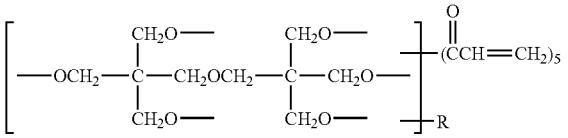

In Chemical formula 21, R represents butyl group.

| | |
|---|---|
| Monomer having one radical polymerizable functional group with a charge transport structure (Compound Example No. 54 illustrated above) | 95 parts |
| Photo-polymerization initiator 1-hydroxy-cyclohexyl-phenyl-keton (IRGACURE 184, manufactured by Chiba Specialty Chemicals K.K.) | 10 parts |
| Tetrahydrofuran | 1,200 parts |

Example 2

The image bearing member of Example 2 is manufactured in the same manner as in Example 1 except that the layer thickness of the surface protective layer is changed to 19 μm.

Example 3

The image bearing member of Example 3 is manufactured in the same manner as in Example 1 except that the layer thickness of the surface protective layer is changed to 11 μm.

Example 4

The image bearing member of Example 4 is manufactured in the same manner as in Example 1 except that the layer thickness of the charge transport layer is changed to 20 μm.

Example 5

The image bearing member of Example 5 is manufactured in the same manner as in Example 1 except that the layer thickness of the charge transport layer is changed to 12 μm.

Example 6

The image bearing member of Example 6 is manufactured in the same manner as in Example 1 except that the charge transport compound contained in the charge transport layer is changed to the compound represented by the following chemical structure:

| | |
|---|---|
| Charge transport compound represented by the chemical structure No. 14 | 10 parts |

Chemical structure No. 14

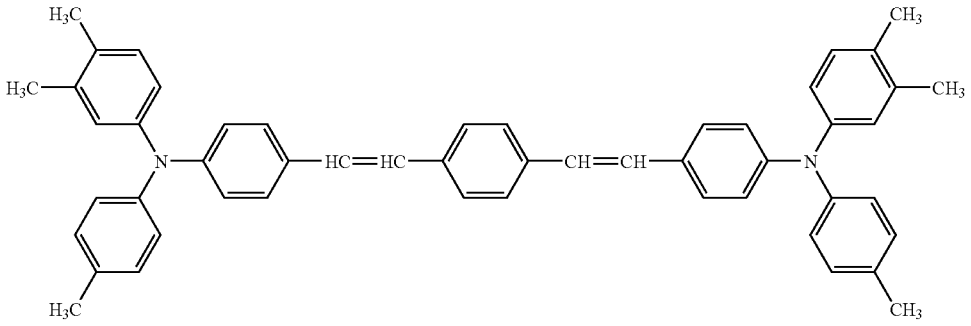

Example 7

The image bearing member of Example 7 is manufactured in the same manner as in Example 1 except that the charge transport compound contained in the charge transport layer is changed to the compound represented by the following chemical structure:

| | |
|---|---|
| Charge transport compound represented by the chemical structure No. 7 | 10 parts |

Chemical structure No. 7

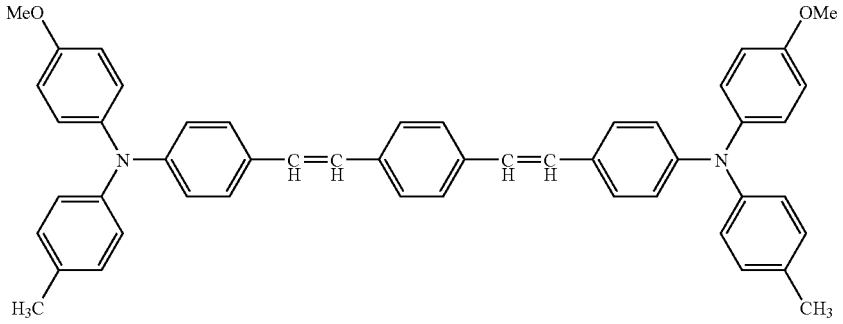

Example 8

The image bearing member of Example 8 is manufactured in the same manner as in Example 1 except that the charge transport compound contained in the charge transport layer is changed to the following compounds:

| | |
|---|---|
| Charge transport compound represented by the chemical structure No. 12 | 7 parts |

Chemical structure No. 12

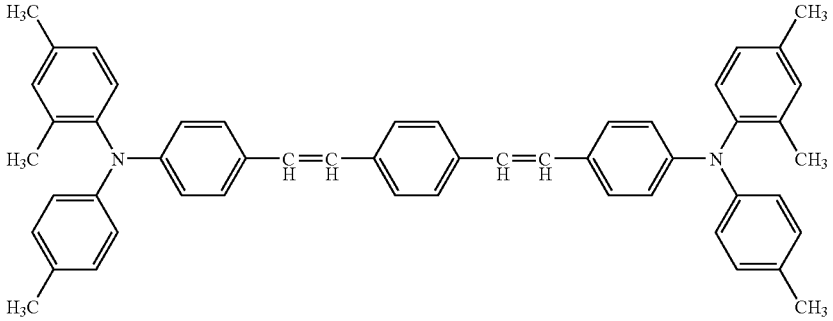

| | |
|---|---|
| Charge transport compound 11-6: | 3 parts |

Example 9

The image bearing member of Example 9 is manufactured in the same manner as in Example 1 except that the layer thickness of the surface protective layer is changed to 19 μm and the charge transport compound contained in the charge transport layer is changed to the compounds:

| | |
|---|---|
| Charge transport compound represented by the following chemical structure No. 12 | 7 parts |

Chemical structure No. 12

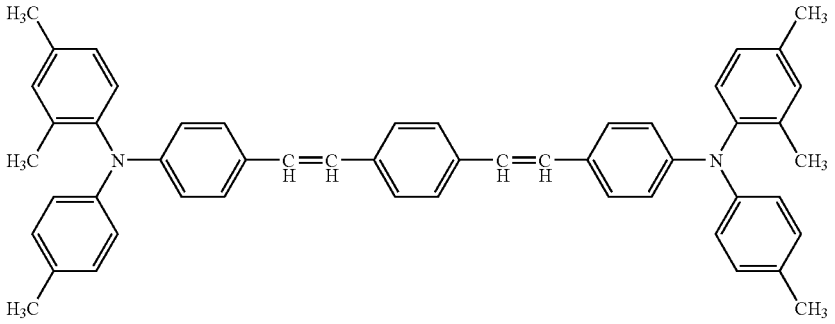

| | |
|---|---|
| Charge transport compound 11-6 | 3 parts |

Example 10

The image bearing member of Example 10 is manufactured in the same manner as in Example 1 except that the layer thickness of the surface protective layer is changed to 11 μm and the charge transport compound contained in the charge transport layer is changed to the compounds represented by the following chemical structures:

| | |
|---|---|
| Charge transport compound (No. 12) | 7 parts |

Chemical structure No. 12

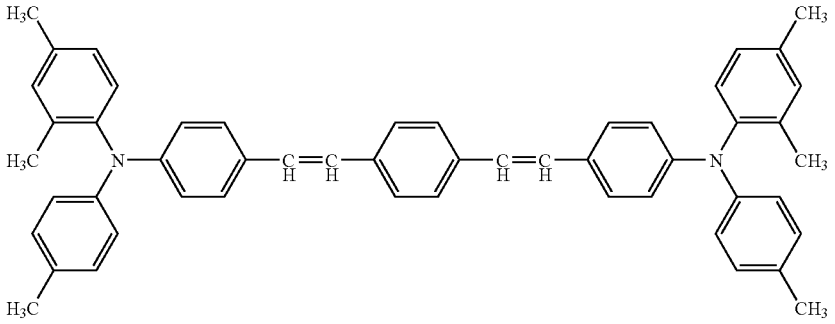

| | |
|---|---|
| Charge transport compound 11-6: | 3 parts |

Example 11

The image bearing member of Example 11 is manufactured in the same manner as in Example 1 except that the liquid application for charge generation layer is changed to the following:

| Liquid Application for Charge Generation Layer | |
|---|---|
| Pigment of Synthesis Example of Titanylphthalocyanine pigment described above: | 1.0 part |
| Disazo pigment represented by the following chemical formula 22: | 1.0 part |

Chemical formula 22

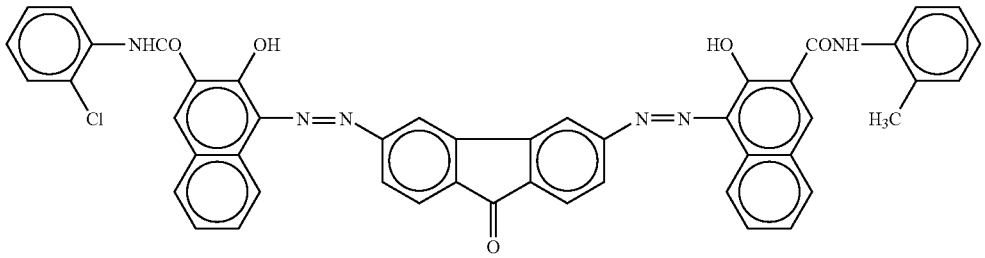

| | |
|---|---|
| Polyvinyl acetal (BM-S, manufactured by Sekisui Chemical Co., Ltd.) | 0.8 parts |
| Methylethyl ketone | 30 parts |
| Cyclohexanone | 40 parts |

Example 12

The image bearing member of Example 12 is manufactured in the same manner as in Example 1 except that the liquid application for charge generation layer is changed to the following:

| Liquid Application for Charge Generation Layer | |
|---|---|
| Galliumphthalocyanine pigment: | 1.5 parts |
| Polyvinylacetal (BM-S, manufactured by Sekisui Chemical Co., Ltd.) | 0.5 parts |
| Methylethyl ketone | 70 parts |

Comparative Example 1

The image bearing member of Comparative Example 1 is manufactured in the same manner as in Example 1 except that the layer thickness of the surface protective layer is changed to 22 μm.

Comparative Example 2

The image bearing member of Comparative Example 2 is manufactured in the same manner as in Example 1 except that the layer thickness of the surface protective layer is changed to 8 μm.

Comparative Example 3

The image bearing member of Comparative Example 3 is manufactured in the same manner as in Example 1 except that the layer thickness of the charge transport layer is changed to 25 μm.

Comparative Example 4

The image bearing member of Comparative Example 4 is manufactured in the same manner as in Example 1 except that the layer thickness of the charge transport layer is changed to 10 μm.

Comparative Example 5

The image bearing member of Comparative Example 5 is manufactured in the same manner as in Example 1 except that the charge transport compound contained in the charge transport layer is changed to the following compound:

| | |
|---|---|
| Charge transport compound II-6 | 10 parts |

Comparative Example 6

The image bearing member of Comparative Example 6 is manufactured in the same manner as in Example 1 except that the charge transport compound contained in the charge transport layer is changed to the following compound:

| | |
|---|---|
| Charge transport compound represented by Chemical formula 23: | 10 parts |

Chemical formula 23

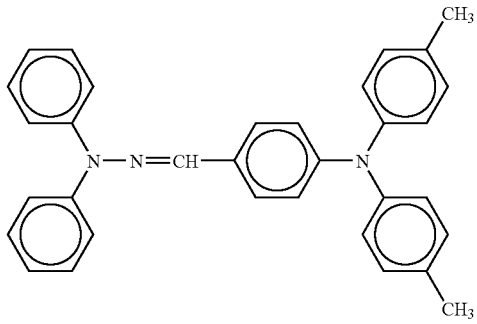

Comparative Example 7

The image bearing member of Comparative Example 7 is manufactured in the same manner as in Example 11 except that the layer thickness of the surface protective layer is changed to 22 μm.

Comparative Example 8

The image bearing member of Comparative Example 8 is manufactured in the same manner as in Example 11 except that the layer thickness of the surface protective layer is changed to 8 μm.

The image bearing members manufactured as described above are installed in a process cartridge for electrophotography and an actual machine test for durability is performed at imagioNeo 1050 Pro (manufactured by Ricoh Co., Ltd.) with a continuous run length of 1,000,000 impressions. The output images are evaluated by observation with naked eyes. The results are shown in Table 7.

Actual Machine Test

Linear velocity of image bearing member: 500 mm/s

Charge condition: Set to 800 (−V) at image bearing member

Transfer condition: Set to 110 (μA) for transfer current

TABLE 7

| | Surface layer Layer thickness (t1) (μm) | Charge transport layer Layer thickness (t2) (μm) | Ratio of layer thickness (t1)/(t2) | Charge transport layer Compound | Charge generation material | Evaluation result |
|---|---|---|---|---|---|---|
| Example 1 | 15 | 15 | 1 | No. 12 | Titanyl phthalocyanine | No abnormal image |
| Example 2 | 19 | 15 | 1.27 | No. 12 | Titanyl phthalocyanine | No abnormal image |
| Example 3 | 11 | 15 | 0.73 | No. 12 | Titanyl phthalocyanine | No abnormal image |
| Example 4 | 15 | 20 | 0.75 | No. 12 | Titanyl phthalocyanine | No abnormal image |
| Example 5 | 15 | 12 | 1.25 | No. 12 | Titanyl phthalocyanine | No abnormal image |
| Example 6 | 15 | 15 | 1 | No. 14 | Titanyl phthalocyanine | No abnormal image |
| Example 7 | 15 | 15 | 1 | No. 7 | Titanyl phthalocyanine | No abnormal image |
| Example 8 | 15 | 15 | 1 | No. 12 and II-6 | Titanyl phthalocyanine | No abnormal image |
| Example 9 | 19 | 15 | 1.27 | No. 12 and II-6 | Titanyl phthalocyanine | No abnormal image |
| Example 10 | 11 | 15 | 0.73 | No. 12 and II-6 | Titanyl phthalocyanine | No abnormal image |
| Example 11 | 15 | 15 | 1 | No. 12 | Titanyl phthalocyanine and azo pigment | No abnormal image |
| Example 12 | 15 | 15 | 1 | No. 12 | Gallium phthalocyanine | Slightly residual image observed but good as a whole |
| Comparative Example 1 | 22 | 15 | 1.47 | No. 12 | Titanyl phthalocyanine | Significantly residual image observed |
| Comparative Example 2 | 8 | 15 | 0.53 | No. 12 | Titanyl phthalocyanine | Significantly residual image observed |
| Comparative Example 3 | 15 | 25 | 0.6 | No. 12 | Titanyl phthalocyanine | Significantly residual image observed |
| Comparative Example 4 | 15 | 10 | 1.5 | No. 12 | Titanyl phthalocyanine | Background fouling |
| Comparative Example 5 | 15 | 15 | 1 | II-6 | Titanyl phthalocyanine | Significantly residual image observed |
| Comparative Example 6 | 15 | 15 | 1 | Compound represented by Chemical formula 23 | Titanyl phthalocyanine | Significantly residual image observed |
| Comparative Example 7 | 22 | 15 | 1.47 | No. 12 | Titanyl phthalocyanine and azo pigment | Residual image rather observed |

TABLE 7-continued

| | Surface layer Layer thickness (t1) (μm) | Charge transport layer Layer thickness (t2) (μm) | Ratio of layer thickness (t1)/(t2) | Charge transport layer Compound | Charge generation material | Evaluation result |
|---|---|---|---|---|---|---|
| Comparative Example 8 | 8 | 15 | 0.53 | No. 12 | Titanyl phthalocyanine and azo pigment | Residual image rather observed |

As seen in the results shown in Table 7, any of the image bearing members of Examples of the present invention is still capable of producing quality images even after a run length of 1,000,000 prints.

Examples 13 to 17

Next, imagioNeo 1050Pro (manufactured by Ricoh Co., Ltd.) in which a toner image developed on the image bearing member is directly transferred to paper is remodeled in such a manner that the linear velocity and transfer current can be changed. Furthermore, to measure the surface voltage of the image bearing member immediately after the image bearing member is charged and after a toner image is transferred to paper, a surface electrometer is attached on the downstream relative to the charging device and on the downstream relative to the cleaning blade.

The image bearing member of Example 1 is installed in a process cartridge for electrophotography and actual machine tests for durability are performed at the imagioNeo 1050 Pro (manufactured by Ricoh Co., Ltd.) with a continuous run length of 1,000,000 impressions on PPC A4 paper (landscape) varying the linear velocity and the transfer current.

Thereafter, the surface voltage of the image bearing member is measured and the output images are evaluated by observation with naked eyes. The results are shown in Table 8.

TABLE 8

| | Linear velocity (mm/s) | Transfer current (μA) | Voltage after charging (V) | Voltage after transfer (V) | Image |
|---|---|---|---|---|---|
| Example 13 | 500 | 120 | −800 | 190 | No abnormal image |
| Example 14 | 600 | 120 | −800 | 110 | No abnormal image |
| Example 15 | 700 | 120 | −800 | 65 | No abnormal image |
| Example 16 | 500 | 100 | −800 | 120 | No abnormal image |
| Example 17 | 500 | 80 | −800 | 30 | Slightly transfer dust observed but good as a whole |

As seen in the results of Table 8, in the case of an image forming apparatus in which the image bearing member of the present invention rotates at a linear velocity of not less than 500 mm/s, a toner image developed on the image bearing member is directly transferred to paper and the polarity of the surface voltage thereof after the toner image is transferred to the paper is the reversed polarity to that of the surface voltage when the image bearing member is charged, the image forming apparatus maintains the quality of output images in each condition after the paper running test with a run length of 1,000,000 sheets.

Example 18

The liquid application for undercoating layer, the liquid application for charge generation layer and the liquid application for charge transport layer having the following compositions are sequentially coated on an aluminum cylinder by a dip coating method. Subsequent to drying, an undercoating layer having a thickness of 3.5 μm, a charge generation layer having a thickness of 0.2 μm and a charge transport layer having a thickness of 15 μm are formed.

Liquid Application for Undercoating Layer

| | |
|---|---|
| Alkyd resin (Beckozole 1307-60-EL, available from Dainippon Ink and Chemicals, Inc.) | 6 parts |
| Melamine resin (Super-beckamine, available from Dainippon Ink and Chemicals, Inc.) | 4 parts |
| Titanium oxide | 40 parts |
| Methylethylketone | 50 parts |

Liquid Application for Charge Generation Layer

| | |
|---|---|
| Titanyl phthalocyanine pigment synthesized above: | 1.5 parts |
| Polyvinyl acetate: (BM-S, manufactured by Sekisui Chemical Co., Ltd.) | 0.5 parts |
| Methylethyl ketone | 70 parts |

Liquid Application for Charge Transport Layer

| | |
|---|---|
| Bisphenol Z type polycarbonate resin (PANLITE TS-2050, manufactured by Teijin Chemicals Ltd.) | 10 parts |
| Charge transport compound having the following chemical structure (Compound BN-27 illustrated above) | 10 parts |

Compound BN-27

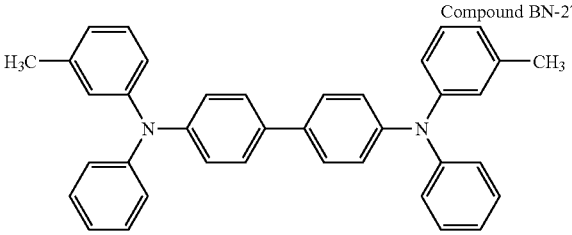

| | |
|---|---|
| Tetrahydrofuran: | 100 parts |
| Tetrahydrofuran solution of 1% silicone oil (KF50-100CS, manufactured by Shin-Etsu Chemical Co., Ltd.) | 1 part |

The image bearing member of the present invention is obtained by spray-coating a liquid application for surface protective layer having the following recipe on the charge transport layer and irradiating with light by a metal halide lamp under the condition of irradiation intensity of 500 mW/cm$^2$ and an irradiation time of 240 seconds followed by drying at 130° C. for 30 minutes to form a surface protective layer having a thickness of 15 μm.

| Liquid Application for Surface Protective Layer | |
|---|---|
| Monomer having at least three radical polymerizable functional groups without a charge transport structure | |
| (1) Trimethylolpropantriacrylate represented by Chemical formula 20 (TMPTA, manufactured by Tokyo Chemical Industry Co., Ltd.) | 55 parts |

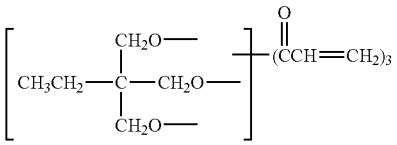

| | |
|---|---|
| (2) Alkyl modified dipenta erythritol pentaacrylate represented by Chemical formula 21: (KAYARADD-310, manufactured by Nippon Kayaku Co., Ltd.) | 40 parts |

Chemical formula 21

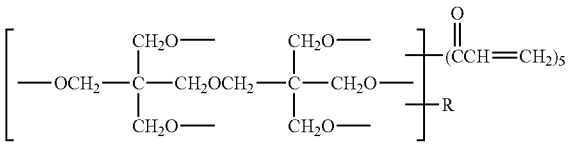

| | |
|---|---|
| In Chemical formula 21, R represents butyl group. | |
| Monomer having one radical polymerizable functional group with a charge transport structure (Compound Example No. 54 illustrated above) | 95 parts |

Example 19

The image bearing member of Example 19 is manufactured in the same manner as in Example 18 except that the layer thickness of the surface protective layer is changed to 19 μm.

Example 20

The image bearing member of Example 20 is manufactured in the same manner as in Example 18 except that the layer thickness of the surface protective layer is changed to 11 μm.

Example 21

The image bearing member of Example 21 is manufactured in the same manner as in Example 18 except that the layer thickness of the charge transport layer is changed to 20 μm.

Example 22

The image bearing member of Example 22 is manufactured in the same manner as in Example 18 except that the layer thickness of the charge transport layer is changed to 12 μm.

Example 23

The image bearing member of Example 23 is manufactured in the same manner as in Example 18 except that the charge transport compound contained in the charge transport layer is changed to the compound represented by the following chemical structure:

| | |
|---|---|
| Charge transport compound represented by the following chemical structure (BN-03 illustrated above) | 10 parts |

BN-03

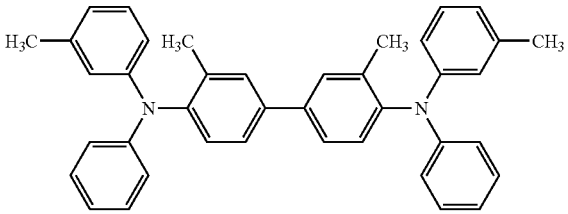

Example 24

The image bearing member of Example 24 is manufactured in the same manner as in Example 18 except that the charge transport compound contained in the charge transport layer is changed to the compound represented by the following chemical structure:

| | |
|---|---|
| Charge transport compound represented by the following chemical structure (BN-28 illustrated above) | 10 parts |

BN-28

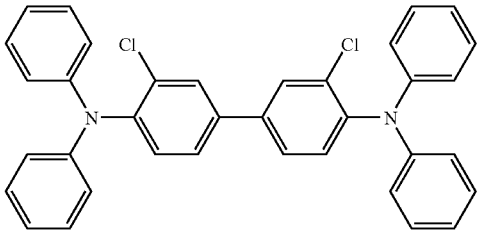

Example 25

The image bearing member of Example 25 is manufactured in the same manner as in Example 18 except that the charge transport compound contained in the charge transport layer is changed to the following compounds:

| | |
|---|---|
| Charge transport compound represented by the following chemical structure (BN-27 illustrated above) | 7 parts |
| Charge transport compound II-6: | 3 parts |

Example 26

The image bearing member of Example 26 is manufactured in the same manner as in Example 18 except that the layer thickness of the surface protective layer is changed to 19 μm and the charge transport compound contained in the charge transport layer is changed to the following compounds:

| | |
|---|---|
| Charge transport compound represented by the following chemical structure (BN-27 illustrated above) | 7 parts |
| Charge transport compound II-6: | 3 parts |

Example 27

The image bearing member of Example 27 is manufactured in the same manner as in Example 18 except that the layer thickness of the surface protective layer is changed to 11 μm and the charge transport compound contained in the charge transport layer is changed to the following compounds:

| | |
|---|---|
| Charge transport compound represented by the following chemical structure (BN-27 illustrated above) | 7 parts |
| Charge transport compound II-6: | 3 parts |

Example 28

The image bearing member of Example 28 is manufactured in the same manner as in Example 18 except that the liquid application for charge generation layer is changed to the following:

| Liquid Application for Charge Generation Layer | |
|---|---|
| Pigment of Synthesis Example of Titanylphthalocyanine pigment described above: | 1.0 part |
| Disazo pigment represented by the following chemical formula 22: | 1.0 part |

Chemical formula 22

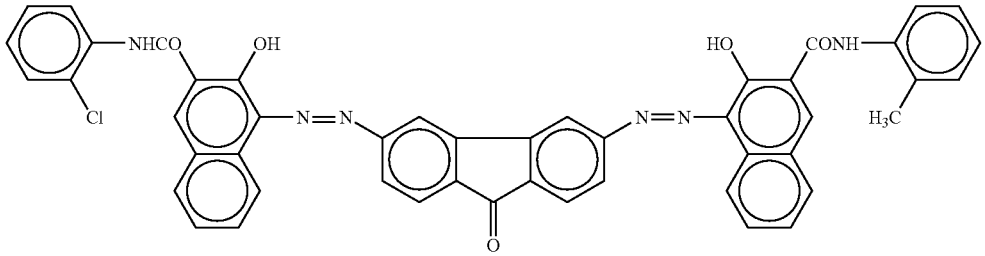

| | |
|---|---|
| Polyvinyl acetal (BM-S, manufactured by Sekisui Chemical Co., Ltd.) | 0.8 parts |
| Methylethyl ketone | 30 parts |
| Cyclohexanone | 40 parts |

Example 29

The image bearing member of Example 29 is manufactured in the same manner as in Example 18 except that the liquid application for charge generation layer is changed to the following:

| Liquid Application for Charge Generation Layer | |
|---|---|
| Galliumphthalocyanine pigment: | 1.5 parts |
| Polyvinylacetal (BM-S, manufactured by Sekisui Chemical Co., Ltd.) | 0.5 parts |
| Methylethyl ketone | 70 parts |

Comparative Example 9

The image bearing member of Comparative Example 9 is manufactured in the same manner as in Example 18 except that the layer thickness of the surface protective layer is changed to 22 μm.

Comparative Example 10

The image bearing member of Comparative Example 10 is manufactured in the same manner as in Example 18 except that the layer thickness of the surface protective layer is changed to 8 μm.

Comparative Example 11

The image bearing member of Comparative Example 11 is manufactured in the same manner as in Example 18 except that the layer thickness of the charge transport layer is changed to 25 μm.

Comparative Example 12

The image bearing member of Comparative Example 12 is manufactured in the same manner as in Example 18 except that the layer thickness of the charge transport layer is changed to 10 μm.

Comparative Example 13

The image bearing member of Comparative Example 13 is manufactured in the same manner as in Example 18 except that the charge transport compound contained in the charge transport layer is changed to the following compound:

| | |
|---|---|
| Charge transport compound II-6 | 10 parts |

Comparative Example 14

The image bearing member of Comparative Example 14 is manufactured in the same manner as in Example 18 except that the charge transport compound contained in the charge transport layer is changed to the following compound:

Charge transport compound represented by Chemical formula 23: 10 parts

Chemical formula 23

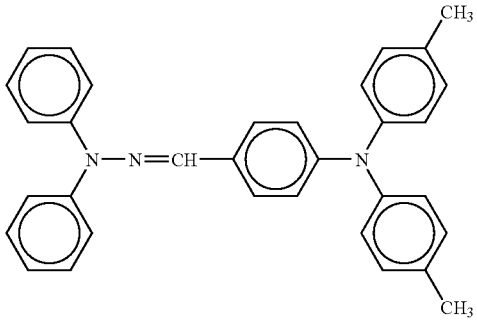

Comparative Example 15

The image bearing member of Comparative Example 15 is manufactured in the same manner as in Example 28 except that the layer thickness of the surface protective layer is changed to 22 μm.

Comparative Example 16

The image bearing member of Comparative Example 16 is manufactured in the same manner as in Example 28 except that the layer thickness of the surface protective layer is changed to 8 μm.

The image bearing members manufactured as described above are installed in a process cartridge for electrophotography and an actual machine test for durability is performed at imagioNeo 1050 Pro (manufactured by Ricoh Co., Ltd.) with a continuous run length of 1,000,000 impressions on PPC having a size of A4 (landscape). The output images are evaluated by observation with naked eyes. The results are shown in Table 9.

Actual Machine Test

Linear velocity of image bearing member: 500 mm/s

Charge condition: Set to 800 (−V) at image bearing member

Transfer condition: Set to 110 (μA) for transfer current

TABLE 9

| | Surface layer Layer thickness (t1) (μm) | Charge transport layer Layer thickness (t2) (μm) | Ratio of layer thickness (t1)/(t2) | Charge transport layer Compound | Charge generation material | Evaluation result |
|---|---|---|---|---|---|---|
| Example 18 | 15 | 15 | 1 | BN-27 | Titanyl phthalocyanine | No abnormal image |
| Example 19 | 19 | 15 | 1.27 | BN-27 | Titanyl phthalocyanine | No abnormal image |
| Example 20 | 11 | 15 | 0.73 | BN-27 | Titanyl phthalocyanine | No abnormal image |
| Example 21 | 15 | 20 | 0.75 | BN-27 | Titanyl phthalocyanine | No abnormal image |
| Example 22 | 15 | 12 | 1.25 | BN-27 | Titanyl phthalocyanine | No abnormal image |
| Example 23 | 15 | 15 | 1 | BN-03 | Titanyl phthalocyanine | No abnormal image |
| Example 24 | 15 | 15 | 1 | BN-28 | Titanyl phthalocyanine | No abnormal image |
| Example 25 | 15 | 15 | 1 | BN-27 and II-6 | Titanyl phthalocyanine | No abnormal image |
| Example 26 | 19 | 15 | 1.27 | BN-27 and II-6 | Titanyl phthalocyanine | No abnormal image |
| Example 27 | 11 | 15 | 0.73 | BN-27 and II-6 | Titanyl phthalocyanine | No abnormal image |
| Example 28 | 15 | 15 | 1 | BN-27 | Titanyl phthalocyanine and azo pigment | No abnormal image |
| Example 29 | 15 | 15 | 1 | BN-27 | Gallium phthalocyanine | Slightly residual image observed but good as a whole |
| Comparative Example 9 | 22 | 15 | 1.47 | BN-27 | Titanyl phthalocyanine | Significantly residual image observed |
| Comparative Example 10 | 8 | 15 | 0.53 | BN-27 | Titanyl phthalocyanine | Significantly residual image observed |

TABLE 9-continued

| | Surface layer Layer thickness (t1) (μm) | Charge transport layer Layer thickness (t2) (μm) | Ratio of layer thickness (t1)/(t2) | Charge transport layer Compound | Charge generation material | Evaluation result |
|---|---|---|---|---|---|---|
| Comparative Example 11 | 15 | 25 | 0.6 | BN-27 | Titanyl phthalocyanine | Significantly residual image observed |
| Comparative Example 12 | 15 | 10 | 1.5 | BN-27 | Titanyl phthalocyanine | Background fouling |
| Comparative Example 13 | 15 | 15 | 1 | II-6 | Titanyl phthalocyanine | Significantly residual image observed |
| Comparative Example 14 | 15 | 15 | 1 | Compound represented by Chemical formula 23 | Titanyl phthalocyanine | Significantly residual image observed |
| Comparative Example 15 | 22 | 15 | 1.47 | BN-27 | Titanyl phthalocyanine and azo pigment | Residual image rather observed |
| Comparative Example 16 | 8 | 15 | 0.53 | BN-27 | Titanyl phthalocyanine and azo pigment | Residual image rather observed |

As seen in the results shown in Table 9, any of the image bearing members of Examples of the present invention is still capable of producing quality images even after a run length of 1,000,000 prints.

Examples 30 to 34

Next, imagioNeo 1050Pro (manufactured by Ricoh Co., Ltd.) in which a toner image developed on the image bearing member is directly transferred to paper is remodeled in such a manner that the linear velocity and transfer current can be changed. Furthermore, to measure the surface voltage of the image bearing member immediately after the image bearing member is charged and after a toner image is transferred to paper, a surface electrometer is attached on the downstream relative to the charging device and on the downstream relative to the cleaning blade.

The image bearing member of Example 18 is installed in a process cartridge for electrophotography and actual machine tests for durability are performed at the imagioNeo 1050 Pro (manufactured by Ricoh Co., Ltd.) with a continuous run length of 1,000,000 impressions on PPC A4 paper (landscape) varying the linear velocity and the transfer current.

Thereafter, the surface voltage of the image bearing member is measured and the output images are evaluated by observation with naked eyes. The results are shown in Table 10.

TABLE 10

| | Linear velocity (mm/s) | Transfer current (μA) | Voltage after charging (V) | Voltage after transfer (V) | Image |
|---|---|---|---|---|---|
| Example 30 | 500 | 120 | −800 | 190 | No abnormal image |
| Example 31 | 600 | 120 | −800 | 110 | No abnormal image |

TABLE 10-continued

| | Linear velocity (mm/s) | Transfer current (μA) | Voltage after charging (V) | Voltage after transfer (V) | Image |
|---|---|---|---|---|---|
| Example 32 | 700 | 120 | −800 | 70 | No abnormal image |
| Example 33 | 500 | 100 | −800 | 120 | No abnormal image |
| Example 34 | 500 | 80 | −800 | 30 | Slightly transfer dust observed but good as a whole |

As seen in the results of Table 10, in the case of an image forming apparatus in which the image bearing member of the present invention rotates at a linear velocity of not less than 500 mm/s, a toner image developed on the image bearing member is directly transferred to paper and the polarity of the surface voltage thereof after the toner image is transferred to the paper is the reversed polarity to that of the surface voltage when the image bearing member is charged, the image forming apparatus maintains the quality of output images in each condition after the paper running test with a run length of 1,000,000 sheets

Example 35

The liquid application for undercoating layer, the liquid application for charge generation layer and the liquid application for charge transport layer having the following compositions are sequentially coated on an aluminum cylinder by a dip coating method. Subsequent to drying, an undercoating layer having a thickness of 3.5 μm, a charge generation layer having a thickness of 0.2 μm and a charge transport layer having a thickness of 15 μm are formed.

| Liquid Application for Undercoating Layer | |
|---|---|
| Alkyd resin (Beckozole 1307-60-EL, available from Dainippon Ink and Chemicals, Inc.) | 6 parts |
| Melamine resin (Super-beckamine, available from Dainippon Ink and Chemicals, Inc.) | 4 parts |
| Titanium oxide | 40 parts |
| Methylethylketone | 50 parts |
| **Liquid Application for Charge Generation Layer** | |
| Titanyl phthalocyanine pigment synthesized above: | 1.5 parts |
| Polyvinyl acetate: (BM-S, manufactured by Sekisui Chemical Co., Ltd.) | 0.5 parts |
| Methylethyl ketone | 70 parts |
| **Liquid Application for Charge Transport Layer** | |
| Bisphenol Z type polycarbonate resin (PANLITE TS-2050, manufactured by Teijin Chemicals Ltd.) | 10 parts |
| Charge transport compound (BTA-08 illustrated above) | 10 parts |
| Tetrahydrofuran: | 100 parts |
| Tetrahydrofuran solution of 1% silicone oil (KF50-100CS, manufactured by Shin-Etsu Chemical Co., Ltd.) | 1 part |

The image bearing member of the present invention is obtained by spray-coating a liquid application for surface protective layer having the following recipe on the charge transport layer and irradiating with light by a metal halide lamp under the condition of irradiation intensity of 500 mW/cm$^2$ and an irradiation time of 240 seconds followed by drying at 130° C. for 30 minutes to form a surface protective layer having a thickness of 15 μm.

| Liquid Application for Surface Protective Layer | |
|---|---|
| Monomer having at least three radical polymerizable functional groups without a charge transport structure | |
| (1) Trimethylolpropantriacrylate represented by Chemical formula 20 (TMPTA, manufactured by Tokyo Chemical Industry Co., Ltd.) | 55 parts |

Chemical formula 20

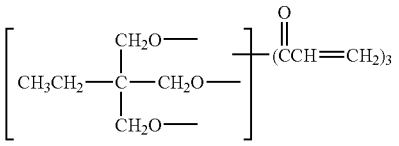

| | |
|---|---|
| (2) Alkyl modified dipenta erythritol pentaacrylate represented by Chemical formula 21: (KAYARADD-310, manufactured by Nippon Kayaku Co., Ltd.) | 40 parts |

Chemical formula 21

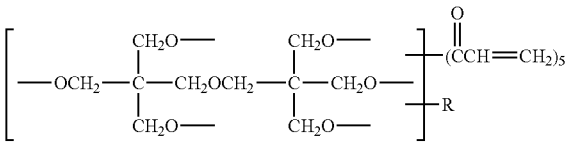

In Chemical formula 21, R represents butyl group.

| | |
|---|---|
| Monomer having one radical polymerizable functional group with a charge transport structure (Compound Example No. 54 illustrated above) | 95 parts |
| Photo-polymerization initiator 1-hydroxy-cyclohexyl-phenyl-keton (IRGACURE 184, manufactured by Chiba Specialty Chemicals K.K.) | 10 parts |
| Tetrahydrofuran | 1,200 parts |

Example 36

The image bearing member of Example 36 is manufactured in the same manner as in Example 35 except that the layer thickness of the surface protective layer is changed to 19 μm.

Example 37

The image bearing member of Example 37 is manufactured in the same manner as in Example 35 except that the layer thickness of the surface protective layer is changed to 11 μm.

Example 38

The image bearing member of Example 384 is manufactured in the same manner as in Example 35 except that the layer thickness of the charge transport layer is changed to 20 μm.

Example 39

The image bearing member of Example 39 is manufactured in the same manner as in Example 35 except that the layer thickness of the charge transport layer is changed to 12 μm.

Example 40

The image bearing member of Example 40 is manufactured in the same manner as in Example 35 except that the charge transport compound (BTA-08) contained in the charge transport layer is changed to the charge transport compound (BTA-20).

Example 41

The image bearing member of Example 41 is manufactured in the same manner as in Example 35 except that the charge transport compound (BTA-08) contained in the charge transport layer is changed to the charge transport compound (BTA-78).

Example 42

The image bearing member of Example 42 is manufactured in the same manner as in Example 35 except that the charge transport compound (10 parts of BTA-08) contained in the charge transport layer is changed to 7 parts of the charge transport compound (BTA-08) and 3 parts of the charge transport compound (II-6).

Example 43

The image bearing member of Example 43 is manufactured in the same manner as in Example 35 except that the layer thickness of the surface protective layer is changed to 19 μm and the charge transport compound (10 parts of BTA-08) contained in the charge transport layer is changed to 7 parts of the charge transport compound (BTA-08) and 3 parts of the charge transport compound (II-6).

Example 44

The image bearing member of Example 44 is manufactured in the same manner as in Example 35 except that the layer thickness of the surface protective layer is changed to 11 μm and the charge transport compound (10 parts of BTA-08) contained in the charge transport layer is changed to 7 parts of the charge transport compound (BTA-08) and 3 parts of the charge transport compound (II-6).

Example 45

The image bearing member of Example 45 is manufactured in the same manner as in Example 35 except that the liquid application for charge generation layer is changed to the following:

Comparative Example 19

The image bearing member of Comparative Example 19 is manufactured in the same manner as in Example 35 except that the layer thickness of the charge transport layer is changed to 25 μm.

Comparative Example 20

The image bearing member of Comparative Example 20 is manufactured in the same manner as in Example 35 except that the layer thickness of the charge transport layer is changed to 10 μm.

| Liquid Application for Charge Generation Layer | |
|---|---|
| Pigment of Synthesis Example of Titanylphthalocyanine pigment described above: | 1.0 part |
| Disazo pigment represented by the following chemical formula 22: | 1.0 part |

Chemical formula 22

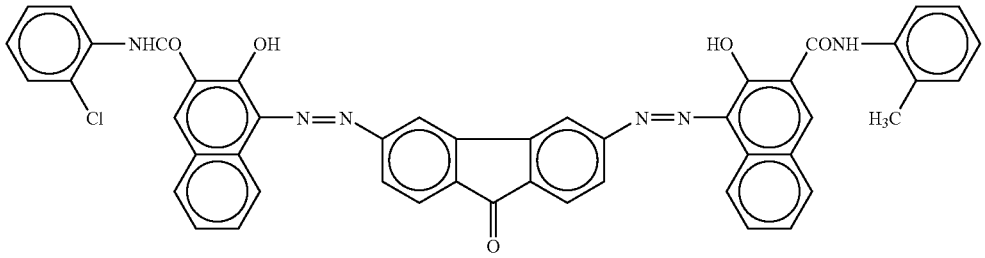

| | |
|---|---|
| Polyvinyl acetal (BM-S, manufactured by Sekisui Chemical Co., Ltd.) | 0.8 parts |
| Methylethyl ketone | 30 parts |
| Cyclohexanone | 40 parts |

Example 46

The image bearing member of Example 46 is manufactured in the same manner as in Example 35 except that the liquid application for charge generation layer is changed to the following:

| Liquid Application for Charge Generation Layer | |
|---|---|
| Galliumphthalocyanine pigment: | 1.5 parts |
| Polyvinylacetal (BM-S, manufactured by Sekisui Chemical Co., Ltd.) | 0.5 parts |
| Methylethyl ketone | 70 parts |

Comparative Example 17

The image bearing member of Comparative Example 17 is manufactured in the same manner as in Example 35 except that the layer thickness of the surface protective layer is changed to 22 μm.

Comparative Example 18

The image bearing member of Comparative Example 18 is manufactured in the same manner as in Example 35 except that the layer thickness of the surface protective layer is changed to 8 μm.

Comparative Example 21

The image bearing member of Comparative Example 5 is manufactured in the same manner as in Example 1 except that the charge transport compound (10 parts of BTA-08) contained in the charge transport layer is changed to the following compound:

| | |
|---|---|
| Charge transport compound II-6 | 10 parts |

Comparative Example 22

The image bearing member of Comparative Example 22 is manufactured in the same manner as in Example 35 except that the charge transport compound contained in the charge transport layer is changed to the following compound:

| | |
|---|---|
| Charge transport compound represented by Chemical formula 23: | 10 parts |

Chemical formula 23

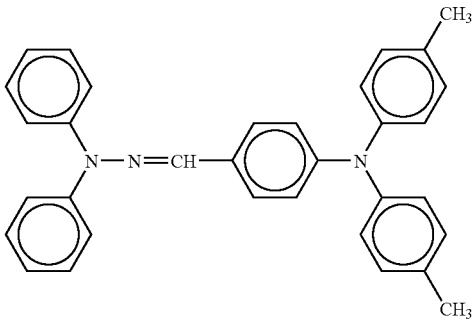

The image bearing members manufactured as described above are installed in a process cartridge for electrophotography and an actual machine test for durability is performed at imagioNeo 1050 Pro (manufactured by Ricoh Co., Ltd.) with a continuous run length of 1,000,000 impressions. The output images are evaluated by observation with naked eyes. The results are shown in Table 11.

TABLE 11

| | Surface layer Layer thickness (t1) (μm) | Charge transport layer Layer thickness (t2) (μm) | Ratio of layer thickness (t1)/(t2) | Charge transport layer Compound | Charge generation material | Evaluation result |
|---|---|---|---|---|---|---|
| Example 35 | 15 | 15 | 1 | BTA-08 | Titanyl phthalocyanine | No abnormal image |
| Example 36 | 19 | 15 | 1.27 | BTA-08 | Titanyl phthalocyanine | No abnormal image |
| Example 37 | 11 | 15 | 0.73 | BTA-08 | Titanyl phthalocyanine | No abnormal image |
| Example 38 | 15 | 20 | 0.75 | BTA-08 | Titanyl phthalocyanine | No abnormal image |
| Example 39 | 15 | 12 | 1.25 | BTA-08 | Titanyl phthalocyanine | No abnormal image |
| Example 40 | 15 | 15 | 1 | BTA-20 | Titanyl phthalocyanine | No abnormal image |
| Example 41 | 15 | 15 | 1 | BTA-78 | Titanyl phthalocyanine | No abnormal image |
| Example 42 | 15 | 15 | 1 | BTA-08 and II-6 | Titanyl phthalocyanine | No abnormal image |
| Example 43 | 19 | 15 | 1.27 | BTA-08 and II-6 | Titanyl phthalocyanine | No abnormal image |
| Example 44 | 11 | 15 | 0.73 | BTA-08 and II-6 | Titanyl phthalocyanine | No abnormal image |
| Example 45 | 15 | 15 | 1 | BTA-08 | Titanyl phthalocyanine and azo pigment | No abnormal image |
| Example 46 | 15 | 15 | 1 | BTA-08 | Gallium phthalocyanine | Slightly residual image observed but good as a whole |
| Comparative Example 17 | 22 | 15 | 1.47 | BTA-08 | Titanyl phthalocyanine | Significantly residual image observed |
| Comparative Example 18 | 8 | 15 | 0.53 | BTA-08 | Titanyl phthalocyanine | Significantly residual image observed |
| Comparative Example 19 | 15 | 25 | 0.6 | BTA-08 | Titanyl phthalocyanine | Significantly residual image observed |
| Comparative Example 20 | 15 | 10 | 1.5 | BTA-08 | Titanyl phthalocyanine | Background fouling |
| Comparative Example 21 | 15 | 15 | 1 | II-6 | Titanyl phthalocyanine | Significantly residual image observed |
| Comparative Example 22 | 15 | 15 | 1 | Compound represented by Chemical formula 23 | Titanyl phthalocyanine | Significantly residual image observed |

As seen in the results shown in Table 11, any of the image bearing members of Examples of the present invention is still capable of producing quality images even after a run length of 1,000,000 prints.

Examples 47 to 51

Next, imagioNeo 1050Pro (manufactured by Ricoh Co., Ltd.) in which a toner image developed on the image bearing member is directly transferred to paper is remodeled in such a manner that the linear velocity and transfer current can be changed. Furthermore, to measure the surface voltage of the image bearing member immediately after the image bearing member is charged and after a toner image is transferred to paper, a surface electrometer is attached on the downstream relative to the charging device and on the downstream relative to the cleaning blade.

The image bearing member of Example 35 is installed in a process cartridge for electrophotography and actual machine tests for durability are performed at the imagioNeo 1050 Pro (manufactured by Ricoh Co., Ltd.) with a continuous run length of 1,000,000 impressions on PPC A4 paper (landscape) varying the linear velocity and the transfer current. Thereafter, the surface voltage of the image bearing member is measured and the output images are evaluated by observation with naked eyes. The results are shown in Table 12.

TABLE 12

| | Linear velocity (mm/s) | Transfer current (μA) | Voltage after charging (V) | Voltage after transfer (V) | Image |
|---|---|---|---|---|---|
| Example 13 | 500 | 120 | −800 | 220 | No abnormal image |
| Example 14 | 600 | 120 | −800 | 130 | No abnormal image |
| Example 15 | 700 | 120 | −800 | 70 | No abnormal image |
| Example 16 | 500 | 100 | −800 | 120 | No abnormal image |
| Example 17 | 500 | 80 | −800 | 40 | Slightly transfer dust observed but good as a whole |

As seen in the results of Table 12, in the case of an image forming apparatus in which the image bearing member of the present invention rotates at a linear velocity of not less than 500 mm/s, a toner image developed on the image bearing member is directly transferred to paper and the polarity of the surface voltage thereof after the toner image is transferred to the paper is the reversed polarity to that of the surface voltage when the image bearing member is charged, the image forming apparatus maintains the quality of output images in each condition after the paper running test with a run length of 1,000,000 sheets.

As described above, according to the image bearing member of the present invention, it is possible to output high definition images without producing abnormal images having, for example, residual images even after a run length of one million or more at a high speed because the image bearing member has and maintains a high durability and excellent electric characteristics for an extended period of time.

Therefore, when the image bearing member of the present invention is applied in an image forming apparatus, an image forming method or a process cartridge for an image forming apparatus, the demand for high speed performance and printing in large quantity can be met.

This document claims priority and contains subject matter related to Japanese Patent Applications Nos. 2007-047065, 2007-303020 and 2007-035170, filed on Feb. 27, 2007, Nov. 22, 2007 and Feb. 15, 2007, respectively, the entire contents of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image bearing member comprising:

an electroconductive substrate;

a charge generation layer;

a charge transport layer;

a cross-linking surface protective layer formed by curing at least a monomer having at least three radical polymerizable functional groups without a charge transport structure and a monomer having one radical polymerizable functional group with a charge transport structure, wherein a ratio (t1/t2) of a layer thickness (t1) of the cross linking surface protective layer to a layer thickness (t2) of the charge transport layer is from 0.7 to 1.3 and wherein the charge transport layer comprises a compound represented by chemical formula I:

Chemical formula I

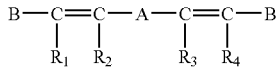

where $R_1$ to $R_4$ independently represent a hydrogen atom, an alkyl group having 1 to 4 carbon atoms, an alkoxy group having 1 to 4 carbon atoms, or a phenyl group optionally substituted by an alkyl group having 1 to 4 carbon atoms or an alkoxy group having 1 to 4 carbon atoms, A represents a substituted or non-substituted arylene group or a compound represented by chemical formula II Chemical formula II

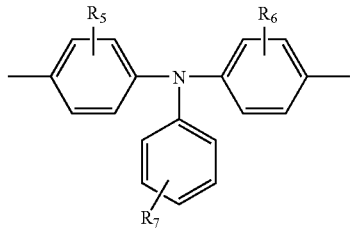

where $R_5$, $R_6$ and $R_7$ independently represent a hydrogen atom, an alkyl group having 1 to 4 carbon atoms, an alkoxy group having 1 to 4 carbon atoms, or a phenyl group optionally substituted by an alkyl group having 1 to 4 carbon atoms or an alkoxy group having 1 to 4 carbon atoms, B represents a substituted or non-substituted aryl group or a compound represented by Chemical formula III:

Chemical formula III

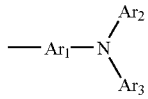

wherein $Ar_1$ represents an arylene group optionally by an alkyl group or alkoxy group having 1 to 4 carbon atoms, $Ar_2$ and $Ar_3$ independently represent an aryl group optionally substituted by an alkyl group or alkoxy group having 1 to 4 carbon atoms, and C is a carbon atom.

2. The image bearing member according to claim 1, wherein the charge transport layer further comprises a distyryl benzene derivative represented by chemical formula IV:

Chemical formula IV

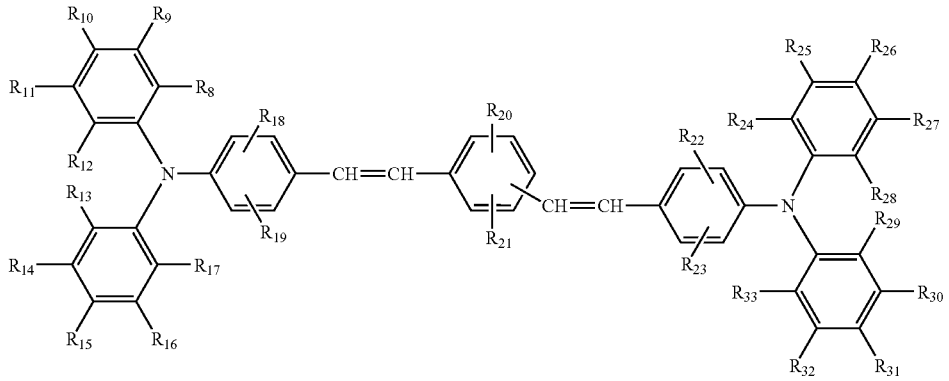

wherein $R_8$ to $R_{33}$ independently represent a hydrogen atom, an alkyl group having 1 to 4 carbon atoms, an alkoxy group having 1 to 4 carbon atoms, or a substituted or non-substituted phenyl group.

3. An image bearing member comprising:

an electroconductive substrate;

a charge generation layer;

a charge transport layer;

a cross-linking surface protective layer formed by curing at least a monomer having at least three radical polymerizable functional groups without a charge transport structure and a monomer having one radical polymerizable functional group with a charge transport structure, wherein a ratio (t1/t2) of a layer thickness (t1) of the cross linking surface protective layer to a layer thickness (t2) of the charge transport layer is from 0.7 to 1.3 and the charge transport layer comprises a compound represented by chemical formula V:

Chemical formula V

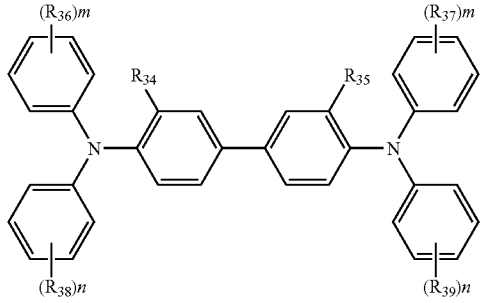

wherein, $R_{34}$ and $R_{35}$ independently represent a hydrogen atom, a halogen atom, an alkyl group, or an alkoxy group, $R_{36}$ to $R_{39}$ independently represent a hydrogen atom, a halogen atom, an alkyl group, an alkoxy group or a dialkylamino group and m and n independently represents 1 or 2.

4. An image bearing member comprising:

an electroconductive substrate;

a charge generation layer;

a charge transport layer;

a cross-linking surface protective layer formed by curing at least a monomer having at least three radical polymerizable functional groups without a charge transport structure and a monomer having one radical polymerizable functional group with a charge transport structure, wherein a ratio (t1/t2) of a layer thickness (t1) of the cross linking surface protective layer to a layer thickness (t2) of the charge transport layer is from 0.7 to 1.3 and the charge transport layer comprises a compound represented by Chemical formula VI:

Chemical formula VI

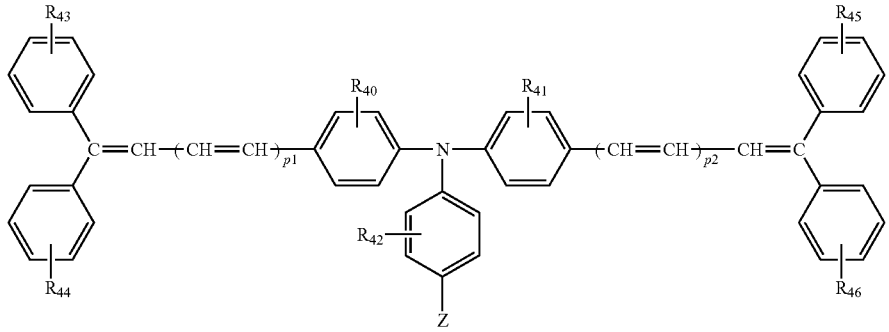

wherein $R_{40}$ to $R_{46}$ independently represent a hydrogen atom, a lower alkyl group, an alkoxy group, a phenoxy group, a halogen atom or a substituted or non-substituted aryl group, p1 and p2 independently represent 0 or 1, Z represents a hydrogen atom, a lower alkyl group, an alkoxy group, a phenoxy group, a halogen atom, a substituted or non-substituted aryl group or a group represented by Chemical formula VII, Chemical formula VIII or Chemical formula IX:

Chemical formula VII

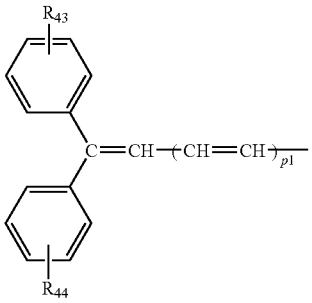

Chemical formula VIII

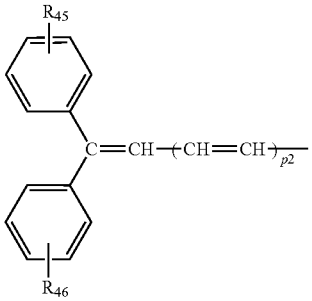

Chemical formula IX

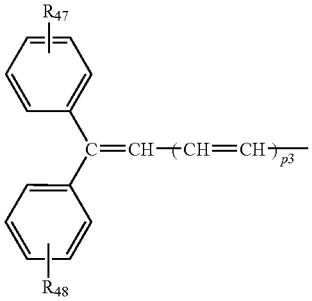

wherein $R_{43}$ to $R_{46}$, p1 and p2 independently represent 0 or 1, $R_{47}$ and $R_{48}$ independently represent a hydrogen atom, a lower alkyl group, an alkoxy group, a phenoxy group, a halogen atom, or a substituted or non-substituted aryl group, and p3 represents 0 or 1.

5. The image bearing member according to claim 1, wherein the layer thickness (t2) of the cross linking surface protective layer is from 10 to 20 μm.

6. The image bearing member according to claim 2, wherein the layer thickness (t2) of the cross linking surface protective layer is 10 to 20 μm.

7. The image bearing member according to claim 3, wherein the layer thickness (t3) of the cross linking surface protective layer is 10 to 20 μm.

8. The image bearing member according to claim 4, wherein the layer thickness (t3) of the cross linking surface protective layer is 10 to 20 μm.

9. The image bearing member according to claim 1, wherein the charge transport layer further comprises a compound represented by Chemical formula X:

Chemical formula X

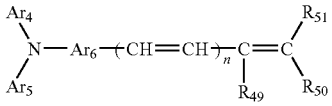

wherein $Ar_4$ and $Ar_5$ independently represent a substituted or non-substituted aryl group or a substituted or non-substituted heterocyclic ring, $R_{49}$, $R_{50}$ and $R_{51}$ independently represent a hydrogen atom, a substituted or non-substituted alkyl group, a substituted or non-substituted alkoxy group, a substituted or non-substituted aryl group, or a substituted or non-substituted heterocyclic group, $R_{50}$ and $R_{51}$ optionally share bond connectivity to form a ring, $Ar_6$ represents a substituted or non-substituted arylene group and n represents 0 or 1.

10. The image bearing member according to claim 2, wherein the charge transport layer further comprises a compound represented by Chemical formula X:

Chemical formula X

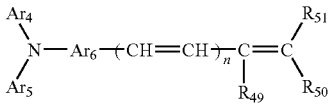

wherein $Ar_4$ and $Ar_5$ independently represent a substituted or non-substituted aryl group or a substituted or non-substituted heterocyclic ring, $R_{49}$, $R_{50}$ and $R_{51}$ independently represent a hydrogen atom, a substituted or non-substituted alkyl group, a substituted or non-substituted alkoxy group, a substituted or non-substituted aryl group, or a substituted or non-substituted heterocyclic group, $R_{50}$ and $R_{51}$ optionally share bond connectivity to form a ring, $Ar_6$ represents a substituted or non-substituted arylene group and n represents 0 or 1.

11. The image bearing member according to claim 3, wherein the charge transport layer further comprises a compound represented by Chemical formula X:

Chemical formula X

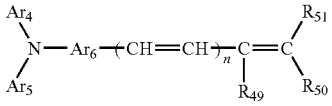

wherein $Ar_4$ and $Ar_5$ independently represent a substituted or non-substituted aryl group or a substituted or non-substituted heterocyclic ring, $R_{49}$, $R_{50}$ and $R_{51}$ independently represent a hydrogen atom, a substituted or non-substituted alkyl group, a substituted or non-substituted alkoxy group, a substituted or non-substituted aryl group, or a substituted or non-substituted heterocyclic group, $R_{50}$ and $R_{51}$ optionally share bond connectivity to form a ring, $Ar_6$ represents a substituted or non-substituted arylene group and n represents 0 or 1.

12. The image bearing member according to claim 1, wherein the charge generation layer comprises a titanyl phthalocyanine pigment.

13. The image bearing member according to claim 2, wherein the charge generation layer comprises a titanyl phthalocyanine pigment.

14. The image bearing member according to claim 3, wherein the charge generation layer comprises a titanyl phthalocyanine pigment.

15. The image bearing member according to claim 1, wherein the monomer having one radical polymerizable functional group with a charge transport structure comprises an acryloyloxy group or a methacryloyloxy group as the functional group.

16. The image bearing member according to claim 2, wherein the monomer having one radical polymerizable functional group with a charge transport structure comprises an acryloyloxy group or a methacryloyloxy group as the functional group.

17. The image bearing member according to claim 3, wherein the monomer having one radical polymerizable functional group with a charge transport structure comprises an acryloyloxy group or a methacryloyloxy group as the functional group.

18. An image forming apparatus comprising:

the image bearing member of claim 1 configured to bear a latent electrostatic image;

a charge device configured to charge the image bearing member;

an irradiation device configured to irradiate a surface of the image bearing member to form the latent electrostatic image;

a development device configured to develop the latent electrostatic image with a development agent; and a transfer device configured to transfer the developed image to a transfer medium, wherein the developed image on the image bearing member rotating at a linear speed of not less than 500 mm/s is directly transferred to the transfer medium and a polarity of the surface of the image bearing member after the developed image is transferred to the transfer medium is opposite to a polarity when the image bearing member is charged.

19. An image forming apparatus comprising:

the image bearing member of claim 2 configured to bear a latent electrostatic image;

a charge device configured to charge the image bearing member;

an irradiation device configured to irradiate a surface of the image bearing member to form the latent electrostatic image;

a development device configured to develop the latent electrostatic image with a development agent; and a transfer device configured to transfer the developed image to a transfer medium, wherein the developed image on the image bearing member rotating at a linear speed of not less than 500 mm/s is directly transferred to the transfer medium and a polarity of the surface of the image bearing member after the developed image is transferred to the transfer medium is opposite to a polarity when the image bearing member is charged.

20. An image forming apparatus comprising:

the image bearing member of claim 3 configured to bear a latent electrostatic image;

a charge device configured to charge the image bearing member;

an irradiation device configured to irradiate a surface of the image bearing member to form the latent electrostatic image;

a development device configured to develop the latent electrostatic image with a development agent; and a transfer device configured to transfer the developed image to a transfer medium, wherein the developed image on the image bearing member rotating at a linear speed of not less than 500 mm/s is directly transferred to the transfer medium and a polarity of the surface of the image bearing member after the developed image is transferred to the transfer medium is opposite to a polarity when the image bearing member is charged.

* * * * *